US012742368B2

(12) United States Patent
Andreychuk et al.

(10) Patent No.: US 12,742,368 B2
(45) Date of Patent: Sep. 22, 2026

(54) DOWNHOLE TOOL SYSTEM COMPRISING HYDRAULICALLY ACTUATED SHIFTING ASSEMBLY AND RELATED METHODS

(71) Applicant: 2345434 Alberta Inc., Calgary (CA)

(72) Inventors: Mark Andreychuk, Calgary (CA); Jeff Kennedy, Calgary (CA); Per Angman, Calgary (CA); Allan Petrella, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 146 days.

(21) Appl. No.: 18/742,452

(22) Filed: Jun. 13, 2024

(65) Prior Publication Data

US 2024/0418056 A1 Dec. 19, 2024

Related U.S. Application Data

(60) Provisional application No. 63/472,735, filed on Jun. 13, 2023.

(51) Int. Cl.
*E21B 34/14* (2006.01)
*E21B 23/04* (2006.01)

(52) U.S. Cl.
CPC ..... *E21B 34/14* (2013.01); *E21B 23/0411* (2020.05); *E21B 2200/06* (2020.05)

(58) Field of Classification Search
CPC ... E21B 2200/06; E21B 23/0411; E21B 34/14
See application file for complete search history.

(56) References Cited

U.S. PATENT DOCUMENTS

| | | | |
|---|---|---|---|
| 10,024,150 B2 | 7/2018 | Andreychuk et al. | |
| 10,605,061 B2 | 3/2020 | Andreychuk et al. | |
| 11,346,169 B2 | 5/2022 | Andreychuk et al. | |
| 11,365,606 B2 | 6/2022 | Andreychuk et al. | |
| 2021/0148179 A1* | 5/2021 | Petrella | E21B 34/08 |

FOREIGN PATENT DOCUMENTS

| | | | |
|---|---|---|---|
| WO | WO-2022251946 A1 * | 12/2022 | E21B 34/14 |

* cited by examiner

*Primary Examiner* — Caroline N Butcher
(74) *Attorney, Agent, or Firm* — Parlee McLaws LLP

(57) ABSTRACT

A downhole tool system is provided for use within a casing string including a sleeve valve comprising a shiftable inner sleeve. The downhole tool system comprises a locator tool, an anchor tool, and a shifting tool. The locator tool comprises at least one sleeve engagement member that is hydraulically actuatable from a radially retracted configuration to a radially extended configuration for engaging the shiftable inner sleeve. The anchor tool comprises at least one anchor member that is hydraulically actuatable from a radially retracted configuration to a radially extended configuration for gripping an inner wall of the casing string. The shifting tool is positioned between the locating tool and the anchor tool and is movable between an axially extended configuration and an axially contracted configuration. The shifting tool is hydraulically actuatable to move from the axially extended configuration to the axially contracted configuration, for shifting the inner sleeve.

15 Claims, 31 Drawing Sheets

DOWNHOLE TOOL SYSTEM COMPRISING HYDRAULICALLY ACTUATED SHIFTING ASSEMBLY AND RELATED METHODS

RELATED APPLICATION

The present application claims priority to U.S. Provisional Patent Application No. 63/472,735, titled "Downhole System Including Hydraulically Actuated Shifting Assembly for Opening and Closing Sleeve Valves" and filed Jun. 13, 2023, the entire contents of which are incorporated herein by reference.

FIELD OF THE DISCLOSURE

The present disclosure relates to downhole tools for wellbore operations. More specifically, the present disclosure relates to bottom hole assemblies for opening and closing sleeve valves.

BACKGROUND

Sleeve valves in a casing string may be used for selectively covering and exposing ports in the casing string. A sleeve valve may comprise a tubular housing with one or more ports extending therethrough and an axially shiftable inner sleeve mounted within the housing. The inner sleeve may be shiftable between opened and closed positions within the housing. In the closed position, the inner sleeve covers the one or more ports and blocks fluid flow therethrough. In the opened position the inner sleeve does not cover the one or more ports, such that fracturing fluid and/or treatment fluid may be pumped downhole and enter a surrounding earth formation through the ports. Sleeve valves are typically spaced along a casing string for sequential use in stages of a fracturing operation. A downhole tool system may include equipment used for shifting the inner sleeve. The downhole tool system may be a Bottom Hole Assembly (BHA) and equipment of the BHA for use in opening or closing a sleeve valve may be referred to as a "shifting assembly". In a single-shift operation, an open-only sleeve valve may be opened by shifting the inner sleeve from a closed position to an opened position. Alternatively, a sleeve valve may be manipulated to both open and to close the sleeve valve in a multi-cycle operation. Sleeve valves may be configured to be opened by shifting the inner sleeve up (from a downhole sleeve position to an uphole sleeve position). Alternatively, the sleeve valves may be configured to open by shifting the inner sleeve down (from an uphole sleeve position to a downhole sleeve position).

A BHA may be run downhole through the casing string for opening and closing sleeve assemblies. The BHA may be connected to the downhole end of coiled tubing, for example. The BHA may sequentially manipulate a large number of sleeve valves (cemented or uncemented) spaced along a casing string extending downhole for fracturing in an oil or gas well (vertical, deviated or horizontal). At each fracturing stage, a respective sleeve valve may be opened, and an isolation tool such as a resettable packer can be positioned to isolate each treated zone below from the next uphole zone above. Open-only sleeve valves are typically operated in a toe-to-heel treatment and, for each treatment.

There are several challenges or drawbacks of existing sleeve valve shifting systems. When shifting inner sleeves of a sleeve valve using a shifting assembly in a BHA, coiled tubing tension (from pulling up) or coiled tubing compression (from running in hole) may be used for mechanically shifting the inner sleeve up/down. However, mechanical force from the coiled tubing is often insufficient for shifting the inner sleeve from an uphole sleeve position to the downhole sleeve position, particularly in deep wells. Thus, some existing systems utilize pressure in the annulus for assisting with shifting an inner sleeve down.

Some systems include a sleeve locator and a resettable packer (or "plug") or other isolator element to grip the inner sleeve and then fill the annulus to allow hydraulic movement of the sleeve by building annulus pressure above the packer. However, in such systems, the inner sleeve must have sufficient length to accommodate both the locator and the packer. Additional sleeve length translates into additional material and manufacturing complexity and cost. Further, the heavy inner sleeves are more difficult to manage, even requiring the implementation of additional equipment simply for handling during makeup of the string. Utilizing annulus pressure to shift the inner sleeve may also require a significant amount of fluid and time to sufficiently pressure-up the annulus.

Another challenge with conventional sleeve valves and bottom hole assemblies is the number of cycles required to open and/or close the sleeve valves and/or perform fracturing. Each cycle may comprise downhole ("run in hole" or "RIH") movement or uphole ("pull out of hole" or "POOH") movement of the BHA. Several cycles may be required to perform various steps and actuate equipment in a sequence to open/close the sleeve valves and set a packer for fracturing, or other operations. The more cycles that are required to perform an operation such as open/close a sleeve valve, the more time may be required.

Additional problems of existing systems are described below. There is interest in the oil and gas industry for sleeve assemblies that are relatively simple in design, hand-manageable, have a low cost, and may further reduce the number of BHA cycles required to perform operations.

SUMMARY

According to an aspect, there is provided, a downhole tool system for use within a casing string including a sleeve valve comprising a shiftable inner sleeve, the downhole tool system comprising: a locator tool comprising at least one sleeve engagement member that is hydraulically actuatable from a radially retracted configuration to a radially extended configuration for engaging the shiftable inner sleeve; an anchor tool positioned downhole of the locator tool and comprising at least one anchor member that is hydraulically actuatable from a radially retracted configuration to a radially extended configuration for gripping an inner wall of the casing string; and a shifting tool positioned between the locating tool and the anchor tool and movable between an axially extended configuration and an axially contracted configuration, wherein the shifting tool is hydraulically actuatable to move from the axially extended configuration to the axially contracted configuration.

In some embodiments, the downhole tool system is connectable to tubing uphole of the locator tool and defines a primary inner fluid passageway therethrough, and each of the locator tool, the anchor tool, and the shifting tool are hydraulically actuatable by controlling fluid pressure or fluid flow within the primary inner fluid passageway.

In some embodiments, the locator tool is actuatable by the fluid pressure in the primary fluid passageway exceeding a first pressure threshold, the anchor tool is actuatable by the fluid pressure exceeding a second pressure threshold that is greater than the first fluid threshold, and the shifting tool is actuatable by the fluid pressure exceeding a third pressure threshold that is greater than the second pressure threshold.

In some embodiments: the locator tool defines a first locator tool fluid path therethrough and a second locator tool fluid path, the first fluid locator tool fluid path being part of the primary fluid passage; the locator tool comprises a locator tool activation valve, the locator tool activation valve comprising a pressure-shiftable locator tool valve component exposed to pressure within the primary fluid passage and moveable between a closed position that blocks fluid communication between the first and second locator tool fluid paths and an opened position that allows fluid communication between the first and second fluid locator tool paths, the pressure-shiftable locator tool valve component is biased to remain in the closed position when the fluid pressure within primary fluid passage is below the first pressure threshold and to shift to the opened position when the fluid pressure meets or exceeds the first pressure threshold; and the at least one sleeve engagement member is hydraulically actuatable by fluid pressure in the second locator tool fluid path.

In some embodiments, the locator tool further comprises, for each at least one sleeve engagement member, a respective one or more hydraulic pistons exposed to pressure within the second locator tool fluid path and movable responsive to the pressure within the second locator tool fluid path to deflect the sleeve engagement member radially outward to the radially extended configuration.

In some embodiments, the anchor tool defines a first anchor tool fluid path therethrough and a second anchor tool fluid path, the first fluid anchor tool fluid path being part of the primary fluid passage; the anchor tool comprises an anchor tool activation valve, the anchor tool activation valve comprising a pressure-shiftable anchor tool valve component exposed to pressure within the primary fluid passage and moveable between a closed position that blocks fluid communication between the first and second anchor tool fluid paths and an opened position that allows fluid communication between the first and second fluid anchor tool paths, the pressure-shiftable anchor tool valve component is biased to remain in the closed position when the fluid pressure within primary fluid passage is below the second pressure threshold and to shift to the opened position when the fluid pressure meets or exceeds the second pressure threshold; and the at least one anchor member is hydraulically actuatable by fluid pressure in the second anchor tool fluid path.

In some embodiments, the anchor tool further comprises, for each at least one anchor member, a respective one or more hydraulic pistons exposed to pressure within the second anchor tool fluid path and movable responsive to the pressure within the second anchor tool fluid path to deflect the anchor member radially outward to the radially extended configuration for gripping the inner wall of the casing string.

In some embodiments: the shifting tool defines a first shifting tool fluid path therethrough and a second shifting tool fluid path, the first fluid shifting tool fluid path being part of the primary fluid passage; the shifting tool comprises a shifting tool activation valve, the shifting tool activation valve comprising a pressure-shiftable shifting tool valve component exposed to pressure within the primary fluid passage and moveable between a closed position that blocks fluid communication between the first and second shifting tool fluid paths and an opened position that allows fluid communication between the first and second fluid shifting tool paths, the pressure-shiftable shifting tool valve component is biased to remain in the closed position when the fluid pressure within primary fluid passage is below the third pressure threshold and to shift to the opened position when the fluid pressure meets or exceeds the third pressure threshold; and wherein pressure within the second shifting tool fluid path exceeding the pressure within the first shifting tool fluid path creates a hydraulic force urging the shifting tool toward the axially contracted configuration.

In some embodiments, the shifting tool further comprises one or more hydraulic cylinders that collectively generate the hydraulic compressive force responsive to the pressure within the second shifting tool fluid path.

In some embodiments, the shifting tool is extendible by mechanical tension to move from the axially retraced configuration to the axially extended configuration.

In some embodiments, the downhole tool system further comprises a selector valve positioned uphole of the locator tool, wherein: the selector valve is extendible to an extended selector valve configuration by axial mechanical tension and contractable to a contracted selector valve configuration by axial mechanical compression; in the extended selector valve configuration, the selector valve directs fluid from the tubing into the primary fluid passage; and in the contracted selector valve configuration, the selector valve directs fluid from tubing into an annulus between the downhole tool system and the casing string.

In some embodiments, the downhole tool system further comprises a flow restriction device that restricts flow through the primary passageway and positioned downhole of the locator tool, the shifting tool and the anchor tool.

In some embodiments, the downhole tool system further comprises an isolation tool positioned downhole of the anchor tool, the isolation tool comprising a resettable packer.

In some embodiments, the downhole tool system further comprises a cycling mechanism positioned below the isolation tool.

In some embodiments, the downhole tool system further comprises a drag block positioned downhole of the isolation mechanism.

According to another aspect, there is provided a method of shifting a shiftable inner sleeve of a sleeve valve using the downhole tool system as described herein, the method comprising: running the downhole tool system downhole to a position below the sleeve valve; locating the inner sleeve with the locator tool; and shifting the inner sleeve within the sleeve valve.

In some embodiments, locating the shiftable inner sleeve comprises: hydraulically activating the locator tool to move the at least one sleeve engagement member from the radially retracted configuration to the radially extended configuration; and while the locator tool is activated, pulling the locator tool uphole until the at least one sleeve engagement member engages the shiftable inner sleeve.

In some embodiments, shifting the inner sleeve comprises shifting the inner sleeve comprises shifting the inner sleeve from an uphole sleeve position to a downhole sleeve position.

In some embodiments, shifting the inner sleeve from an uphole sleeve position to a downhole sleeve position comprises: while the locator tool is activated and the inner sleeve is engaged by the locator tool: hydraulically activating the anchor tool to move the at least one anchor member from the radially retracted anchor member configuration to the radially extended anchor member configuration; and while the locator tool and the anchor tool are activated, hydraulically activating the shifting tool to move from the axially extended position to the axially contracted position, thereby moving the shiftable inner sleeve from an uphole sleeve position to a downhole sleeve position.

In some embodiments, shifting the inner sleeve comprises: running the downhole tool system downhole to a position below the sleeve valve; hydraulically activating the locator tool to move the at least one sleeve engagement member from the radially retracted configuration to the radially extended configuration; while the locator tool is activated: pulling the locator tool uphole until the at least one sleeve engagement member engages the shiftable inner sleeve; and further pulling the locator tool uphole to move the shiftable inner sleeve from a downhole sleeve position to an uphole sleeve position.

Other aspects and features of the present disclosure will become apparent to those ordinarily skilled in the art, upon review of the following description of the specific embodiments of the disclosure.

BRIEF DESCRIPTION OF THE DRAWINGS

The present disclosure will be better understood having regard to the drawings in which.

DETAILED DESCRIPTION

In this disclosure, the terms "uphole" and "up" may refer generally to the direction of travel within a wellbore toward the surface. The terms "downhole" and "down" may refer generally to the direction of travel within a wellbore away from the surface or toward a bottom of the wellbore. The terms "above" and "below" as used herein may also likewise refer to the position of an element relative to another element in the uphole and downhole directions. For example, in a horizontal well, a first component may be positioned "uphole" of another component, while both components are horizontally spaced apart rather than vertically spaced.

The terms "hydraulically actuate" or "hydraulically activate" may refer to utilizing fluid pressure and/or fluid flow through or around the tool to directly or indirectly actuate one or more mechanical components of the tool. For example, a piston may be directly actuated by fluid pressure, and the piston may in turn actuate another mechanical component. A component or device described as "hydraulically actuated" or "hydraulically activated" herein does not preclude the device from also including one or more functions that may be also be mechanically actuated.

Figure 1:
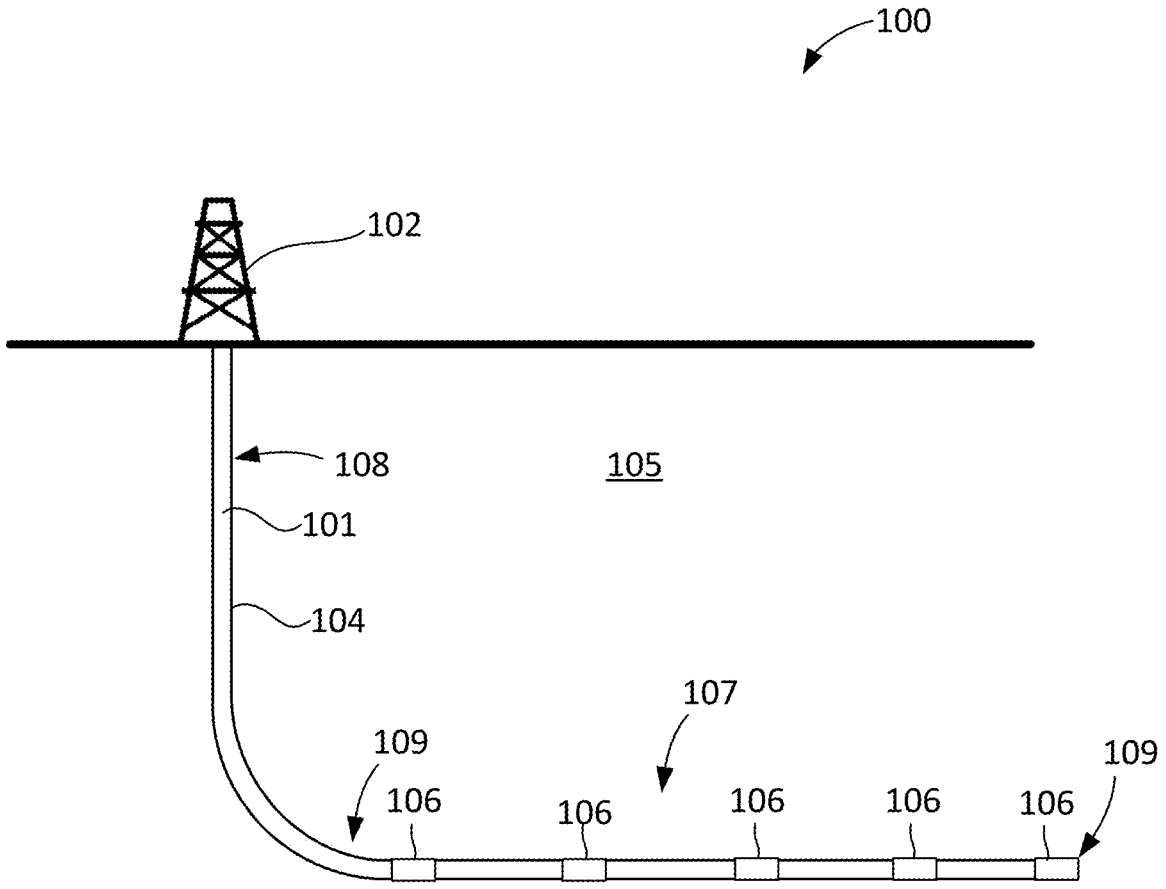
FIG. 1 is a side view diagram of an example wellbore system in which embodiments of the present disclosure may be implemented.

FIG. 1 is a side view diagram of an example well system 100 in which a downhole tool system for opening and closing sleeve valves may be used. The downhole tool system may be a BHA. The system 100 includes surface equipment 102 and a drilled well 101 that extends into an earth formation 105. The well 101 includes vertical well section 108 and a deviated well section 107 extending at an angle, even horizontal, from the vertical well section 108. The deviated well section 107 system 100 starts approximately at heel 109 and ends at a downhole "toe" 111. Deviated wells may be approximately horizontal or may be at another angle, but embodiments are not limited to horizontal or other deviated well applications.

The well has a casing string 104 installed therein (within the wellbore). The casing string 104 may include a plurality of interconnected casing sections and, in this example, includes a plurality of sleeve valves 106 spaced apart within the deviated well section 107. A well system may include multiple separate deviated sections, each having a respective plurality of sleeve valves positioned therein.

The surface equipment 102 may include a rig with equipment for controlling a BHA attached to coiled tubing that is run into the well. The surface equipment 102 may include one or more fluid pumps for pumping fluid(s) through the coiled tubing into the BHA and/or into the annulus within the casing string 104. While the description of various example embodiments herein refers to coiled tubing connected to the BHA, embodiments are not limited to use with coiled tubing only.

Referring to FIG. 1, a fracturing operation may include: opening one of the sleeve valves 106 using the BHA; isolating a wellbore zone about the opened sleeve valve 106 using the BHA; and pumping fracturing fluid at pressures sufficiently high for the fracturing fluid to exit through ports of the sleeve valve 106 and fracture the earth formation 105 in the region of the sleeve valve 106. The sleeve valve 106 may optionally be closed after the fracturing has been performed. This process may then be sequentially repeated for one or more of the remaining sleeve valves 106. The skilled person will appreciate that a fracturing operation may vary from the steps described above. Embodiments are not limited to a particular number, arrangement of, and/or order of opening/closing of sleeve valves to name a few examples of possible variations.

Aspects of the present disclosure provide a shifting assembly for a downhole tool system, for use in a wellbore comprising one or more sleeve valves. The shifting assembly may comprise a locator tool, a shifting tool, an anchor tool. One or more of the locator tool, a shifting tool, an anchor tool may be hydraulically actuated using tubing pressure and/or tubing flow rate. As part of a process to down-shift an inner sleeve of the sleeve valve, tubing flow and/or tubing pressure may be used to sequentially: (1) actuate sleeve engagement elements of a locator tool for engaging the inner sleeve; (2) set an anchor tool in the casing below the locator tool when the inner sleeve has been engaged by the locator tool; and/or (3) collapse a shifting tool between the locator tool and the anchor tool to shift the inner sleeve down. Between steps (1) and (2), the locator tool may be moved (e.g. by POOH coiled tubing movement) to align with and engage the inner sleeve. Mechanical force from downhole (RIH) movement of the coiled tubing may still be applied to contribute to the down-shifting, and hydraulic down-shifting may be activated if the mechanical force from coiled tubing RIH movement is insufficient. The shifting assembly may also be used for up-shifting the inner sleeve as will be described below. Optionally, after the sleeve valve is opened, fracturing may be performed by setting an isolation tool in the annulus below the sleeve valve and pumping fracturing fluid into the annulus.

A downhole tool system, such as a BHA, may comprise the hydraulically actuated shifting assembly. The BHA may be connected by tubing (e.g. coiled tubing) to surface equipment. The BHA may include additional equipment for use in a fracturing operation.

The shifting assembly disclosed herein may be used to open and/or close either shift-up-to-open sleeve valves and/or shift-down-to-open sleeve valves in a casing string. The system may provide location efficiency with the ability to open and re-close sleeve valves in deep wells.

The systems and methods described herein may provide a number of advantages over prior art shifting and isolation systems for use with shiftable sleeve valves in a casing string.

For example, the systems and assemblies described herein may provide for convenient opening and closing of sleeve valves during a fracturing operation. Opening a valve to equalize pressure after a fracturing stage may cause crossflow through a bottom hole assembly. Crossflow may have undesirable effects, including erosion and exposing the bottom hole assembly to problematic swabbing or hydraulic sources. Thus, closing sleeve valve after a stage before a flow path is open across or thru the isolation tool may be desirable because the difference in reservoir pressure in the newly fractured stage above the tool may be isolated from the pressure below when the flow path through the BHA is opened. Thus, the adverse effects mentioned above may be reduced or eliminated.

Conventional prior art sleeve shifting systems cycle coiled tubing with RIH and POOH movement for activating tools for engaging and shifting an inner sleeve of a sleeve valve. Each instance of RIH and POOH movement may be referred to as a "stroke" herein. The hydraulically actuated shifting assembly described herein may reduce the number of strokes required to perform sleeve shifting and/or fracturing operations. In other words, embodiments described herein may provide for opening/closing sleeves and fracturing with fewer coiled tubing cycles. Additionally, according to some embodiments of the disclosure, the travel distance for coiled tubing strokes (i.e. cycle distance) may also be reduced. Total movement and RIH/POOH cycling of an isolation tool (e.g. packer) and drag block during a fracturing operation may also be advantageously reduced, as described below.

Some conventional, prior art sleeve shifting systems may use a packer-type plug set in the inner sleeve combined with fluid pressure in the annulus for shifting the inner sleeve from an uphole sleeve position to a downhole sleeve position. Beneficially, aspects of the present disclosure may provide for shifting the inner sleeve of a sleeve valve from an uphole sleeve position to a downhole sleeve position by utilizing tubing flow and/or tubing pressure, rather than annulus fluid pressure. The terms "tubing flow" and "tubing pressure" refer to fluid flow or pressure delivered internally to the BHA by tubing connecting the BHA to the surface (e.g. coiled tubing). The term "annulus flow" or "annulus pressure" refers to fluid flow or pressure in the annulus between the BHA and the casing string. Use of tubing flow/pressure, rather than annulus flow/pressure, for shifting a sleeve valve may reduce the volume of fluid required to be pumped. This may, in turn, save time and cost.

Additionally, the inner sleeve may be shifted without requiring a plug to be set within the inner sleeve. Thus, the sleeve may only need to be long enough to engage the sleeve engagement elements of the locator tool. This, in turn, may allow for significantly shorting the inner sleeve compared to conventional prior art systems. Reducing sleeve valve size may be more material and cost efficient. Smaller sleeve valves may also be more manageable when assembling the casing string.

The shorter and lighter inner sleeve of the sleeve valve may also allow for improved means for biasing the inner sleeve to remain in the uphole or downhole position and/or for controlling shifting of the inner sleeve. For example, inner sleeve detent mechanisms for use with the presently disclosed shifting assemblies may be beneficial compared to prior art sleeve detent mechanisms. Instead of a typical detent or a shear screw that causes a relatively violent mechanical release, an inner sleeve used with the systems described herein may be configured for a more consistent shifting load from the uphole sleeve position to the downhole sleeve position.

Embodiments disclosed herein may also have a benefit of less erosion of the BHA during fracturing. As will be disclosed, a smaller outer diameter of the BHA uphole of a locator sub may be positioned adjacent ports in the sleeve valve during fracturing.

As another advantage, the shifting tool and below the locator tool may axially contract a known "slack" distance, such that position of the locator tool relative to the sleeve valve is known. This "slack" may reduce or eliminate the need to rely on fully cycling a "J-slot" type re-settable packer below the sleeve on Coiled Tubing Tension depth, which may be inaccurately measured from surface. Shifting movement may comprise travel between anchored endpoints. These features may reduce cycles and cycle distance.

Figure 2:
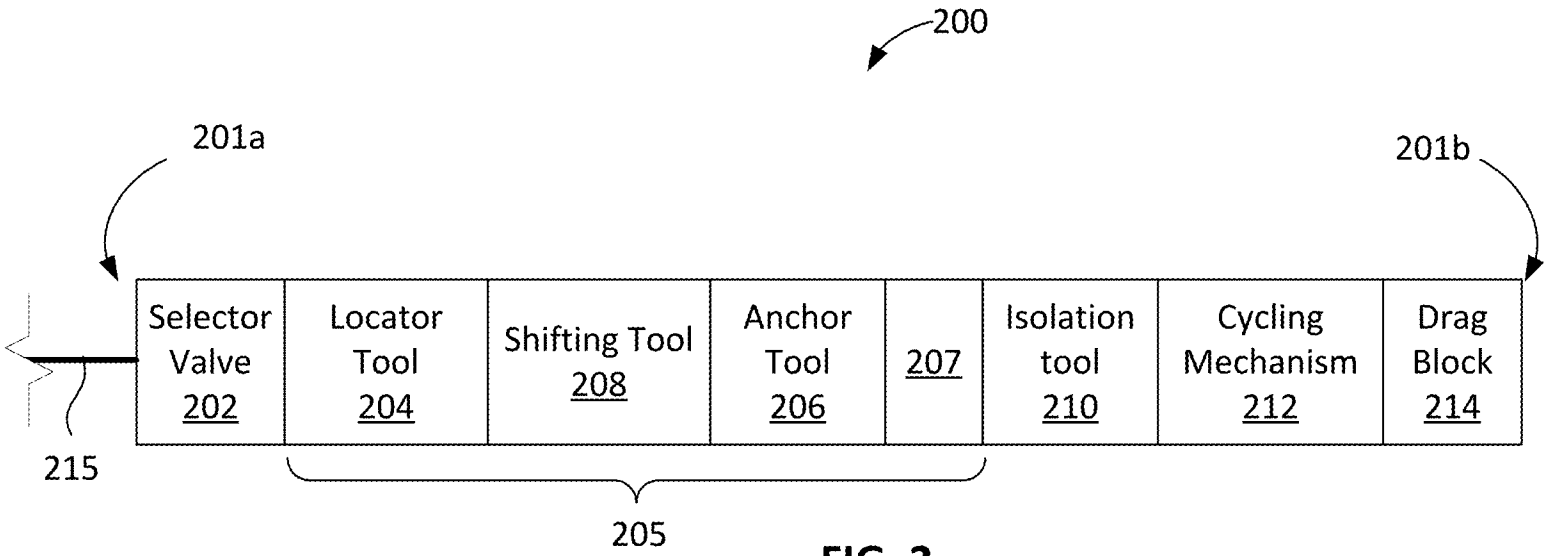
FIG. 2 is a functional block diagram of an example BHA including a shifting assembly according to some embodiments.

FIG. 2 is a functional block diagram of an example BHA 200 (downhole tool system) according to some embodiments. The BHA 200 may be modular with each on the labelled functional blocks comprising one or more connected modules, which may referred to herein as "subs". Individual subs may be removed and/or swapped out with other subs depending on needs for a particular downhole application. The example BHA generally has an uphole end 201*a* and a "downhole" end 201*b* and is connected by coiled tubing to surface equipment (not shown). The BHA 200 includes a central or primary fluid passage (not shown in FIG. 2) extending therethrough that receives fluid via the coiled tubing 215 and carries fluid internally through the various components of the BHA 200. The primary fluid passage may comprise a central bore through some or all subs of the BHA 200. Fluid may be pumped downhole through the coiled tubing 215 and into the primary fluid passage of the BHA 200.

The BHA 200 includes a hydraulic shifting assembly 205 controllable to shift a shiftable inner sleeve of a sleeve valve in a casing string. The sleeve valve may, for example, be in the form shown in FIGS. 4A to 4D, although embodiments are not limited to that specific configuration. As will be discussed below, one fluid pressure and/or flow rate of fluid flowing through the BHA 200. The BHA 200 in this embodiment optionally further includes: a selector valve 202; an isolation tool 210 positioned downhole of the shifting assembly 205; a cycling mechanism 212 positioned downhole of the isolation tool 210; and a drag block 214 at the downhole end 201*b* of the BHA 200. One or more of components of the BHA 200 may be omitted or rearranged in other embodiments. Although not shown in FIG. 2, the BHA 200 may also include other modules, such as a coil connector at the uphole end of the BHA or connecting the BHA to coiled tubing.

The hydraulic shifting assembly 205 includes a locator tool 204 positioned downhole of the selector valve 202; an anchor tool 206 (or "hold down" tool) positioned downhole of the locator tool 204, and a shifting tool 208 (or "hydraulic stroker") positioned intermediate the locator tool 204 and the anchor tool 206. For pressure-activated embodiments, the shifting assembly may further include a flow restriction device 207 that restricts fluid flow in the primary fluid passage to generate pressure within the shifting assembly 205. As discussed above, the hydraulically actuated shifting assembly 205 may allow for locating and opening/closing a sleeve valve with fewer cycles of coiled tubing movement than conventional systems and may provide additional advantages described herein.

The locator tool 204 may comprise at least one sleeve engagement member that is hydraulically actuatable from a radially retracted configuration to a radially extended configuration for engaging a shiftable inner sleeve of a sleeve valve. Example embodiments of the locator tool 204 and at least one sleeve engagement member are described below.

The anchor tool 206 may comprise at least one anchor member that is hydraulically actuatable from a radially retracted configuration to a radially extended configuration. In the extended configuration, anchor member(s) may engage the inner casing wall with sufficient force to axially secure the anchor tool 206 in the casing to facilitate shifting the inner sleeve. Example embodiments of the anchor tool 206 and methods of operation are described below.

The shifting tool 208 is hydraulically actuatable to move from an axially extended configuration to an axially contracted configuration while the anchor tool 206 is secured to the inner casing wall and the locator tool 204 is engaged with the inner sleeve. When not being hydraulically driven to contract, the shifting tool 208 may be mechanically extended or collapsed by RIH or POOH coiled tubing movement applying tension or compression respectively. Example embodiments of the shifting tool 208 and methods of operation are described below.

The process of down-shifting an inner sleeve of a target sleeve valve may comprise sequentially actuating the locator tool 204, the anchor tool 206 and the shifting tool 208. Initially, the shifting assembly may be positioned below the target sleeve valve by RIH coiled tubing movement. The locator tool 204 may then be hydraulically actuated to extend one or more sleeve engagement members to radially extend the sleeve engagement members. The locator tool 204 may then be pulled uphole until the one or more sleeve engagement members are aligned with an engage the shiftable inner sleeve. Next, the anchor tool 206 may be hydraulically actuated to extend one or more anchor members to grip to the inner wall of the casing string (while the locator tool 204 is still engaged with the shiftable inner sleeve). With the locator tool 204 engaged with the inner sleeve an the anchor tool 206 anchored to the casing, the shifting tool 208 may then be hydraulically actuated to contract, which pulls the locator tool 204 downward and thereby down-shifts the inner sleeve. For a shift-down-to-open type sleeve valve, this downhole shifting of the inner sleeve may open the sleeve valve. In a shift-up-to-open type sleeve valve, this downhole shifting of the inner sleeve may close the sleeve valve.

The selector valve 202 may be actuated between two modes of operation including: a first "bypass flow" mode in which fluid flowing downhole into the selector valve is at least partially diverted into the annulus (between the BHA 200 and casing string) to bypass the shifting assembly 205; and a second "active" mode in which the fluid is directed through the shifting assembly 205. Example embodiments of the selector valve 202 and methods of operation are described below. In this example, actuation between the two modes of operation is achieved by mechanically extending and contracting (i.e. collapsing) the selector valve 202 by POOH and RIH movement to apply tension or compression respectively. However, embodiments are not limited to a particular method of actuating two modes of operation of the selector valve 202. For example, in other embodiments the selector valve may be fluid-activated in that it is configured for actuation between modes by controlling internal fluid flow (rate or pressure) within the selector valve.

The isolation tool 210 may, for example, comprise a resettable packer that, when set, engages the inner casing wall to form a seal and isolate the casing annulus above the packer from the annulus below the packer. With the sleeve valve in an opened position, the isolation tool 210 may be set in the casing, and fracturing fluid may be pumped to build sufficient pressure in the annulus (above the isolation tool) so that the fluid enters the earth formation through ports in the opened sleeve valve for fracturing the earth formation. See, for example, the packer and slips described in U.S. Pat. No. 10,605,061 to Andreychuk et al., the entire content of which is incorporated by reference.

The cycling mechanism 212 may be cycled through settings or "positions" by alternating RIH and POOH movement, where these positions control operational aspects of the BHA operation. The cycling mechanism 212 may, for example, comprise a J-slot mechanism. The J-slot mechanism 212 may have the following settings: "Rin-in-Hole" setting which the isolation tool is prevented from being set by RIH movement; "Set-for-Frac" position in which setting the isolation tool by RIH movement is enabled; "Pull-out-of-Hole" setting (e.g. for unsetting a packer). Cycling J-slot mechanisms for controlling an isolation tool such as a resettable packer is known, as described in U.S. Pat. No. 10,605,061 to Andreychuk et al., the entire content of which is incorporated by reference.

The isolation tool 210 and cycling mechanism 212 may by mechanically controlled by uphole and downhole force or movement of the coiled tubing. RIH movement of the coiled tubing may provide an axially compressive force on the BHA 200. POOH movement of the coiled tubing may provide axial tension in the BHA 200. The drag block 214 may be configured to drag in the casing such that RIH movement of the coiled tubing provides increased compressive force on the BHA 200. The drag block 214 may also increase tension for POOH movement.

Figure 3:
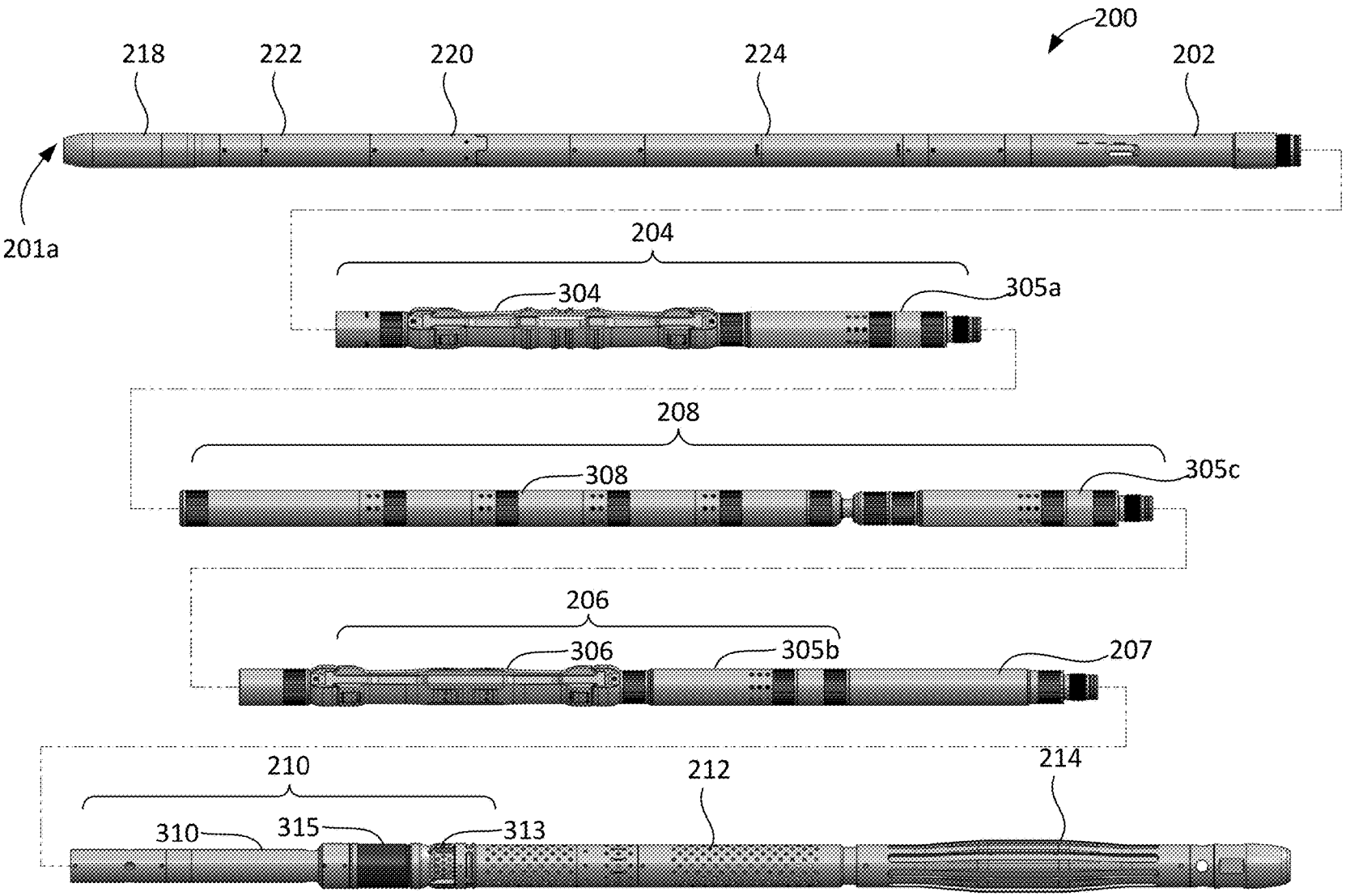
FIG. 3 is an exploded side view of an example implementation of the BHA of FIG. 2.

FIG. 3 is an exploded side view of an example implementation of the BHA 200 of FIG. 2 including: the selector valve 202; the locator tool 204; the shifting tool 208; the anchor tool 206; the isolation tool 210; the cycling mechanism 212; and the drag block 214. However, embodiments of the disclosure are not limited to the specific example of FIG. 3.

The locator tool 204 in this example includes a hydraulic locator 304 and a first activation valve 305*a*. The anchor tool 206 includes a hydraulic anchor 306 and a second activation valve 305*b*. The shifting tool 208 includes a hydraulic shifter 308 and a third activation valve 305*c*.

The isolation tool 210 includes an equalization valve 310 and a resettable packer 312. The resettable packer may include a compressible packer ring 315 that is axial compressible for radial expansion in the annulus. The resettable packer 312 also include slips 313 that may be set to grip the inner casing wall to aid in setting (axially compressing) the packer ring 315. Mechanical compression of the resettable packer 312 may first set the slips 313 and continued compression may then axially compress and radially expand the packer ring 315. The cycling mechanism 212 is a J-slot mechanism in this example.

In this embodiment, the BHA 200 further includes a flow restriction device 207 which may comprise a fluid orifice within the primary fluid passage of the BHA 200, a valve and/or any other device that restricts flow through the primary fluid passage. The flow restriction may enable or improve control of pressure within the BHA 200 by controlling fluid flow in the coiled tubing from the surface.

In the example of FIG. 3, the hydraulic locator 304, the hydraulic anchor 306, and the hydraulic shifter 308, the activation valves 305*a* to 305*c*, the flow restriction device 207, the equalization valve 310, the resettable packer, the J-slot mechanism 212 and the drag block 214 are each implemented as separate "subs" of the BHA 200 that can be connected together. Additional optional subs are also shown and discussed below.

Each activation valve (305*a* to 305*c*) has a first "non-activated" mode and a second "activated" mode of operation. Each activation valve (305*a* to 305*c*) also has a respective pressure threshold at which the activation valve switches from the first mode to the second mode. This switching to the second mode may be referred to as "activating" the activation valve herein. In this embodiment, the first, second, and third activation valves (305*a* to 305*c*) are each configured to activate at different respective tubing pressure thresholds such that the locator 304, anchor 306 and then shifter 308 are sequentially actuatable for shifting an inner sleeve of a sleeve valve, as described below.

The first activation valve 305*a* may activate at a first pressure threshold to hydraulically actuate the hydraulic locator 304 for engaging the inner sleeve. The second activation valve 305*b* may activate at a second pressure threshold to hydraulically actuate the hydraulic anchor 306 for anchoring to the inner wall of the casing string. The second pressure threshold may be higher than the first pressure threshold. The third activation valve 305*c* may activate at a third pressure threshold to hydraulically actuate the hydraulic shifter 308 to axially contract. The third pressure threshold may be higher than the second and first pressure thresholds.

The BHA 200 in this example also optionally includes a coil connector 218, a disconnect mechanism 220, one or more check valves 222 and an instrument sub 224. The coil connector 218 is positioned at the uphole end 201*a* of the BHA 200 for connecting the BHA 200 to coiled tubing (not shown). The disconnect mechanism 220 is positioned intermediate the selector valve 202 and the coil connector 218. The disconnect mechanism 220 may be operable to disconnect the BHA 200 from the coiled tubing should the need arise. The check valves 222 may allow fluid flow in the downhole direction and prevent fluid flow in the uphole direction in the coiled tubing. The instrument sub 224 may include electronics such as sensors and/or other instrumentation. Sensors may include, but are not limited to, one or more of tension sensor(s), compression sensor(s), shock sensor(s), temperature sensor(s), tubing pressure sensor(s), annulus pressure, sensor(s), inclination sensor(s), etc.

Before describing additional details and methods of operation of the BHA 200, some example sleeve valves will now be described with reference to FIGS. 4A to 4C.

Figure 4A:
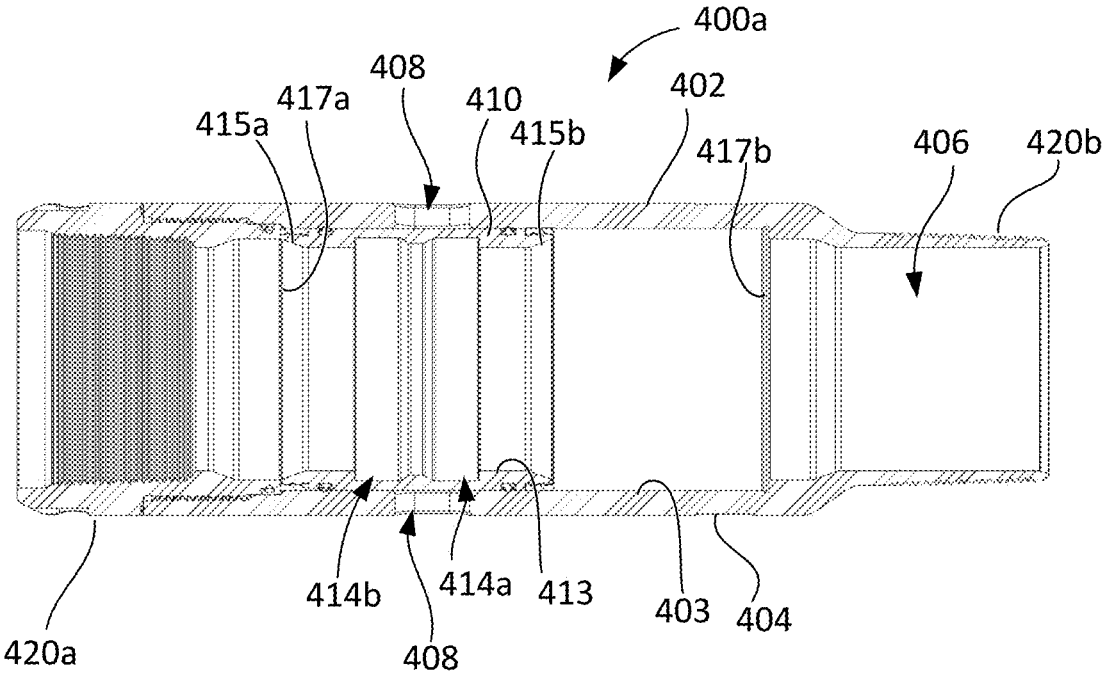
FIGS. 4A and 4B are side cross-sectional views of an example "shift-down-to-open sleeve" valve in closed and opened configurations, respectively, according to some embodiments.

FIG. 4A is a side cross-sectional view of an example "shift-down-to-open sleeve" valve 400*a* in a closed configuration according to some embodiments. FIG. 4B is a side cross-sectional view of the sleeve valve 400*a* in an opened configuration. The sleeve valve 400*a* comprises a tubular housing 402 having an inner surface 403 and an outer surface 404 and defining a bore 406 axially therethrough. The housing 402 defines one or more housing ports 408 from the inner surface 403 to the outer surface 404. The one or more housing ports 408 are arranged and aligned circumferentially about the housing 402. The one or more housing ports 408 are for allowing fluid, such as fracturing fluid or water, to flow from the bore 406 to a surrounding treatment zone or formation.

Figure 4B:
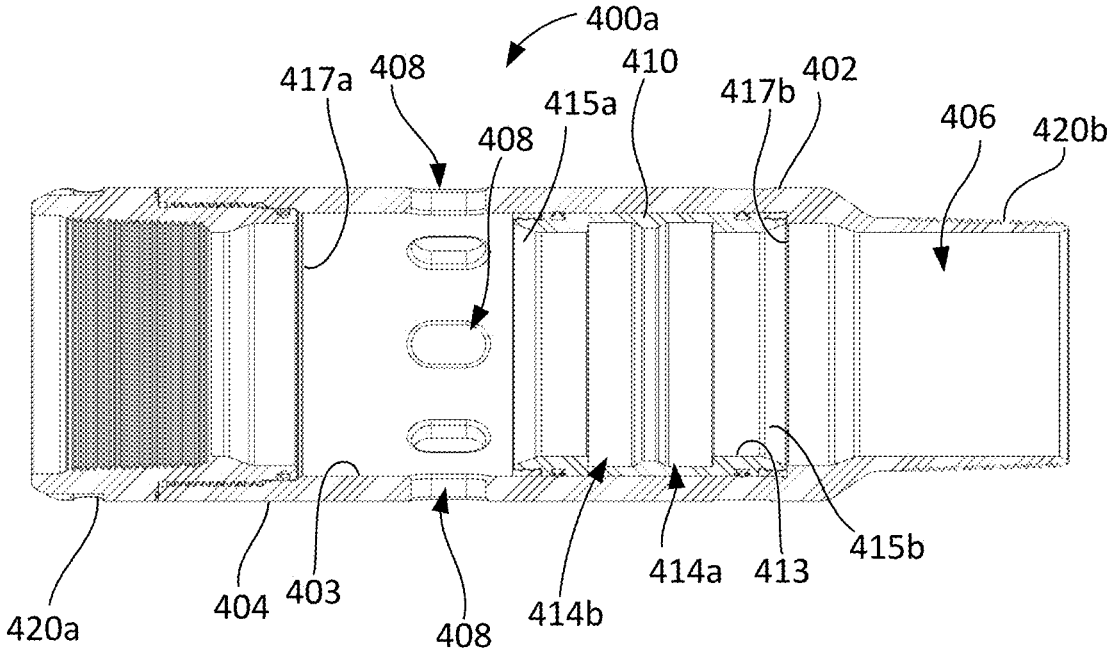

The sleeve valve 400*a* comprises an inner sleeve 410, positioned within the housing 402, that is axially shiftable between a closed sleeve position (FIG. 4A) and an opened sleeve position (FIG. 4B). In the closed sleeve position, the one or more ports 408 are obstructed by the inner sleeve 410 to block fluid for therethrough. In the opened sleeve position, the inner sleeve 410 does not block the one or more ports 408. In other embodiments, ports may be provided in the inner sleeve 410 instead of, or in addition to the ports in the housing 402.

The sleeve valve 400*a* in this embodiment is configured for "shift-down-to-open" operation, meaning that the sleeve valve 400*a* is closed when the inner sleeve 410 is in an uphole sleeve position (FIG. 4A), and the sleeve valve 400*a* is opened when the inner sleeve 410 is in a downhole sleeve position (FIG. 4B).

As shown in FIGS. 4A and 4B, inner sleeve 410 is generally tubular, and the inner surface 413 of the inner sleeve 410 defines an inner profile. The inner profile of the inner sleeve 410 in this embodiment includes two annular groove 414*a* and 414*b*, upper tapered end 415*a* and lower tapered end 415*b*. The inner profile is shaped for engaging with sleeve engagement members of a locator tool (such as the locator tool 204 of FIG. 2) having a complimentary profile. When the locator tool is engaged with the inner sleeve 410, downhole axial movement of the locator tool can shift the sleeve from the uphole sleeve position (FIG. 4A) to the downhole sleeve position (FIG. 4B), or vice versa. While a "shift-down-to-open" sleeve valve 400*a* is shown in FIG. 4, the BHA 200 of FIG. 3 may also be used for opening and closing "shift-up-to-open" sleeve valves.

The housing 402 also defines upper and lower inner annular shoulders 417*a*, 417*b* in the bore 406, which provide upper and lower stops for the inner sleeve 410.

The sleeve valve 400*a* in this example includes friction rings 416*a* and 416*b* positioned between the inner sleeve 410 and the housing 402. The friction rings 416*a* and 416*b* may hold the inner sleeve 410 in the uphole sleeve position and downhole sleeve position absent force applied by a shifting assembly (such as the shifting assembly 205 of FIG. 2) or other tool. Embodiments are not limited to any particular method of resisting unwanted movement of the inner sleeve 410 or biasing the inner sleeve 410 to the opened/closed positions. For example, in other embodiments, the sleeve valve 400*a* may instead include a detent mechanism (not shown) that biases the inner sleeve 410 to remain in each of the open first sleeve position and the closed first sleeve position. The detent mechanism may include a detent ring secured about the inner sleeve 410 and annular detent grooves defined in the inner surface 403 of the housing 402. Any other suitable means to bias or resist movement of the inner sleeve 410 may be used in other embodiments.

The sleeve valve 400*a* further includes top and bottom threaded connectors 420*a* and 420*b* for coupling the sleeve valve 400*a* to the casing. The sleeve valve 400*a* for use with the BHA 200 may be constructed with a shorter length than sleeve valves used with existing hydraulic shifting systems because the BHA 200 does not require a plug or other isolation element to grip the inner sleeve 410. The inner sleeve 410 may only need to be engaged by the sleeve engagement elements of the locator tool, thus allowing shorter sleeve length and reducing material requirements and costs.

While the example sleeves 400*a* and 400*b* include male threaded connectors at one end and female threaded connectors at the opposite end, sleeve valves may also be provided with two female or two male connectors. For example, a sleeve valve having two female connectors may be coupled directly between two sections of casing. The sleeve valve may thus be installed in place of a traditional casing coupling (which typically includes two female connectors to connect to male connectors of the casing sections). See, for example, the example sleeve valve 2100 shown in FIG. 21.

Figure 4C:
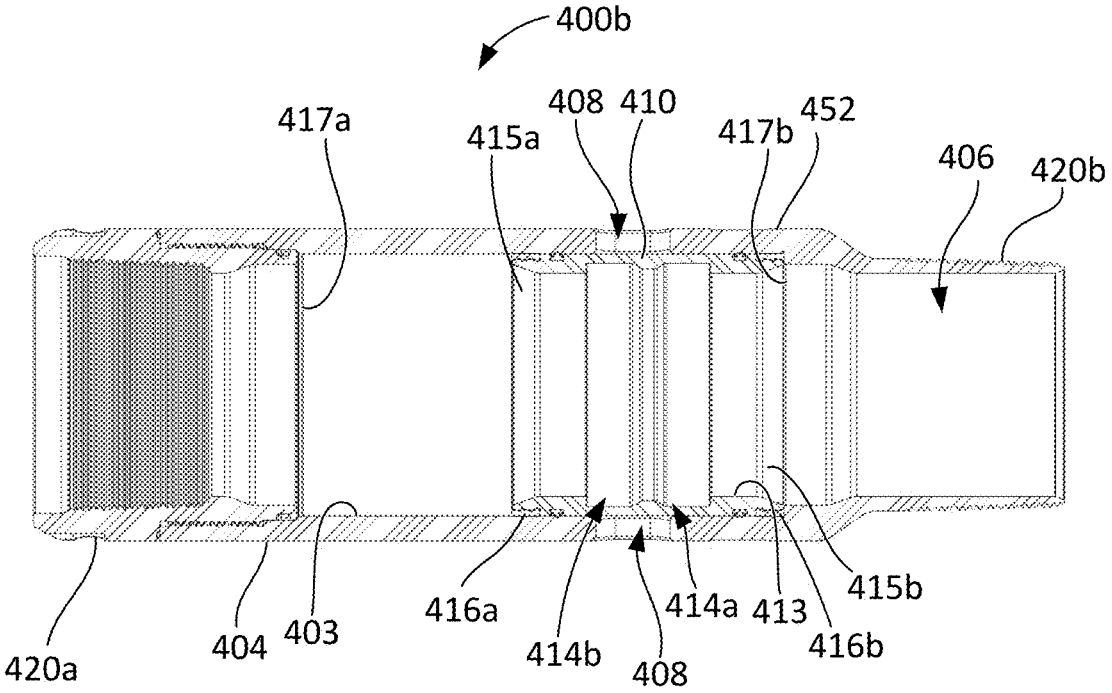
FIGS. 4C and 4D are side cross-sectional views of an example "shift-up-to-open sleeve" valve in closed and opened configurations, respectively, according to some embodiments.
Figure 4D:
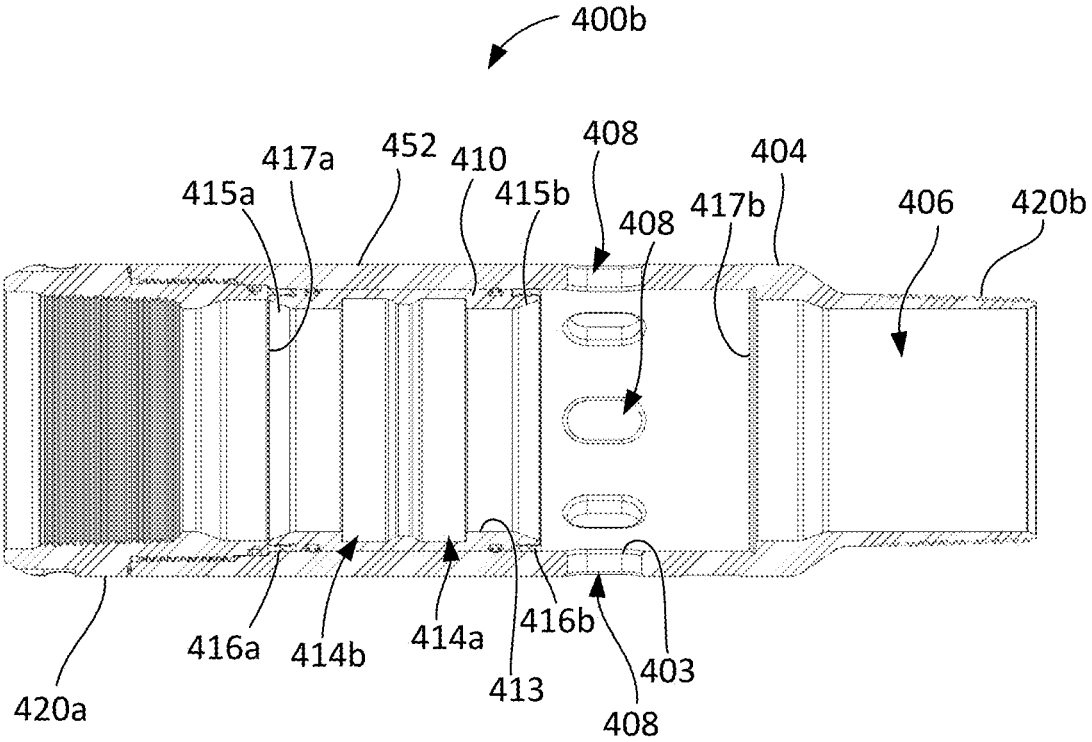

FIGS. 4C and 4D are side cross-sectional views of an example "shift-up-to-open" sleeve valve 400*b* in closed and opened configurations, respectively. This embodiment is similar to the example of FIGS. 4A and 4D (with like reference numbers indicating similar elements). The sleeve valve again has an inner sleeve that is axially shiftable within a tubular housing 452. In this embodiment, however, the housing ports 408 are positioned to be covered when the inner sleeve 410 is in the downhole sleeve position (FIG. 4A) and exposed when the inner sleeve 410 is in the uphole sleeve position (FIG. 4B). Thus, the inner sleeve 410 is shifted "up" to open the sleeve valve 400*b* and "down" to close the sleeve valve 400*b*.

Figure 5A:
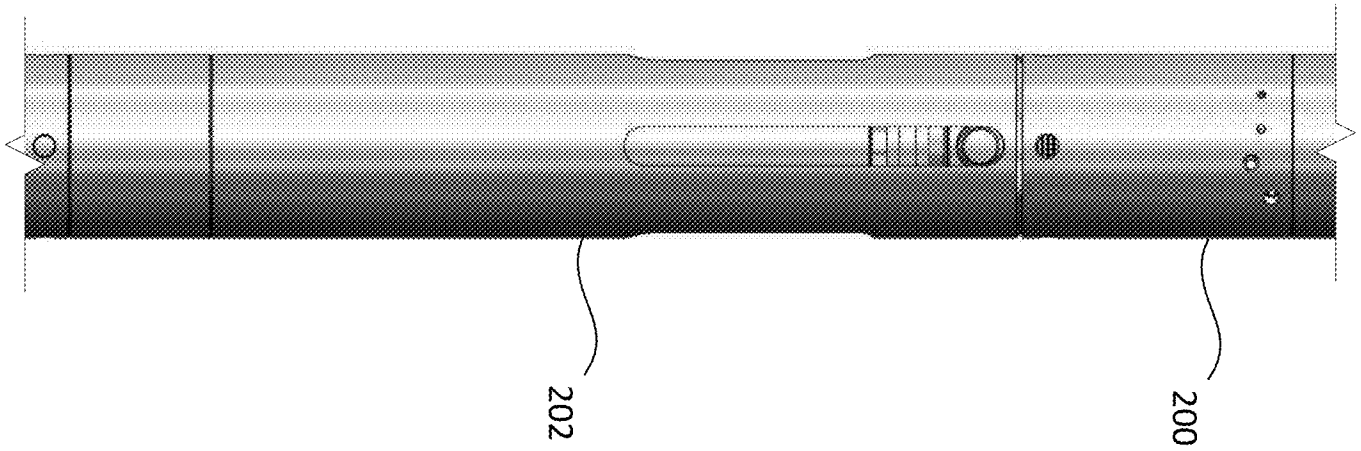
FIG. 5A is an enlarged partial view of the BHA of FIG. 2 showing a selector valve.
Figure 5B:
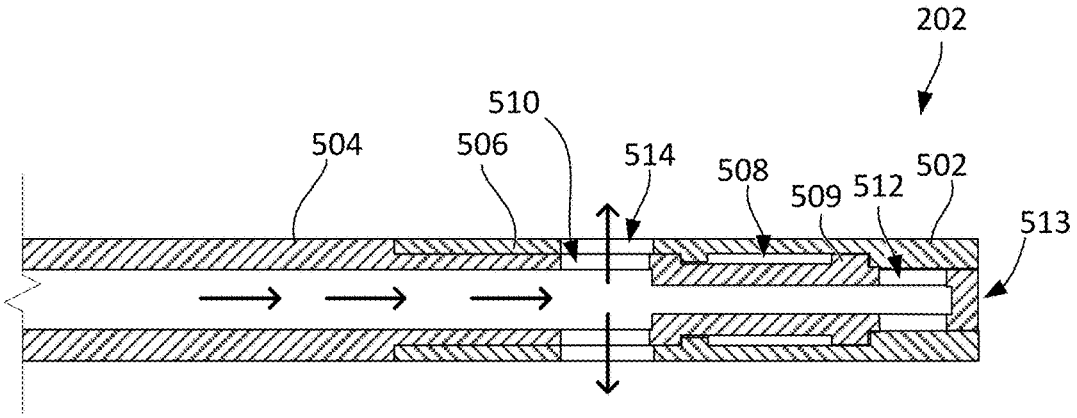
FIGS. 5B and 5C are cross-sectional illustrations of an example implementation of the selector valve of FIG. 5A.
Figure 5C:
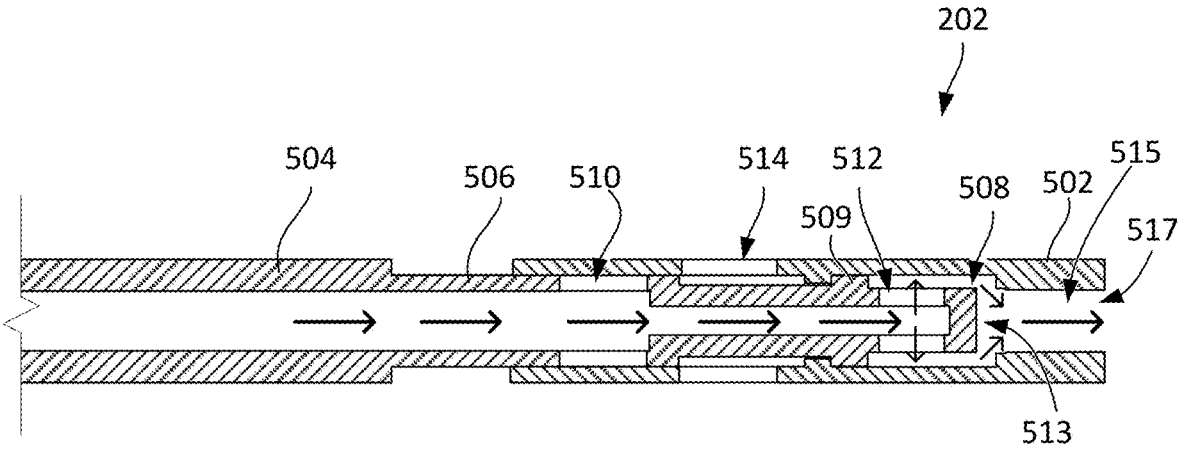

FIG. 5A is an enlarged partial view of the BHA 200 of FIG. 2, showing the selector valve 202. The selector valve 202 is actuatable to switch between a "bypass" mode of operation and an "active" mode of operation. FIGS. 5B and 5C are cross-sectional illustrations of an example implementation of the selector valve 202. The actual structure of the selector valve 202 may vary and FIGS. 5B and 5B are shown simply for illustrative purposes. FIG. 5B shows the selector valve 202 in the bypass mode of operation, and FIG. 5C shows the selector valve 202 in the active mode of operation.

As shown, the selector valve 202 comprises a first tubular portion 502 and a second tubular portion 504. The second tubular portion 504 includes a telescoping portion 506 slidably received within the first tubular portion 502 for axial movement relative thereto. Telescoping movement of the first tubular portion 502 and a second tubular portion 504 allows movement of the selector valve 202 between a contracted configuration and an extended configuration. The contracted configuration provides the "bypass" mode of operation, and an extended configuration provides the "active" mode of operation. Selecting between these two modes of operation may thereby be accomplished by axially extending or contracting the selector valve 202 by POOH and RIH movement of the coiled tubing.

The axial telescoping movement is limited by physical stops. Specifically, at least one radial extension 509 (e.g., annular rim) defined by the outer face of the telescoping portion 506 is received within an inner chamber 508 defined within the second tubular portion 504. The inner chamber 508 allows axial movement of the telescoping portion 506, but also defines upper and/or lower stops limiting the axial movement of the telescoping portion 506. However, any suitable method for limiting axial movement may be used, and embodiments are not limited to this specific example.

The telescoping portion 506 includes a first one or more ports 510 an and a second one or more ports 512. The telescoping portion 506 has a closed downhole end 513 such that fluid entering the through an uphole end of the second tubular portion 504 must exit through either the first one or more ports 510 or the second one or more ports.

As shown in FIG. 5B, the first tubular portion 502 includes ports 514 that abut and align with the first one or more ports 510 of the telescoping portion 506 when the selector valve 202 is in the contracted configuration. The first tubular portion 502 blocks the second one or more ports 512 of the telescoping portion 506 in the contracted configuration. Thus, in the "bypass" mode of operation (with the selector valve 202 in the contracted configuration), fluid flowing downhole through the selector valve 202 is directed outward into the annulus between the BHA 200 and the casing (not shown).

As shown in FIG. 5C, when the selector valve 202 is in the extended configuration, the first one or more ports 510 of the telescoping portion 506 are blocked by the first tubular portion 502. The second one or more ports 512 are received in an inner chamber 508 defined by the first tubular portion 502. The inner chamber 508 is in fluid communication with axial passage 515 at downhole open end 517 of the selector valve 202. Thus, in the "active" mode of operation (with the selector valve 202 in the extended configuration), fluid flowing through the selector valve 202 is directed through the selector valve 202 and exits through axial passage 515, continuing downhole through the interior of the BHA 200.

Figure 6A:
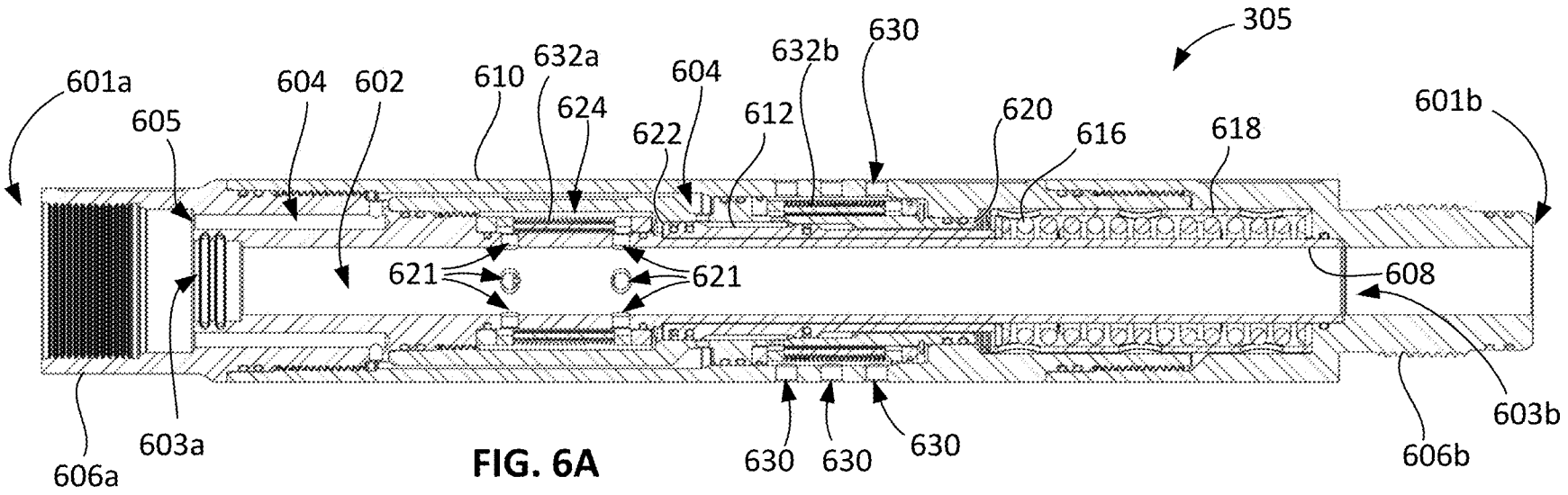
FIGS. 6A and 6B are side cross-sectional views of an example activation valve in non-activated and activated states according to some embodiments.
Figure 6B:
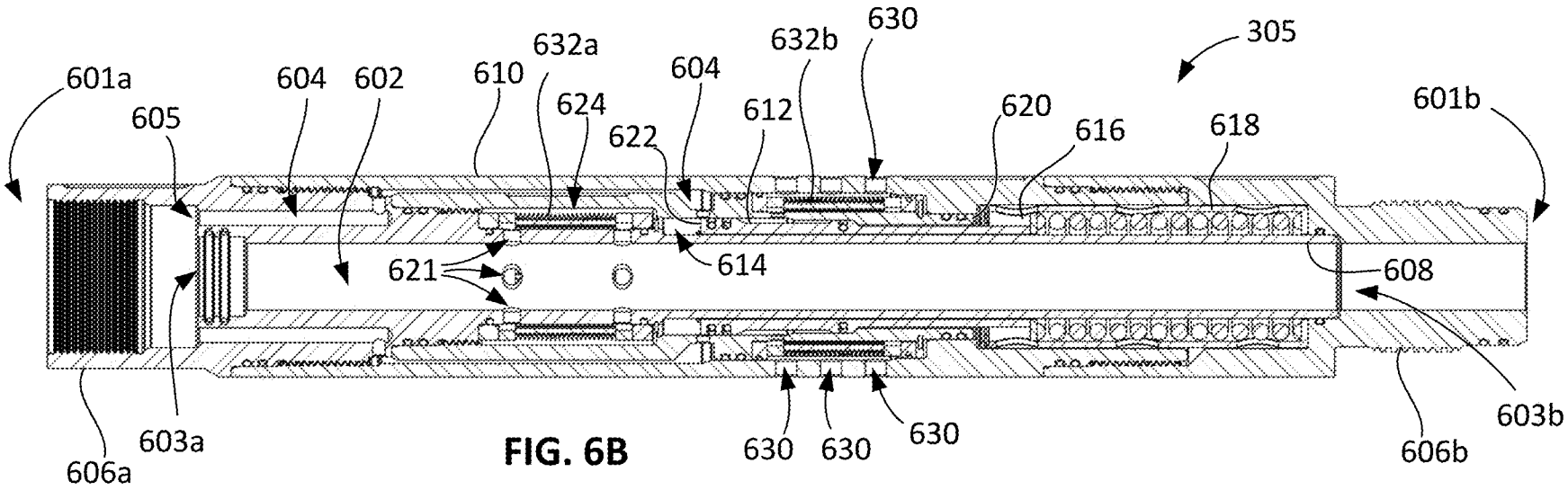

FIGS. 6A and 6B are side cross-sectional views of an example activation valve 305 in non-activated and activated states respectively. Each of the activation valves 305*a*, 305*b* and 305*c* in FIG. 3 may have the same essential structure shown in FIGS. 6A and 6B, but configured to activate at their respective different pressure thresholds.

The activation valve 305 is in the form of a BHA "sub" having an uphole connector 606*a* at an uphole end 601*a* and a downhole connector 606*b* at a downhole end 601*b*.

The activation valve 305 defines a primary valve fluid path 602 therethrough. The primary valve fluid path 602 is part of the primary fluid passage extending through the BHA 200 of FIGS. 2 and 3. The activation valve 305 further defines a secondary valve fluid path 604. As will be described below, the secondary valve fluid path 604 directs fluid pressure for hydraulically actuating the corresponding locator 304, anchor 306 or shifter 308.

The activation valve 305 comprises a tubular inner mandrel 608 extending between the uphole connector 606*a* and the downhole connector 606*b*. The tubular inner mandrel 608 defines the primary valve fluid path 602 axially therethrough. The activation valve 305 includes a primary fluid path inlet 603*a* at or near the uphole end 601*a* and a primary fluid path outlet 603*b* at or near the downhole end 601*b*. The activation valve 305 further comprises an outer housing 610 extending between the uphole connector 606*a* and the downhole connector 606*b*. The secondary valve fluid path 604 is generally positioned between the inner mandrel 608 and the outer housing 610. The activation valve 305 comprises a secondary fluid outlet 605 from the secondary valve fluid path 604 at or near the uphole end 601*a*. The secondary fluid outlet 605 is annular in shape and extends about the inner mandrel 608 at or near the uphole end 601*a*.

Figure 6C:
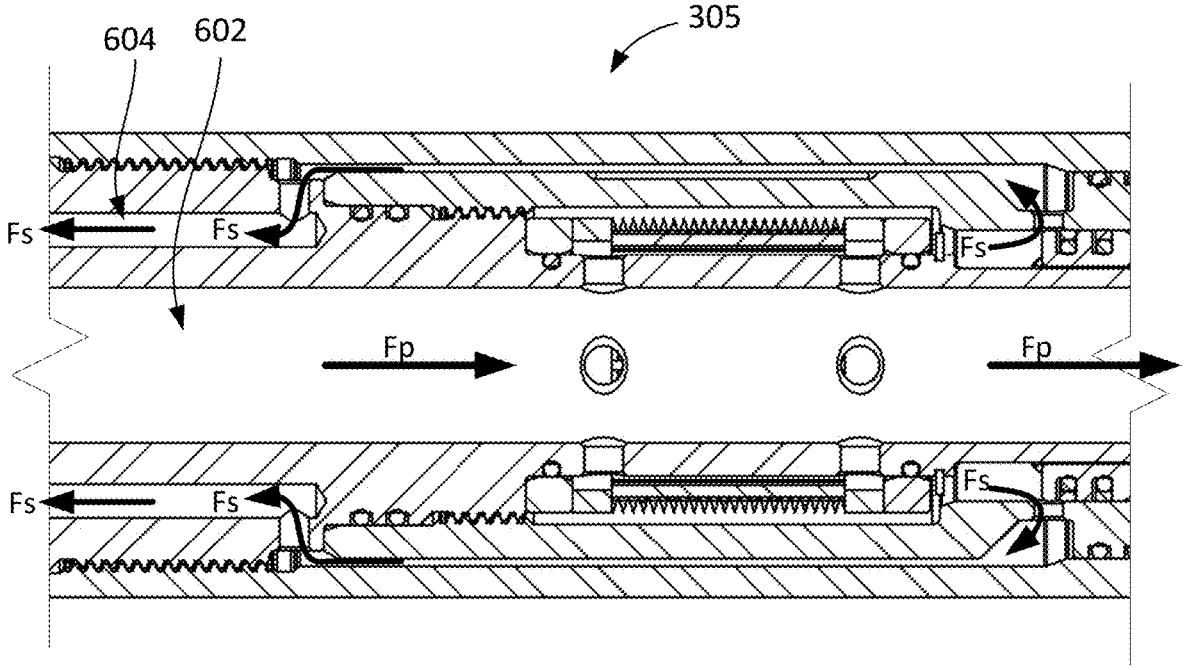
FIG. 6C is a detailed view of the activation valve of FIGS. 6A and 6B illustrating fluid flow paths.

FIG. 6C is an enlarged partial view of the activation valve 305. In this figure, the primary valve fluid path 602 is illustrated by arrows "Fp", and the secondary valve fluid path 604 is illustrated by the arrows labelled "Fs". In the non-activated state, the primary valve fluid path 602 is isolated from the secondary valve fluid path 604. In the activated state, the secondary valve fluid path 604 is in fluid communication with the primary valve fluid path 602 path such that fluid pressure and/or flow from the primary valve fluid path 602 is communicated to the secondary valve fluid path 604.

The activation valve 305 further includes a biased slidable plug sleeve 612 in this embodiment, although embodiments are not limited to this configuration. The plug sleeve is a pressure-shiftable locator tool valve component that responds to pressure for switching the activation valve 305 between the activated and non-activate modes. The slidable plug sleeve 612 is exposed to fluid pressure in the primary valve fluid path 602 and is movable between a closed valve position to an open valve position. In the closed valve position shown in FIG. 6A, the plug sleeve 612 blocks a channel 614 (visible in FIG. 6B) which blocks flow between the primary and secondary valve fluid paths 602 and 604. In the open valve position shown in FIG. 6B, the plug sleeve 612 does not block fluid flow through the channel 614. The plug sleeve 612 is biased to remain in the closed position (FIG. 6A) at pressures below the pressure threshold. At or above the pressure threshold, the fluid pressure in the primary valve fluid path 602 overcomes the biasing force and moves the plug sleeve 612 to the open valve position (FIG. 6B).

The activation valve 305 includes a coil spring 616 that provides a biasing force urging the plug sleeve 612 to remain in the closed (uphole) position shown in FIG. 6A. The coil spring 616 is contained in a tubular cartridge 618 is positioned between the inner mandrel 608 and outer housing 610. The spring 616 abuts a downhole end 620 of the sleeve valve to provide the biasing force. The uphole end 622 of the plug sleeve 612 is exposed to fluid pressure from the primary valve fluid path 602 through the inner mandrel 608 via the one or more mandrel ports 621, which extend radially through the mandrel into fluid chamber 624. Fluid pressure in the fluid chamber 624 applies a downhole force against the plug sleeve 612. The coil spring 616 may be chosen to provide a biasing force that is overcome at the desired pressure threshold, such that pressure at or above the threshold moves the plug sleeve 612 downhole to the open position shown in FIG. 6B.

The cartridge 618 containing the spring 616 may be swapped out for another cartridge with a different spring. Beneficially, this modular design may allow for simple customization of the activation valve 305 for different activation pressures. The three activation valves 305*a*, 305*b* and 305*c* in FIG. 3 may thus have essentially the same structure but with different respective spring strengths depending on the selected pressure threshold.

The activation valve 305 may further include one or more pressure equalization ports 630 extending radially through the outer housing 610. When the plug sleeve 612 is in the closed position (FIG. 6A), the pressure equalization ports 630 are in fluid communication with the secondary valve fluid path 604 such that pressure in the secondary valve fluid path 604 is equalized with the annulus between the BHA 200 and the casing string. When the plug sleeve 612 is in the opened position (FIG. 6B), the plug sleeve 612 now blocks fluid flow between the secondary valve fluid path 604 and the pressure equalization ports 630. By isolating the pressure equalization ports 630 from the secondary valve fluid path 604, a pressure differential relative to the annulus can build in the secondary valve fluid path 604.

Optional first and second filtering screens 632*a* and 632*b* are also shown in FIGS. 6A and 6B. The first filtering screen 632*a* is positioned in the fluid flow between the mandrel ports 621 and the channel 614 to prevent solids or debris from flowing from the inner mandrel 608 to the secondary valve fluid path 604. The second filtering screen 632*b* is positioned to prevent solids or debris from entering through the pressure equalization ports 630.

Embodiments are not limited to the particular activation valve structure described above. Other valve means responsive to fluid pressure or flow rate may be used in other embodiments. Activation valves may not be used in other embodiments and other means may be employed for providing locator, anchor, and/or shifter functions that are responsive to fluid pressure or flow rate thresholds.

Figure 7A:
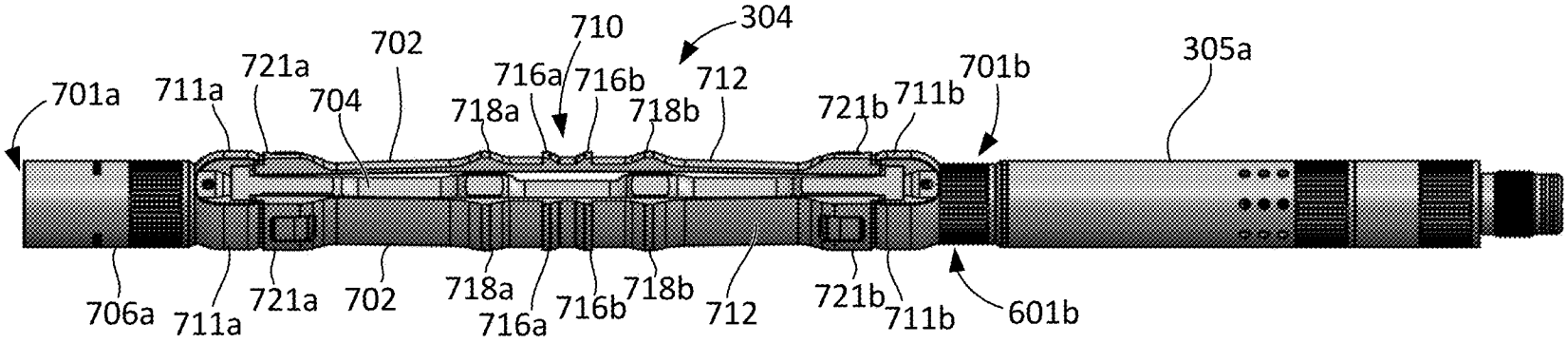
FIG. 7A is a side view of a locator tool of the shifting assembly in FIG. 3 according to some embodiments, including a hydraulic locator connected to a first activation valve.

FIG. 7A is a side view of the locator tool 204 of FIG. 3, including the hydraulic locator 304 connected to the first activation valve 305*a*. The hydraulic locator 304 is in the form of a BHA "sub" in this embodiment, having an uphole connector 706*a* at an uphole end 701*a* and a downhole connector 706*b* at a downhole end 701*b* (see FIGS. 7B and 7C). The uphole connector 706*a* connects to a corresponding downhole end of the selector valve 202 (FIG. 5A). The downhole connector 706*b* connects to the uphole end 601*a* of the first activation valve 305*a*.

The hydraulic locator 304 comprises a frame 704 and one or more sleeve engagement elements 702 mounted to the frame 704. The sleeve engagement elements 702 are in the form of elongate deflectable members in this embodiment. The frame 704 extends between the uphole connector 706*a* and the downhole connector 706*b*. The sleeve engagement members 702 are longitudinally aligned along the frame 704. Each sleeve engagement member 702 has first and second ends 721*a* and 721*b* that are secured to the frame 704 near the ends 701*a* and 701*b* of the locator 304 respectively. In this embodiment each end (721*a*, 721*b*) of the sleeve engagement member 702 is secured by a corresponding latch or retainer (711*a*, 711*b*) positioned near the respective ends 701*a* or 701*b* of the hydraulic locator 304. The hydraulic locator further comprises hydraulic pistons 720 (shown in FIGS. 7B to 7E) operable deflect the sleeve engagement member 702 outward to radially extend the sleeve engagement member 702. The sleeve engagement members 702 may be resilient and biased (e.g. pre-tensioned) to remain in the retracted position and/or un-deflect, such that the sleeve engagement members 702 do not radially extend absent hydraulic activation of the locator 304. The sleeve engagement members 702 may comprise a resilient material (e.g. resilient metal such as spring steel).

In this example embodiment, the hydraulic locator 304 comprises three similar sleeve engagement members 702 arranged and spaced apart circumferentially about the locator 304 (two of the three sleeve engagement members 702 are visible in FIG. 7A). Embodiments are not limited a particular number of sleeve engagement members or to the specific configuration shown in FIG. 7A.

An intermediate portion 710 of each sleeve engagement member 702 (approximately midway between its ends 721*a* and 721*b*) has an outward face 712 defining an outer profile for engaging the inner sleeve of a sleeve valve. In this particular example, the sleeve engagement members 702 are configured for locating and engaging the inner sleeve 410 of the sleeve valves 400*a* and 400*b* shown in FIGS. 4A to 4D. Specifically, the outer profile of the intermediate portion 710 includes a plurality of annular ridges (716*a*, 716*b*, 718*a*, 718*b*) that are shaped complementary to the profile formed by the inner surface 413 of the inner sleeve 410 of the sleeve valves 400*a* and 400*b* (FIGS. 4A to 4D). Two ridges 716*a* and 716*b* are shaped and positioned to fit in annular grooves 414*a* and 414*b* of the inner sleeve 410, and two other ridges 718*a* and 718*b* are shaped and positioned to engage tapered ends 415*a* and 415*b* of the inner sleeve 410. When the sleeve engagement member 702 engages the complimentary profile of the shiftable inner sleeve 410, the hydraulic locator 304 becomes axially fixed with the shiftable inner sleeve 410.

Embodiments are not limited to engaging the particular shiftable inner sleeve or the specific complimentary profiles described above. Other configurations suitable for locating and engaging a shiftable sleeve may be used in other embodiments.

Figure 7B:
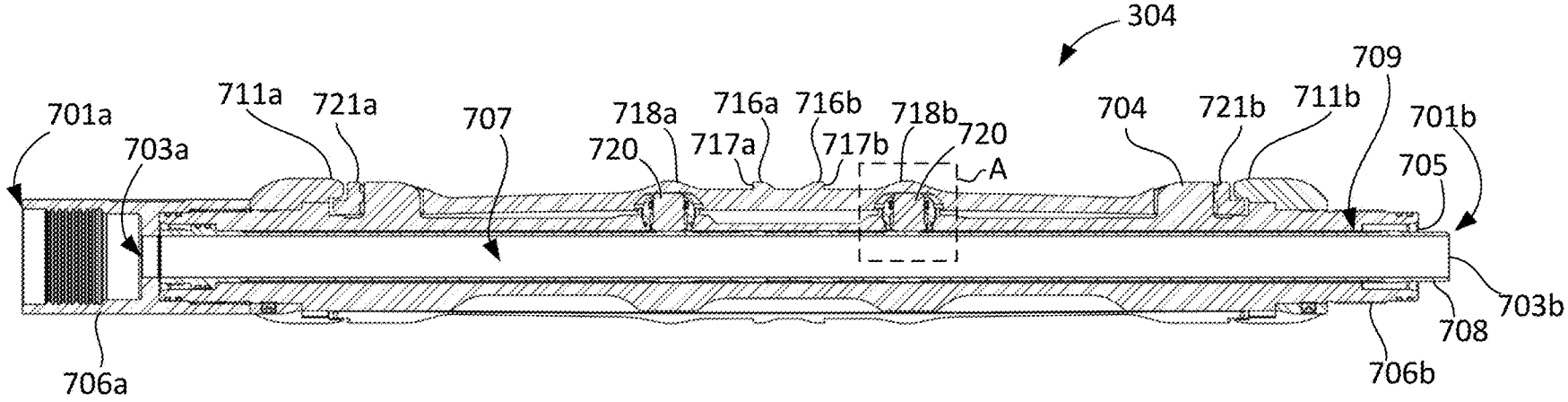
FIGS. 7B and 7C are side cross-sectional views of the example hydraulic locator of FIG. 7A in non-activated and activated configurations, respectively.
Figure 7C:
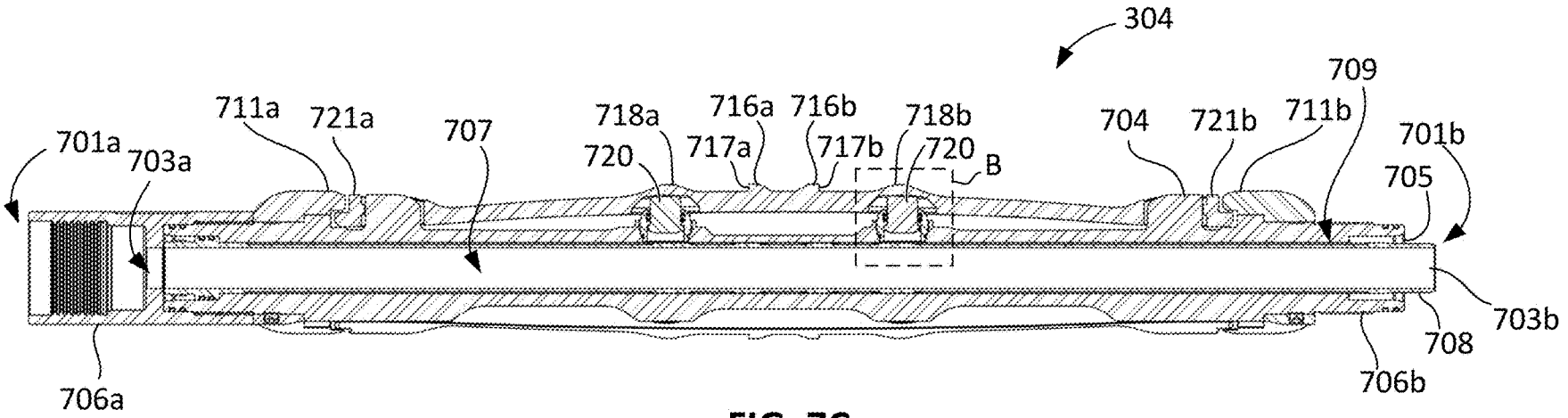

FIGS. 7B and 7C are side cross-sectional views of the example hydraulic locator 304 in the retracted (non-activated) and extended (non-activated) configurations respectively. The hydraulic activation mechanics of the example hydraulic locator 304 are illustrated in FIGS. 7B and 7B. FIG. 7B shows sleeve engagement member 702 in a retracted configuration (i.e. the hydraulic locator 304 is not activated) and FIG. 7B shows sleeve engagement member 702 in an extended configuration (i.e. the hydraulic locator 304 is activated).

The hydraulic locator 304 comprises a tubular inner mandrel 708 extending between the uphole connector 706*a* and the downhole connector 706*b*. The tubular inner mandrel 708 defines the primary locator flow path 707 axially therethrough. The hydraulic locator 304 includes a primary fluid path inlet 703*a* at or near the uphole end 701*a*, and a primary fluid path outlet 703*b* at or near the downhole end 701*b*. The primary locator flow path 707 is part of the primary fluid passage extending through the BHA 200.

In the retracted configuration (FIG. 7B), the sleeve engagement members 702 may not engage the shiftable inner sleeve of a sleeve valve (e.g. inner sleeve 410 of sleeve valves 400*a* and 400*b* of FIGS. 4A to 4D) and the BHA 200 may be run downhole in the casing string without catching on a sleeve valve. In the extended configuration (FIG. 7C), the sleeve engagement members 702 are deflected radially outward from the frame 704 for locating and engage the inner sleeve 410.

The hydraulic locator 304 further includes a secondary locator fluid path 709 with a secondary fluid path inlet 705 at the second end 701*b* of the locator 304, which extends generally between the inner mandrel 708 and the frame 704. The secondary fluid path inlet 705 of the hydraulic locator 304 is coupled to (in fluid communication with) the secondary fluid outlet 605 of the first activation valve 305*a* in FIG. 3. The secondary fluid path 709 carries fluid to the hydraulic pistons 720 for actuation thereof. When the first activation valve 305*a* is activated, fluid pressure from the primary fluid paths (602, 707) is communicated to the secondary flow locator path 709 to actuate the pistons 720 and deflect the sleeve engagement members 702 radially outward to the extended configuration. The primary fluid paths (602, 707) in the locator 304 and first activation valve 305*a* attached thereto together form a first fluid path through the locator tool 204. The secondary fluid paths (605, 709) in the locator 304 and first activation valve 305*a* attached thereto together form a second fluid path through the locator tool 204.

In this embodiment, the hydraulic locator 304 comprises, for each sleeve engagement member 702, one or more hydraulic pistons 720 mounted to the frame 704 under the sleeve engagement member 702. Activating the first activation valve 305*a* causes the hydraulic pistons 720 to extend radially outward from the frame 704. This outward extension deflects the sleeve engagement member 702 outward, thereby extending sleeve engagement member 702 radially outward. When pressure in the secondary locator fluid path 709 is reduced, the sleeve engagement members 702 may again retract.

Typically, the locator 304 will be positioned below a sleeve valve when the locator 304 becomes activated. The sleeve engagement members 702 may extend and press against the inner wall of the casing string. By pulling the locator 304 uphole, the sleeve engagement members 702 may slide along the interior wall of the casing string and sleeve valve until the outer profiles of the sleeve engagement members 702 are aligned with the corresponding profile of the shiftable inner sleeve 410 (in this example). When aligned, the ridges (716*a*, 716*b*, 718*a*, 718*b*) of the sleeve engagement members 702 may fit into the corresponding grooves and tapered ends (414*a*, 414*b*, 415*a*, 415*b*) of the inner sleeve 410, thereby allowing slightly more radial extension of the sleeve engagement members 702 and gripping the inner sleeve. The ridges 716*a* and 716*b* in this example define an uphole-facing right-angled shoulder 717*a* and a downhole-facing right-angled shoulder 717*b* respectively. These shoulders 717*a* and 717*b* may assist with axially securing the sleeve engagement members 702 with the inner sleeve 410.

Figure 7D:
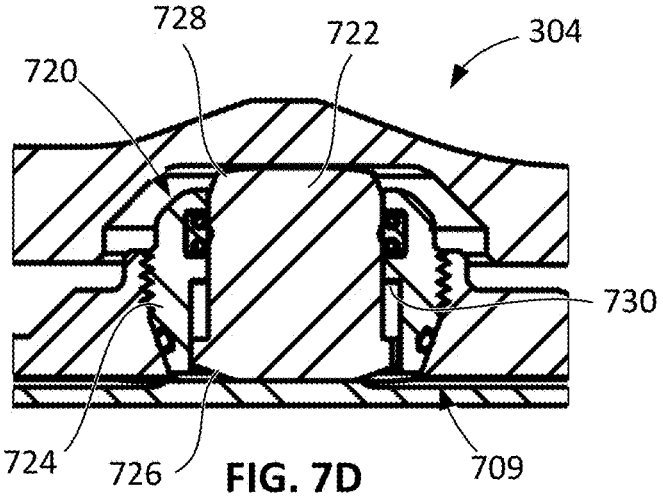
FIG. 7D is an enlarged view of the portion of the hydraulic locator of within the square labelled "A" in FIG. 7B.
Figure 7E:
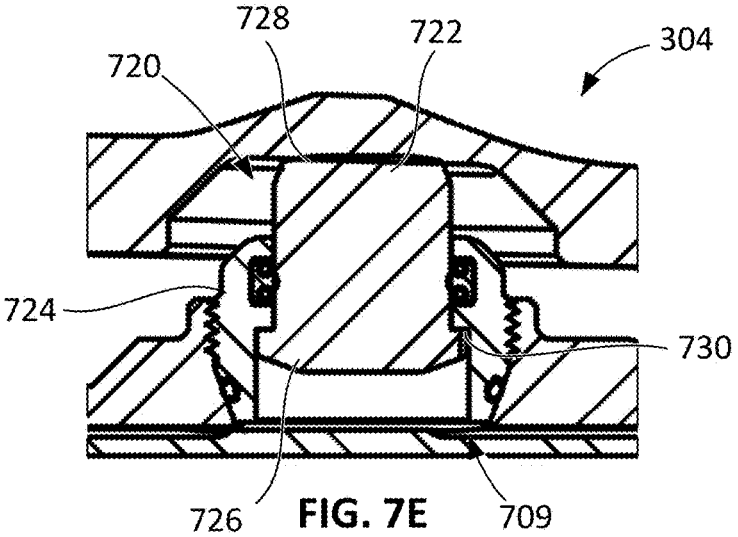
FIG. 7E is an enlarged partial view of the portion of the hydraulic locator within the square labelled "B" in FIG. 7C.

FIG. 7D is an enlarged view of the portion of the hydraulic locator 304 within the square labelled "A" in FIG. 7B. FIG. 7E is an enlarged view of the portion of the hydraulic locator 304 within the square labelled "B" in FIG. 7C. One of the hydraulic pistons 720 is shown in retracted and extended configurations in FIGS. 7D and 7E.

The hydraulic pistons 720 each comprise a piston rod 722 movable to extend and retract within a barrel 724. The rod 722 has a proximal first end 726 within the barrel 724 and a distal second end 728 protruding from the barrel 724 and abutting the underside of the sleeve engagement member 702. The first end 726 is exposed to the secondary locator fluid path 709. Increasing pressure within the secondary locator fluid path 709, relative to the external annulus pressure may create a pressure differential that pushes the piston rod radially outward, thereby extending the piston rod. A shoulder 730 within the barrel 724 functions as a stop limiting extension of the piston rod 722. In operation, activating the first activation valve 305*a* increases pressure within the secondary locator fluid path 709 to extend the piston rod.

Figure 7F:
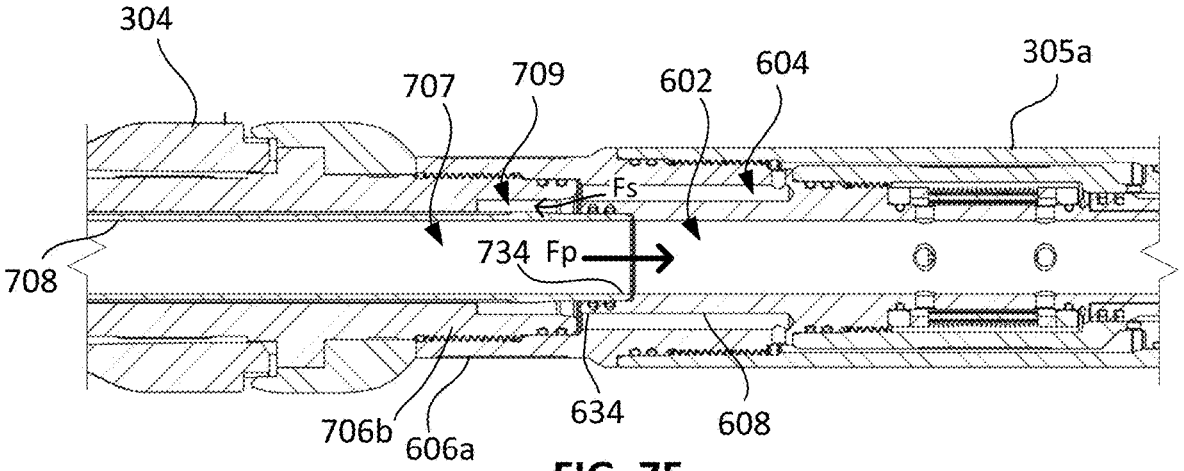
FIG. 7F is an enlarged partial cross-section view of the hydraulic locator and the first activation valve connected together.

FIG. 7F is an enlarged partial cross-section view of the hydraulic locator 304 and the first activation valve 305*a* connected together (by connectors 606*a* and 706*b*) to illustrate the interface of these components. FIG. 7F shows the interface between the primary fluid paths (602, 707) with arrows "Fp" and the interface between the secondary fluid paths (604, 709) with arrow "Fs". As shown, a downhole end 734 of the locator inner mandrel 708 couples to an uphole end 634 of the inner mandrel 608 of the activation valve 305*a*.

Features of the locator tool may vary in other embodiments. For example, the activation valve may be integrated with the hydraulic locator (rather than separate components). Other embodiments may include an expandable or inflatable element (e.g. bladder) that expands responsive to fluid pressure to actuate the sleeve engagement member(s), rather than using an activation valve. In other embodiments, the locator tool may be actuated by mechanical compression of the tool, rather than hydraulically actuated. Embodiments are not limited to sleeve engagement members that are deflected for radial extension. For example, pivoting members such as pads or rods (e.g. dogs) that extend by pivoting to locate and engage a sleeve may be used. Other variations of the locator tool are also possible.

Figure 8A:
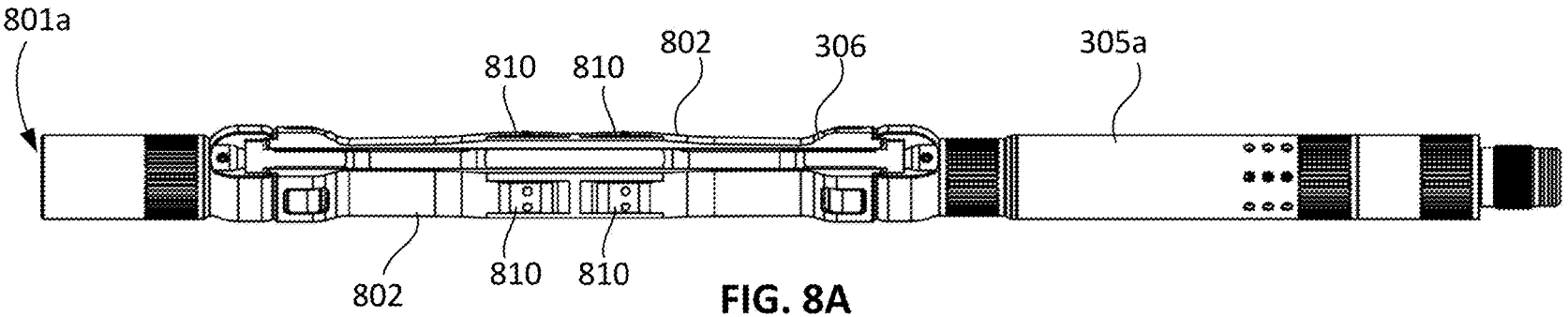
FIG. 8A is a side view of the anchor tool of the shifting assembly of FIG. 3 including a hydraulic anchor according to some embodiments connected to a second activation valve.

FIG. 8A is a side view of the anchor tool 206 of FIG. 3 including the hydraulic anchor 306 connected to the second activation valve 305*b*. The hydraulic anchor 306 is in the form of a BHA "sub" in this embodiment. The hydraulic anchor 306 is similar in structure and operation to the hydraulic locator 304, but with some differences discussed below. The hydraulic anchor 306 and corresponding activation valve 305*b* also connect together with fluid path interfaces similar to the interfaces between the hydraulic locator 304 and its corresponding activation valve 305*a* shown in FIG. 7F and discussed above.

Referring to FIG. 8A, the hydraulic anchor comprises a plurality of extendible and retractable anchor members 802. These anchor members 802 are deflectable to extend radially outward and are structurally similar to the sleeve engagement members 702 of the hydraulic locator 304. However, instead of an outer profile for engaging a shiftable inner sleeve, each anchor member 802 of the hydraulic anchor comprises outward facing anchor pads 810 configured for gripping the inner casing wall. The anchor pads 810 may comprise features for assisting with gripping the casing wall, such as small carbide teeth or other features.

Figure 8B:
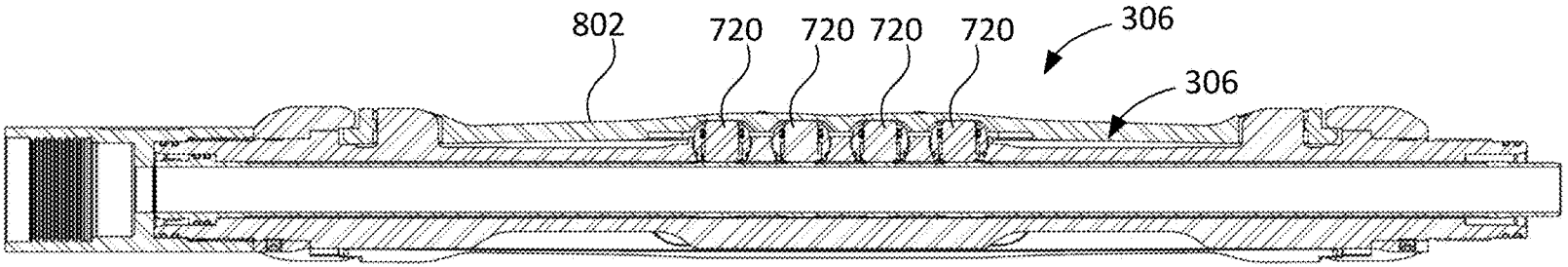
FIGS. 8B and 8C are side cross-sectional views of the hydraulic anchor of FIG. 8A in non-activated and activated configurations respectively.
Figure 8C:
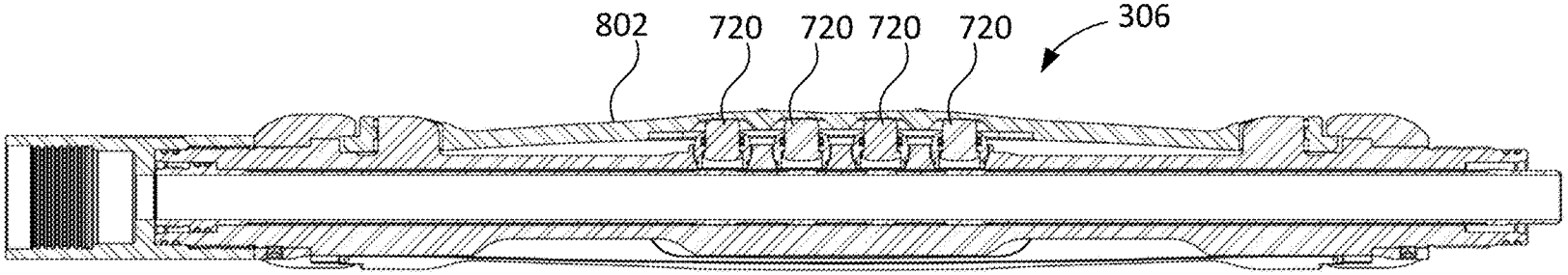

FIGS. 8B and 8C are side cross-sectional views of the example hydraulic anchor 306 in non-activated and activated configurations respectively. As shown, the hydraulic anchor 306 of this embodiment also differs from the hydraulic locator 304 in that it comprises more hydraulic pistons 720 than the hydraulic locator 304. Specifically, in this example, the hydraulic anchor 306 comprises four hydraulic pistons 720 per anchor member 802, whereas the hydraulic locator 304 is shown with two hydraulic pistons 720 per sleeve engagement member 702. The number of hydraulic pistons 720 and/or the higher pressure threshold may be selected for generating sufficient anchoring forces to grip the inner casing wall while the sleeve valve is shifted. However, embodiments are not limited to a particular number or arrangement of the hydraulic pistons.

Similar to the locator tool 204, primary fluid paths in the hydraulic anchor 306 and second activation valve 305*b* attached thereto together form a first fluid path through the anchor tool 206, and secondary fluid paths in the anchor 306 and second activation valve 305*b* attached thereto together form a second fluid path through the anchor tool 206.

Features of the anchor may vary in other embodiments. For example, the activation valve may be integrated with the hydraulic locator (rather than separate subs). Other embodiments may include an expandable member (e.g. bladder) that expands responsive to fluid pressure to actuate the anchor member(s), rather than using an activation valve. In other embodiments, the anchor tool may be actuated by mechanical compression of the tool, rather than hydraulically actuated. Other variations are also possible. The anchor tool may, for example, comprise mechanically actuated slips similar to the isolation tool 210, or other anchoring means.

Figure 9A:
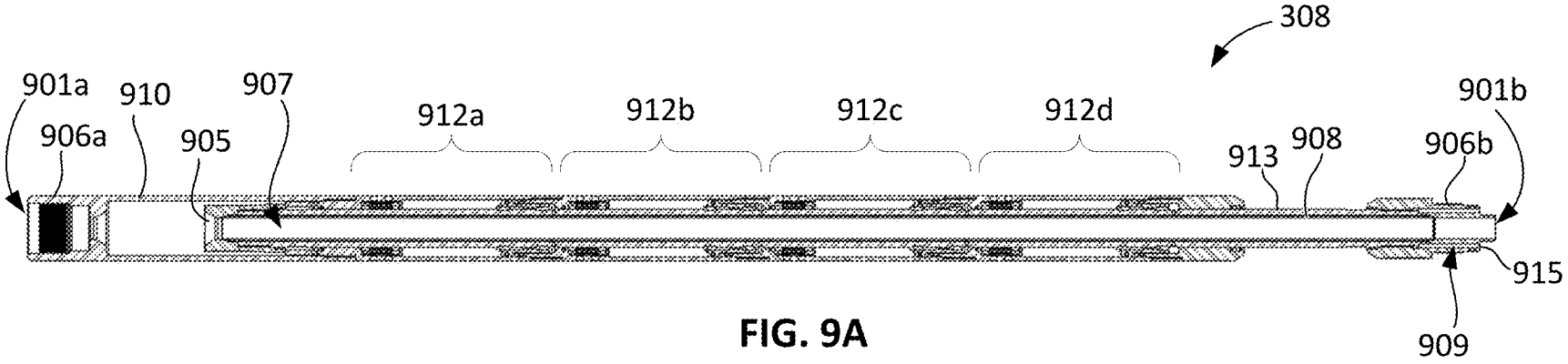
FIGS. 9A and 9B are side cross-sectional views of a hydraulic shifter of the shifting assembly of FIG. 3 in extended and contracted configurations respectively, according to some embodiments.
Figure 9B:
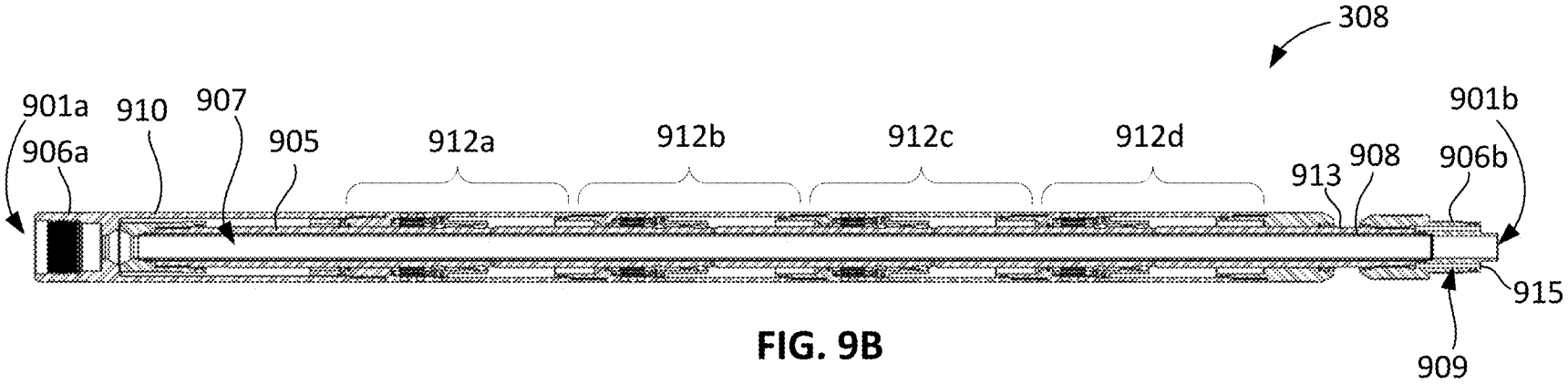

FIGS. 9A and 9B are side cross-sectional views of the example hydraulic shifter 308 in extended and contracted configurations respectively. The hydraulic shifter 308 is in the form of a BHA "sub" having an uphole connector 906*a* at its uphole end 901*a* and a downhole connector 906*b* at its downhole end 901*b*. The uphole connector 906*a* connects to a corresponding downhole end 601*b* of the first activation valve 305*a* associated with the hydraulic locator 304 (shown in FIG. 3). The downhole connector 906*b* connects to the uphole end 601*a* of the corresponding third activation valve 305*c* that activates the hydraulic shifter 308.

When activated by the third activation valve 305*c*, the hydraulic shifter 308 contracts from the extended configuration shown in FIG. 9A to the contracted configuration shown in FIG. 9B. From the contracted configuration, mechanical tension on the uphole end 901*a* of the hydraulic shifter, such as from POOH movement of the coiled tubing, may re-extend the hydraulic shifter 308.

The hydraulic shifter 308 in this embodiment comprises an elongate inner body 905 and an outer housing 910. The inner body 905 is partially received within and telescopes with the outer housing 910 (i.e. is slidable relative to the outer housing 910). The inner body 905 telescopes axially relative to the outer housing 910 at least over the distance to fully shift the shiftable inner sleeve of the sleeve valve. The inner body 905 comprises a sleeve 913 and a tubular inner mandrel 908 mounted substantially concentrically within the sleeve 913. A small annular space 914 (best shown in FIG. 9E) is formed between the sleeve 913 and the inner mandrel 908. The annular space 914 extends along the length of the inner mandrel 908 at and is closed at or before the uphole end thereof.

The hydraulic shifter 308 comprises a plurality of stacked hydraulic cylinders 912*a* to 912*d*, with the inner mandrel functioning as a piston rod for each of the hydraulic cylinders 912*a* to 912*d* and the outer housing functioning as a barrel for the hydraulic cylinders 912*a* to 912*d*. The hydraulic cylinders 912*a* to 912*d* are configured to retract the inner body 905 relative to the outer housing 910 responsive to a pressure differential caused by increasing pressure within the inner mandrel 908 relative to the exterior of the outer housing 910. The stacked plurality of hydraulic cylinders 912*a* to 912*d* may increase the total hydraulic force provided compared to a single cylinder. The force may multiply (scale approximately linearly) with the number of hydraulic cylinders. The hydraulic cylinders 912*a* to 912*d* and fluid pressure driving them is selected to provide sufficient force to shift a shiftable inner sleeve of a sleeve valve (e.g. sleeve valve 400*a* or 400*b* from FIGS. 4A to 4D) from an uphole sleeve position to a downhole sleeve position.

Similar to the hydraulic locator 304 and the hydraulic anchor 306, the hydraulic shifter 308 also defines a primary shifter fluid path 907 therethrough from the uphole end 901*a* to the downhole end. The primary fluid path 907 extends through the inner mandrel 908 and forms part of the primary fluid passage through the BHA 200. The hydraulic shifter 308 also further defines a secondary fluid path 909 comprising a secondary fluid path inlet 915 that couples to the secondary valve fluid path 604 of the third activation valve 350*c*. The secondary shifter fluid path 909 extends through the annular space 914 between the inner mandrel 908 and sleeve 913 to each of the hydraulic cylinders 912*a* to 912*d*. When the third activation valve 305*c* is activated, fluid pressure from the primary shifter fluid path 907 is communicated via the third activation valve 305*c* to the secondary fluid path 909 for causing the hydraulic cylinders 912*a* to 912*d* to axially contract the hydraulic shifter 308.

The primary fluid paths (602, 907) in the shifter 308 and third activation valve 305*c* attached thereto together form a first fluid path through the shifting tool 208. The secondary fluid paths (605, 709) in the shifter 308 and third activation valve 305*c* together form a second fluid path through the shifting tool 208. Pressure within the second shifting path exceeding the pressure within the first fluid path creates a hydraulic force urging the shifting tool toward the axially contracted position.

Figure 9C:
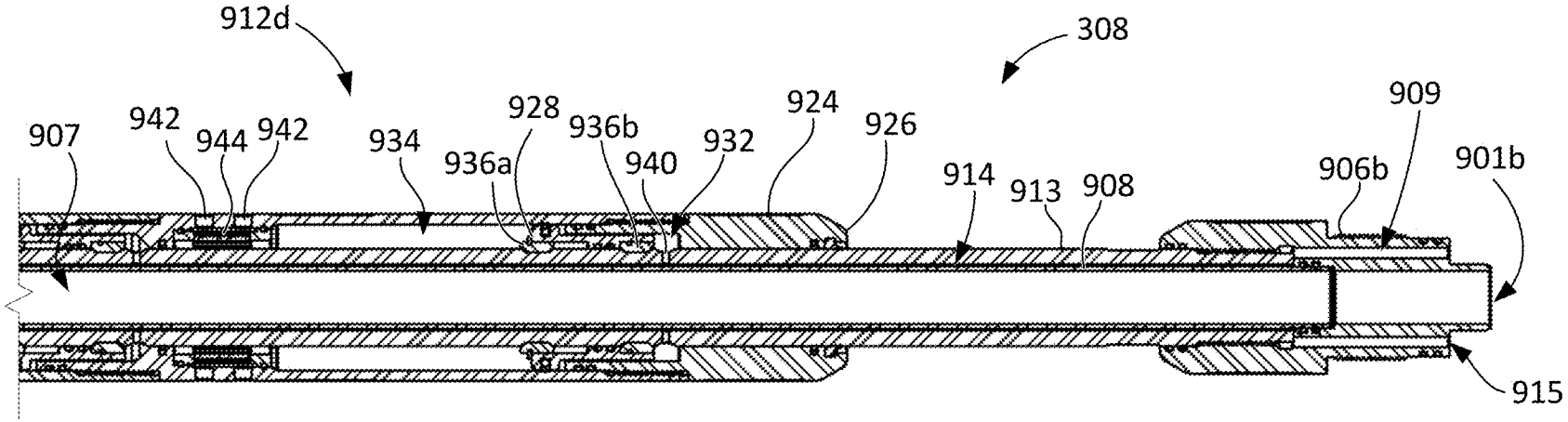
FIGS. 9C and 9D are enlarged partial views of the hydraulic shifter of FIGS. 9A and 9B.
Figure 9D:
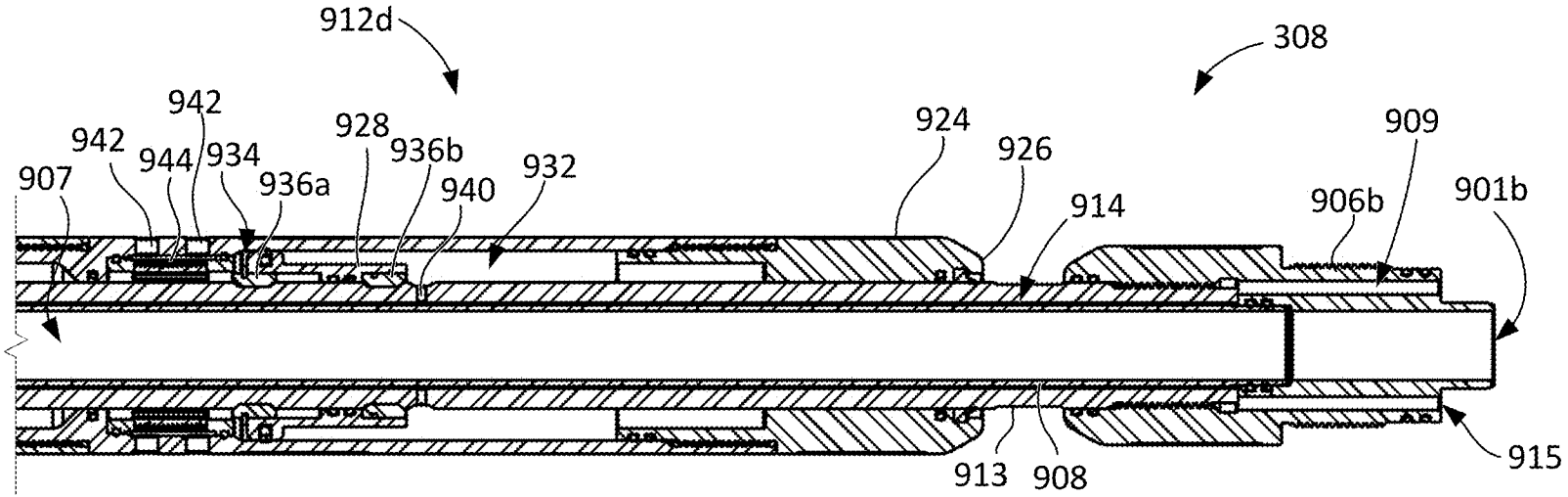

FIGS. 9C and 9D are enlarged partial views of the hydraulic shifter 308 in extended and contracted configurations respectively. The downhole-most hydraulic cylinder 912*d* is shown in FIGS. 9C and 9D. The remaining hydraulic cylinders 912*a* to 912*c* have a similar structure.

The outer housing 910 includes a guide portion 924 at its downhole end 926 that fits and seals around the inner body 905. A piston collar 928 is mounted on the outer surface of the sleeve 913. The outer housing 910, sleeve 913 of the inner body 905 and piston collar 928 define a first annular fluid chamber 932 downhole of the piston collar 928 and a second annular fluid chamber 934 uphole of the piston collar 928. The piston collar 928 is axially fixed to the sleeve 913 by retaining rings 936*a* and 936*b* and is axially slidable relative to the outer housing 910. The piston collar 928 separates the first and second fluid chambers 932 and 934.

The sleeve 913 defines a flow port 940 therethrough from the annular space 914 within the sleeve 913 to the first fluid chamber 932. Relief ports 942 are defined through the outer housing 910 from its outer surface to the second fluid chamber 934. The pressure within the second fluid chamber 934 may therefore be equalized with fluid in the annulus between the BHA 200 and the casing of the wellbore.

When the third activation valve 305*c* is not activated (i.e. when fluid pressure within the primary fluid paths (602, 907) is below the corresponding threshold) the fluid pressure within the first fluid chamber 932 is matched with the annulus between the BHA 200 and the casing since the secondary fluid paths (604, 909) of the hydraulic shifter 308 and third activation valve 305*c* will be in fluid communication with the annulus through the pressure equalization ports 630 of the third activation valve 305*c* (FIGS. 6A and 6B). When the third activation valve 305*c* is activated by pressure above the corresponding threshold, the pressure in the secondary fluid paths (604, 909) will increase, creating a pressure differential that causes fluid to flow into the first fluid chamber 932 via the flow port 940 and expand the first fluid chamber 932. The relief ports 942 allow fluid to exit the second fluid chamber 934 as the second fluid chamber shrinks. The collective expansion of the first fluid chamber 932 and corresponding chambers of the remaining hydraulic cylinders (912*a* to 912*c*) moves the outer housing 910 relative to the inner body 905 such that the inner body 905 is retracted into the outer housing 910. This movement axially contracts the hydraulic shifter to the contracted configuration shown in FIG. 9D.

In this example, an optional filter screen 944 is positioned in the outer housing 910 adjacent the relief ports 942 to filter solids or debris from entering the second fluid chamber 934.

Figure 9E:
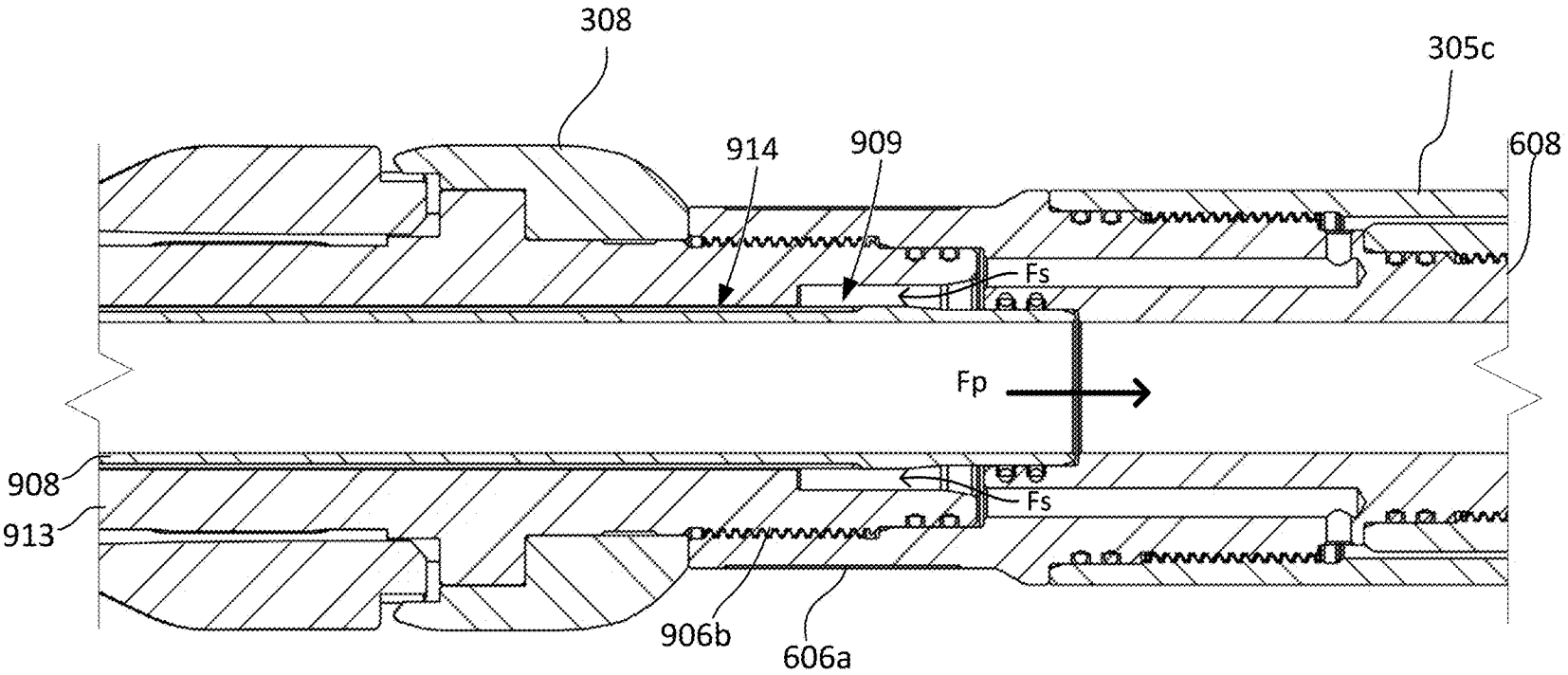
FIG. 9E is an enlarged partial cross-section view of the hydraulic shifter and a third activation valve connected together.

FIG. 9E is an enlarged partial cross-section view of the hydraulic shifter 308 and third activation valve 305*c* connected together (by connectors 606*a* and 906*b*). FIG. 8 shows the interface between the primary fluid paths (602, 907) with arrows "Fp" and the interface between the secondary fluid paths (604, 909) with arrow "Fs". As shown, a downhole end of the inner mandrel 908 couples to the inner mandrel 608 of the activation valve 305*c*.

Features of the shifting tool may vary in other embodiments. For example, the activation valve may be integrated with the hydraulic locator (rather than separate components). Other variations and means of hydraulic contraction of the shifting tool may also be implemented. In other embodiments, the shifting tool may be actuated by mechanical compression of the tool, rather than hydraulically actuated.

Figure 10:
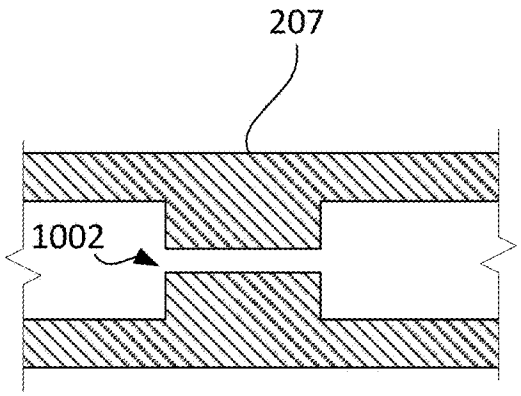
FIG. 10 is a cross-sectional partial view of an example embodiment of a flow restriction device of the shifting assembly of FIG. 3.

FIG. 10 is a cross-sectional partial view of an example embodiment of the flow restriction device 207 of FIG. 3. In this example, the flow restriction device 207 comprises a simple flow restriction orifice 1002 that may restrict flow through the primary fluid passage of the BHA 200 to allow flow rate control at surface to in turn control pressure within the primary fluid passage for selectively and sequentially activating the hydraulic locator 304, the hydraulic anchor 306 and the hydraulic shifter 308. Flow rates between 200 to 350 L/min or between 200 to 600 L/min may be used in conjunction with a flow restriction device to generate pressures at the desired thresholds. Embodiments are not limited to any particular fluid pressure threshold values or flow rate values.

In other embodiments, a flow restriction valve may be used rather than a simple orifice. The flow restriction valve may be controllable to cycle between a flow restriction mode where flow is restricted, and a free flow mode where flow is not restricted. In the flow restricted mode, the shifting assembly 205 of FIG. 3 may be controlled to shift down. In some embodiments, flow may be substantially or completely restricted (i.e. blocked) by the flow restriction device for hydraulic activation of the shifting assembly 205. Blocked flow may require very low to zero flow rate to generate the required pressure.

Referring again to FIG. 3, the J-slot mechanism 212 in this embodiment is configured to be cycled through a set of states (or J-slot positions) for controlling a fracturing operation using the BHA 200. The J-slot mechanism 212 cycles through a plurality of positions responsive to cycling of the coiled tubing. That is, successive uphole and downhole movement of the coiled tubing causing corresponding uphole or downhole tension on the J-slot mechanism cycles the J-slot mechanism through those positions. The J-slot mechanism is configured to prevent setting of the resettable packer 312 until a fracturing substage of operation described below.

When the J-slot mechanism 212 is cycled to a fracturing substage position, RIH coiled tubing movement applies downhole force on the isolation tool 210 that may now close the equalization valve 310 and set the resettable packer 312

Example methods of opening and/or closing shift-up-to-open and shift-down-to-open sleeve valves using the shifting assembly 205 of the BHA 200 of FIGS. 2 and 3 will now be described.

Figure 11:
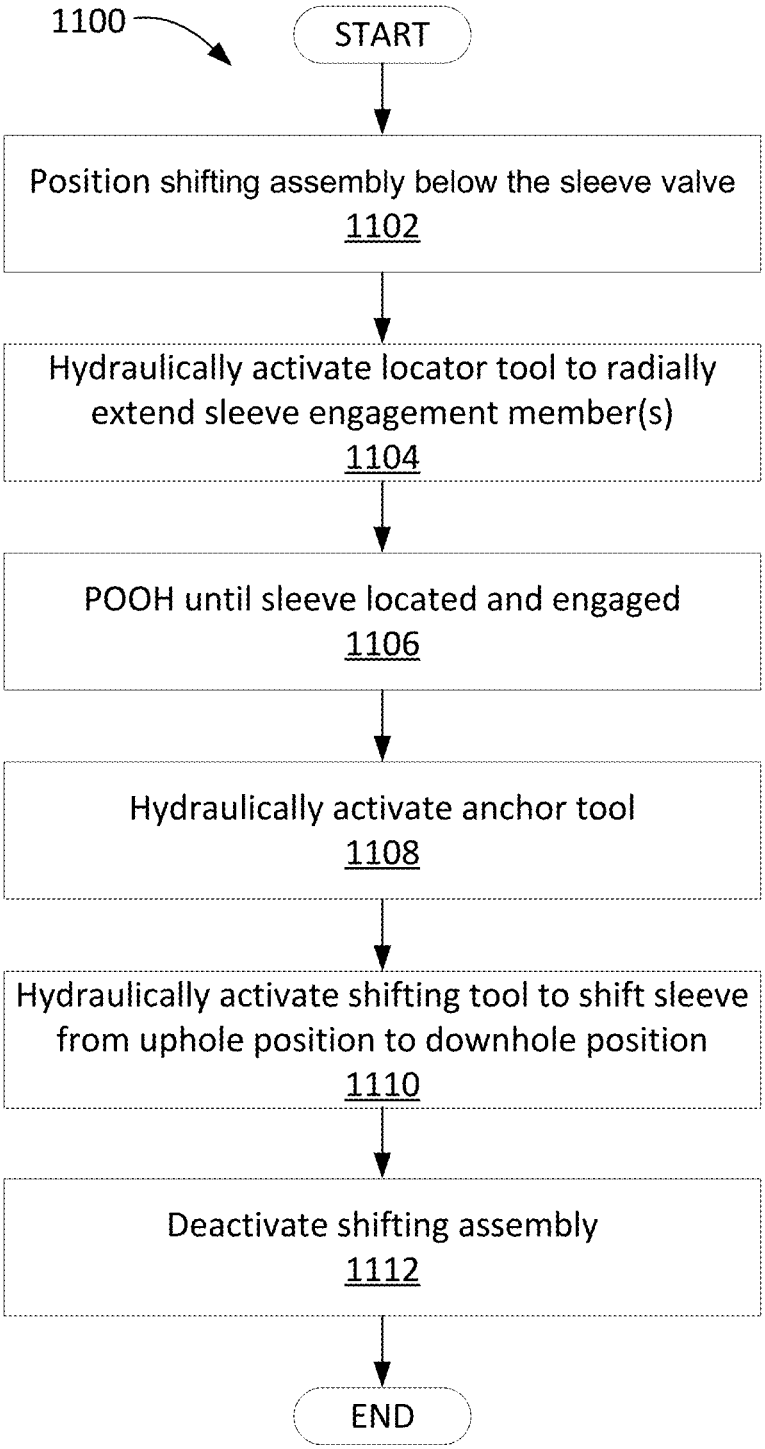
FIG. 11 is a flowchart of an example method for shifting an inner sleeve of a sleeve valve in a casing string from an uphole sleeve position to a downhole sleeve position according to some embodiments.

FIG. 11 is a flowchart of a method 1100 for shifting an inner sleeve of a sleeve valve in a casing string from an uphole sleeve position to a downhole sleeve position according to some embodiments. This method will be described with reference to the example shifting assembly 205 and shift-down-to-open sleeve valve 400*a* described above. However, embodiments are not limited to the embodiments in FIGS. 2 to 4D. For this method, the inner sleeve 410 starts in the uphole (closed) position shown in FIG. 4A.

At step 1102, the shifting assembly 205 is positioned in the casing string below the sleeve valve. Positioning the shifting assembly may comprise running the shifting assembly 205 downhole by RIH coiled tubing movement until the shifting assembly 205 is estimated to be below the sleeve valve.

In embodiments with a selector valve similar to the example selector valve 202 in FIG. 3, RIH movement may put mechanical compressive forces on the selector valve 202 so the selector valve 202 is in its "bypass mode". This may ensure the locator tool 204, shifting tool 208 and anchor tool 206 are not hydraulically activated as the shifting assembly 205 is run in hole. Optionally, after the shifting assembly 205 is positioned at step 1102, POOH movement may shift the selector valve 202 to "active" mode to enable hydraulic activation of the locator tool 204, shifting tool 208 and anchor tool 206.

At step 1104, the locator tool 204 is hydraulically activated to radially extend the sleeve engagement member(s) 702. Activating the locator tool 204 may comprise increasing tubing pressure to meet or exceed the first pressure threshold of the first activation valve 305*a*. However, fluid pressure may be kept below the second and third pressure thresholds of the second and third activation valves 305*b* and 305*c* so that the shifting tool 208 and anchor tool 206 do not yet activate.

At step 1106, shifting assembly 205 is pulled in the uphole direction (i.e. POOH movement of the coiled tubing) to move the locator tool 204 uphole for locating the sleeve valve. This may comprise further POOH movement of the coiled tubing to pull the BHA 200 in the uphole direction until the sleeve engagement elements 702 of the locator tool 204 engage the matching profile of the shiftable inner sleeve of the sleeve valve (e.g. inner sleeve 410 of the sleeve valve 400*b*. The complimentary and matching profiles of the inner sleeve 410 and the sleeve engagement elements 702 allows the sleeve elements to further radially extend to engage and become axially secured with the inner sleeve 410. The inner sleeve 410 is thus "located". The locating of the inner sleeve 410 may be detectable at surface, for example, by an increase in a coil surface weight indicator.

The POOH movement of the BHA 200 may also extend the shifting tool 208.

At step 1108, the anchor tool 206 is hydraulically activated. Activating the anchor tool 206 may comprise increasing the tubing pressure until it meets or exceeds the second pressure threshold of the second activation valve 305*b* (but not the third pressure threshold of the third activation valve 305*c*). When activated, the anchor members 802 are hydraulically actuated to radially extend and grip the inner wall of the casing string. The tubing pressure applied may be sufficient for securing the anchor tool 206 in the casing string to withstand axial forces required to open the sleeve valve in the next step.

At step 1110, the shifting tool 208 is hydraulically activated to contract. Activating the shifting tool 208 may comprise increasing the tubing pressure until it meets or exceeds the third pressure threshold of the third activation valve 305*c*, thereby causing the hydraulic shifter 308 to contract from the extended configuration to the contracted configuration. Since the anchor tool 206 is axially secured to the casing string below the shifting tool 208, this contraction causes the locator tool 204 to shift downhole, thereby shifting the inner sleeve 410 of the sleeve valve 400*a* from the uphole (closed) sleeve position of FIG. 4A to the downhole (open) sleeve position of FIG. 4B. The shifting tool applies sufficient force to overcome biasing forces holding the inner sleeve 410 in the downhole (closed) position In cases where downhole compressive force from the coiled tubing is sufficient to downshift the sleeve valve, step 1110 might be omitted.

Optionally, at step 1112, the locator tool 204, the shifting tool 208 and the anchor tool 206 are deactivated (i.e. released). This may comprise reducing fluid flow from the coiled tubing to reduce tubing pressure back below the first pressure threshold. In embodiments including the selector valve 202, RIH movement of the coiled tubing may be applied to switch the selector valve 202 back to "bypass mode", thereby deactivating the locator tool 204, the shifting tool 208 and the anchor tool 206.

The same steps described above for opening a shift-down-to-open sleeve valve may instead be used to close a shift-up-to-open sleeve valve (e.g. the sleeve valve 400*b* of FIGS. 4C and 4D).

Figure 12:
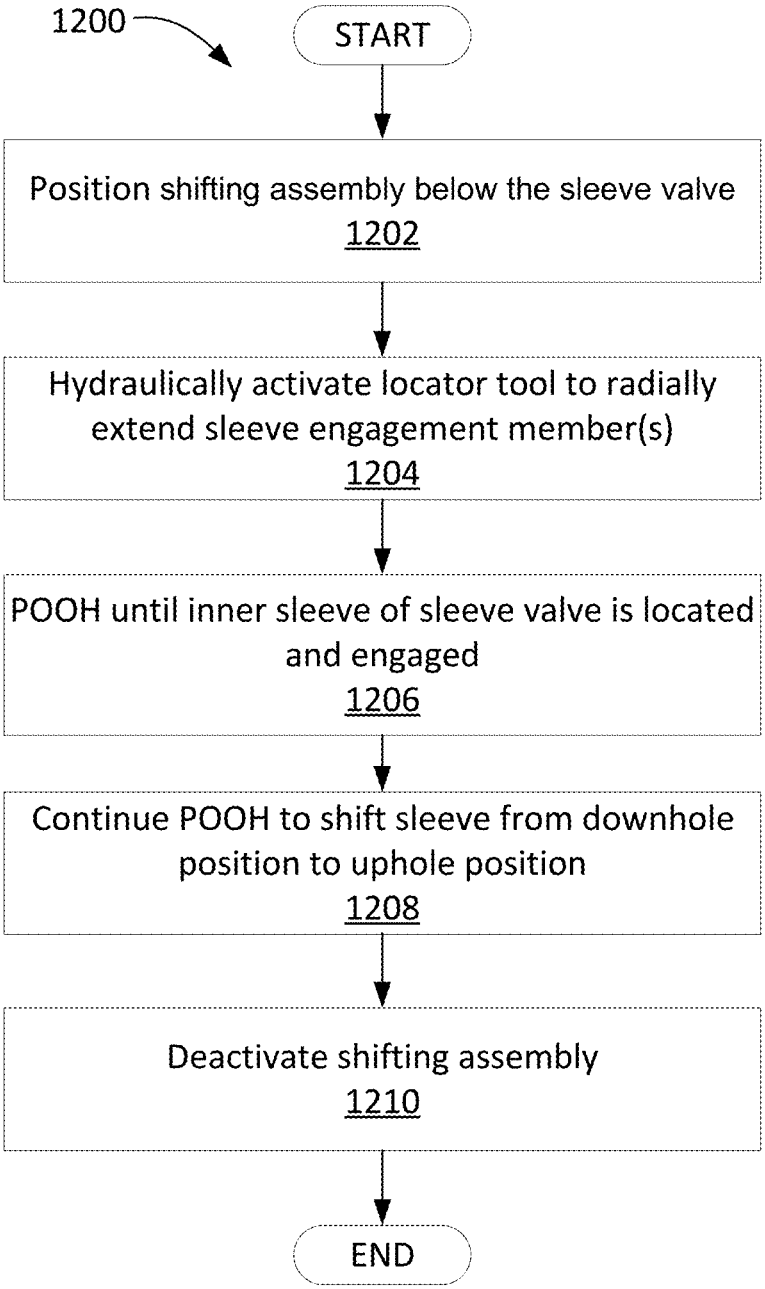
FIG. 12 is a flowchart of an example method for shifting an inner sleeve of a sleeve valve in a casing string from a downhole sleeve position to an uphole sleeve position according to some embodiments.

FIG. 12 is a flowchart of an example method for shifting an inner sleeve of a sleeve valve in a casing string from a downhole sleeve position to a an uphole sleeve position. This method will be described with reference to the example shifting assembly 205 and shift-up-to-open sleeve valve 400*b* described above. However, embodiments are not limited to the embodiments in FIGS. 2 to 4D.

At step 1202, the shifting assembly 205 is positioned in the casing string below the sleeve valve, similar to step 1102 of FIG. 11. In embodiments with a selector valve 202, the selector valve 202 may be similarly controlled as described above.

At step 1204, the locator tool 204 is hydraulically activated to radially extend the sleeve engagement member(s) 702, similar to step 1104 of FIG. 11.

At step 1206, shifting assembly 205 is moved in the uphole direction (e.g. POOH movement of the coiled tubing) until the sleeve engagement members 702 locate and engage the inner sleeve, similar to step 1106 of FIG. 11.

At step 1208, uphole (POOH) movement of the coiled tubing continues to pull the shifting assembly 205 and inner sleeve 410 in the uphole direction. Sufficient uphole force may be applied to overcome biasing or resistive forces holding the inner sleeve 410 in the downhole (closed) position, in order to shift the inner sleeve from to the uphole (open) sleeve position. For this step, the tubing fluid pressure is maintained so that the locator tool 204 remains engaged with the inner sleeve 410. In this opened position of the inner sleeve 410. At this point, the locator tool 204 is axially stopped from further uphole movement by the inner sleeve 410. This stopping of the inner sleeve 410 in the opened position may be detectable at surface (e.g., by the coil surface weight indicator). Any other suitable means for detecting the opening of the sleeve valve may be employed. POOH tension on the coiled tubing may optionally be stopped or reduced upon detection of the sleeve shifting to the uphole sleeve position.

Optionally, at step 1210, the locator tool 204 may be released from the inner sleeve 410, similar to step 1112 of FIG. 11.

The same steps described above for opening a shift-up-to-open sleeve valve may instead be used to close a shift-down-to-open sleeve valve (e.g. the sleeve valve 400*a* of FIGS. 4A and 4B).

Example fracturing stage methods using shift-down-to-open and shift-up-to-open sleeve valves and the BHA 200 including the shifting assembly 205 are discussed below. However, embodiments are not limited to these specific methods. Furthermore, embodiments described herein may be used with both shift-down-to-open and shift-up-to-open sleeve valves. For example, a well system may include a combination of shift-down-to-open and shift-up-to-open sleeve valves, and the same BHA in some embodiments described herein may be used for opening/closing both sleeve valve types without needing to reconfigure or customize the BHA.

A fracturing stage may generally include opening a sleeve valve, isolating a zone of the wellbore in the vicinity of the sleeve valve and pumping fracturing fluid into the zone of the wellbore. Overall, each fracturing stage may include, but is not limited to, the following phases or substages: (a) run BHA in hole to position below target sleeve valve; (b) locate the sleeve valve; (c) open the sleeve valve; (d) set an isolation tool to allow pressure to be built in the annulus; (e) pump fracturing fluid at high pressure (i.e., fracturing); (f) release the packer. Optionally, the fracturing stage may also include the one or more of the following substages (g) close the sleeve valve; (h) perform a pressure test; and (i) cycle to BHA for the next fracturing stage. One or more of the substages above may be omitted. The operation may also include additional or fewer substages.

An example method for performing a fracturing stage using the BHA 200 of FIG. 3 and a shift-down-to-open sleeve valve will now be described with reference to FIGS. 13A and 13B. In this example, the process will be described with reference to the example sleeve valve 400*a* in FIGS. 4A and 4B, but embodiments are not limited to this specific example.

(a) RIH Below Sleeve Valve

At step 1302, the BHA 200 is run downhole by RIH coiled tubing movement to a position in which the locator tool 204 is downhole of the target sleeve valve 400*a* to be opened. The locator tool 204 may be moved to a position that is a predetermined approximate distance below the sleeve valve 400*a*. In this step, components of the BHA 200 may have the following states/configurations:

| Component | State |
|---|---|
| Selector Valve 202 | Bypass mode |
| Locator tool 204 | Retracted |
| Shifting tool 208 | Contracted |
| Anchor tool 206 | Retracted |
| Equalization Valve 310 | Closed/Collapsed |
| Resettable Packer 312 | Unset |
| J-slot mechanism 212 | "Run-in-hole" |

The contracted/open position of the selector valve 202 is shown in FIG. 5B. In this configuration, fluid from the coiled tubing is bypassed to the annulus, and fluid therefor does not flow through or activate the locator tool 204, shifting tool 208, or anchor tool 206. The sleeve engagement elements 702 of the locator tool 204 and anchor members 802 of the anchor tool are in their retracted configurations (see FIGS. 7B and 8B).

The initial RIH movement for positioning the locator tool 204 may cycle the J-slot mechanism to the "Run in Hole" setting that disables setting of the packer 312. Thus, the RIH movement of the BHA 200 in this substage does not set the packer 312 in the casing.

(b) Locate Sleeve Valve

With the locator tool 204 in the desired initial position below the sleeve valve 400*a*, the method may continue to step 1304.

At step 1304, the POOH movement of the coiled tubing is applied. The POOH movement of the coiled tubing in this substage mechanically may extends the shifting tool 208 and open the equalization valve 310. The tension from the POOH movement of the coil tubing may also mechanically extends the selector valve 202, thereby activating its "active" mode of operation. Thus, fluid from the coiled tubing no longer flows to the annulus from the selector valve 202. Rather, fluid flow from the coiled tubing is now directed through the selector valve 202, through the primary fluid passage of the locator tool 204, shifting tool 208, and anchor tool 206 of the BHA 200.

At step 1306, the locator tool 204 is activated by increasing the tubing fluid pressure to meet or exceed the first pressure threshold, thereby radially extending its sleeve engagement members 702.

At step 1308, the BHA 200 is pulled uphole (POOH movement of the BHA) until the inner sleeve 410 is located and engaged by the sleeve engagement members 702. The POOH movement of steps 1304 and/or 1308 also cycles the J-slot mechanism to a configuration that may be referred to as "first POOH setting" herein. The engagement of the inner sleeve may be detectable at surface by increased tension on the coiled tubing. POOH tension on the coiled tubing may optionally be stopped or reduced upon detection of sleeve engagement.

At this point, components of the BHA 200 may have the following states/configurations:

| Component | State |
|---|---|
| Selector Valve 202 | Active mode |
| Locator tool 204 | Extended |
| Shifting tool 208 | Extended |
| Anchor tool 206 | Retracted |
| Equalization valve 310 | Open/Extended |
| Resettable Packer 312 | Unset |
| J-slot mechanism 212 | "POOH" |

The J-slot mechanism may not be cycled again until step 1316 below.

(c) Open Sleeve Valve

At step 1310, the anchor tool 206 is activated to radially extend the anchor members 802 against the casing, by increasing the tubing fluid pressure to meet or exceed the second pressure threshold.

At step 1312, the shifting tool 208 is activated to contract from the extended configuration to the contracted configuration, by increasing the tubing fluid pressure to meet or exceed the third pressure threshold. This contraction of the shifting tool 208 causes the locator tool 204 to shift the inner sleeve 410 from the uphole sleeve position to the downhole sleeve position. Steps 1302, 1304, 1306, 1308, 1310 and 1312 are similar to the process of opening the sleeve valve 400*a* described above with reference to FIG. 11.

At this point, components of the BHA 200 may have the following states/configurations:

| Component | State |
|---|---|
| Selector Valve 202 | Active mode |
| Locator tool 204 | Extended |
| Shifting tool 208 | Contracted |
| Anchor tool 206 | Extended |
| Equalization valve 310 | Open/Extended |
| Resettable Packer 312 | Unset |

At step 1314, the locator tool 204 is released from the inner sleeve 410. For example, RIH movement of the coiled tubing may be applied, which contracts and switches the selector valve 202 back to "bypass" mode such that fluid from the coiled tubing is bypassed into the annulus rather than through the BHA components downhole thereof. As a result, the sleeve engagement elements 702 of the locator sub retract and release from the inner sleeve 410, and the anchor tool 206 similarly releases from the casing.

(d) Set Isolation Tool

At step 1316, further RIH movement is applied by the coiled tubing sufficient to: cycle the J-slot mechanism to the "Set/Frac" or "Set for Frac" setting; close the equalization valve; and set the resettable packer. In the "Set for Frac" setting of the J-slot mechanism, the resettable packer 312 is enabled for being set to stop fluid flow in the annulus. To set the packer 312, the further RIH movement combined with the drag provided by the drag block 214 generates compressive force on the BHA which activates the slips 313 and axially compresses the packer ring 315. Compression of the packer ring 315 radially expands the packer ring 315 to fill the annulus and seal against the inner casing wall, thereby setting the packer 312.

The RIH movement in steps 1314 and/or 1316 may also mechanically finish collapsing the shifting tool 208 if opening the sleeve valve 400*a* did not fully collapse the shifting tool 208 in step 1312. The shifting tool 208 may contract a known "stroke" distance in movement from the extended configuration to the collapsed configuration. This stroke distance of the shifting tool 208 may be approximately equal to the axial travel distance of the inner sleeve 410, or the stroke distance of the shifting tool 208 may be greater than the axial travel distance of the inner sleeve 410. In such cases, down-shifting the inner sleeve may "partially stroke" the shifting tool, and the subsequent RIH movement to set the isolation tool may complete the contraction of the shifting tool 208.

If tubular friction of the coiled tubing in the well is preventing the RIH movement in this step, fluid may be pumped in the annulus past the coil tubing and the top section of the BHA to facilitate the RIH movement. The BHA 200 may allow this fluid flow in the annulus since the relief valve is closed and the re-settable packer is not set. This may advantageously assist in moving the portion of the BHA 200 above the packer 312 downhole to set the BHA in position for fracturing.

Contracting or collapsing the shifting tool 208 and setting the packer 312 by RIH movement of the coiled tubing may move the locator tool 204 downhole by a known (or approximately known) distance below the sleeve valve 400*a*. A section of the BHA above the locator tool 204 that is expected to be positioned adjacent the sleeve valve during fracturing may be provided with a reduced outer diameter. The reduced outer diameter section may maximize annular cross-sectional area and may reduce erosion. Additionally, the section of the BHA 200 adjacent the ports during fracturing may be made of a wear resistant material to reduce wear from the abrasive fracturing fluid as it changes direction to flow out of the ports into the formation.

(e) Fracture

At step 1318, fracturing fluid is pumped downhole to fracture an earth formation in the region of the sleeve valve 400*a*. The fracturing fluid may be pumped into the annulus and enter the formation via the ports 408 in the opened sleeve valve 400*a*.

At this point, components of the BHA 200 may have the following states/configurations:

| Component | State |
|---|---|
| Selector Valve 202 | Bypass |
| Locator tool 204 | Retracted |
| Shifting tool 208 | Contracted |
| Anchor tool 206 | Retracted |
| Equalization Valve 310 | Closed |
| Resettable Packer 312 | Set |
| J-slot mechanism 212 | "Set/Frac" |

(f) Release Packer

At step 1320, the coiled tubing is again cycled with POOH movement, and the tension on the BHA may extend the selector valve 202 to switch it back to "active" mode of operation and open the equalization valve 310. The POOH movement also unsets the packer 312 of the isolation tool 210 after the equalization valve 310 has been opened.

If the sleeve valve is to be left open after the fracturing substage, then the method may skip steps 1322 to 1332 discussed below and instead continue to step 1334.

(g) Close Sleeve Valve

Optionally, after the fracturing is complete the sleeve valve 400*a* may be closed. More specifically, at step 1322, the locator tool 204 is activated to extend the sleeve engagement members 702. Then at step 1324, the locator tool is pulled uphole (by POOH movement of the coiled tubing) to until the sleeve valve is located (i.e., the the sleeve engagement members 702 engage and locate the inner sleeve 410). Then at step 1326, further POOH movement may be applied to up-shift the inner sleeve 410 to the uphole sleeve position, thereby closing the sleeve valve. At step 1328, the locator tool 204 is released from the sleeve valve by appling RIH movement of the coiled tubing to switch the selector valve back to "bypass" mode, or alternatively by decreasing pressure in the BHA 200 below the first pressure threshold.

(h) Pressure Test

Optionally, a pressure test may be performed to verify the sleeve valve 400*a* is closed. If no pressure test is to be performed, then method may skip steps 1330 and 1332 discussed below and move to step 1332.

For the pressure test, at step 1330, RIH movement of the coiled tubing may again be applied until the equalization valve 310 is closed, and the resettable packer 312 has been reset.

At step 1332, the pressure test may be performed to verify the sleeve valve 400*a* is closed. The pressure test may comprise pumping fluid into the annulus and measuring pressure to verify that fluid is not entering the surrounding formation through the sleeve valve 400*a*.

Advantageously, the steps of steps 1320 to 1332 may not require cycling of the J-slot mechanism and the drag block may essentially be stationary during these steps. The axial extension and contraction allowed by the selector valve 202, the shifting tool 208, the equalization valve 310 and packer 312 may provide that the coiled tubing movement though these steps may not require the J-slot mechanism 212 to cycle. Thus, the J-slot mechanism may remain in the "set for frac" setting throughout fracturing, closing the sleeve valve, and pressure test substages described above. Beneficially, the pressure test may then be performed without requiring the J-slot mechanism to be cycled back around to the "set for frac" setting, which may provide a time saving and cost advantage over prior art systems.

(i) Cycle for Next Fracturing Stage

Optionally, at step 1334, the BHA 200 may be moved to the next target sleeve valve in preparation for the next fracturing stage. This may include POOH coiled tubing movement. If the packer 312 is still set (e.g., from the pressure test), the POOH movement will unset the packer 312 to allow movement of the BHA 200 within the casing. The POOH movement of the coiled tubing will cycle to the J-slot mechanism to it's next configuration (which may be referred to as "second POOH setting"). The BHA 200 may, in some embodiments, be moved to the next sleeve valve.

RIH movement may then be performed for positioning the BHA below the next sleeve valve and cycling the J-slot back to the initial "Run in Hole" setting described above with reference to step 1302, and the method 1300 described above may be repeated. Alternatively, if the next sleeve valve is shift-up-to-open, the method 1400 of FIGS. 14A and 14B (discussed below) may be performed.

In the preceding method, the BHA drag block 214 may be axially stationary or effectively anchored in a fixed position in the casing from the time the shift-down-to-open sleeve valve has been shifted open until the tool ready to be cycled and moved to the next sleeve valve. By anchoring the BHA 200 during these steps, coiled tubing travel during be substantially reduced or minimized.

The coiled tubing cycles (RIH and POOH movement) required for a fracturing operation using the BHA 200 may be fewer than other existing/typical systems for downhole sleeve shifting systems. Reducing cycles may save time and therefore decrease cost and increase efficiency of the operations.

Figure 13A:
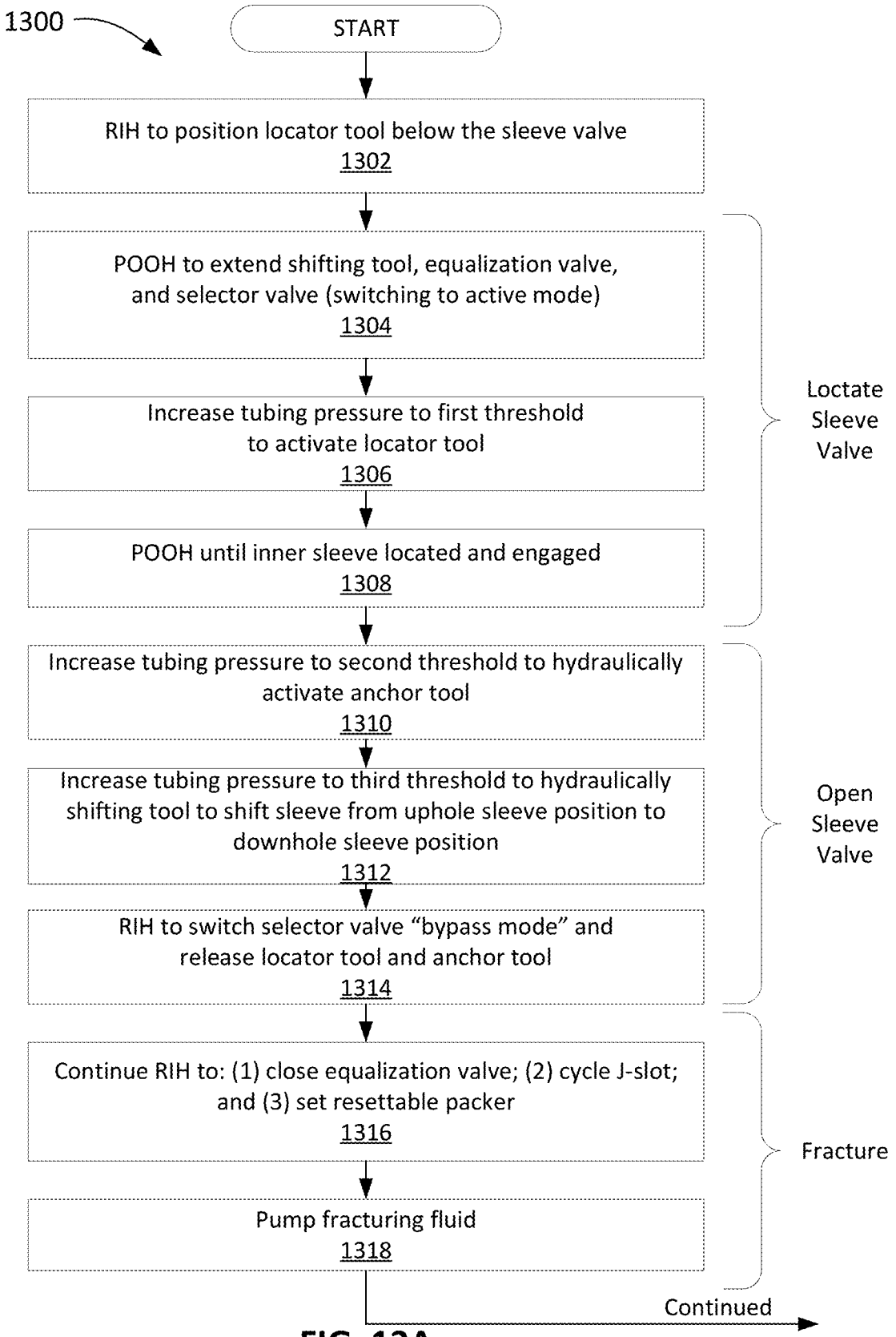
FIGS. 13A and 13B are a flowchart of an example method for performing a fracturing operation using the BHA of FIG. 3 and a shift-down-to-open sleeve valve.
Figure 13B:
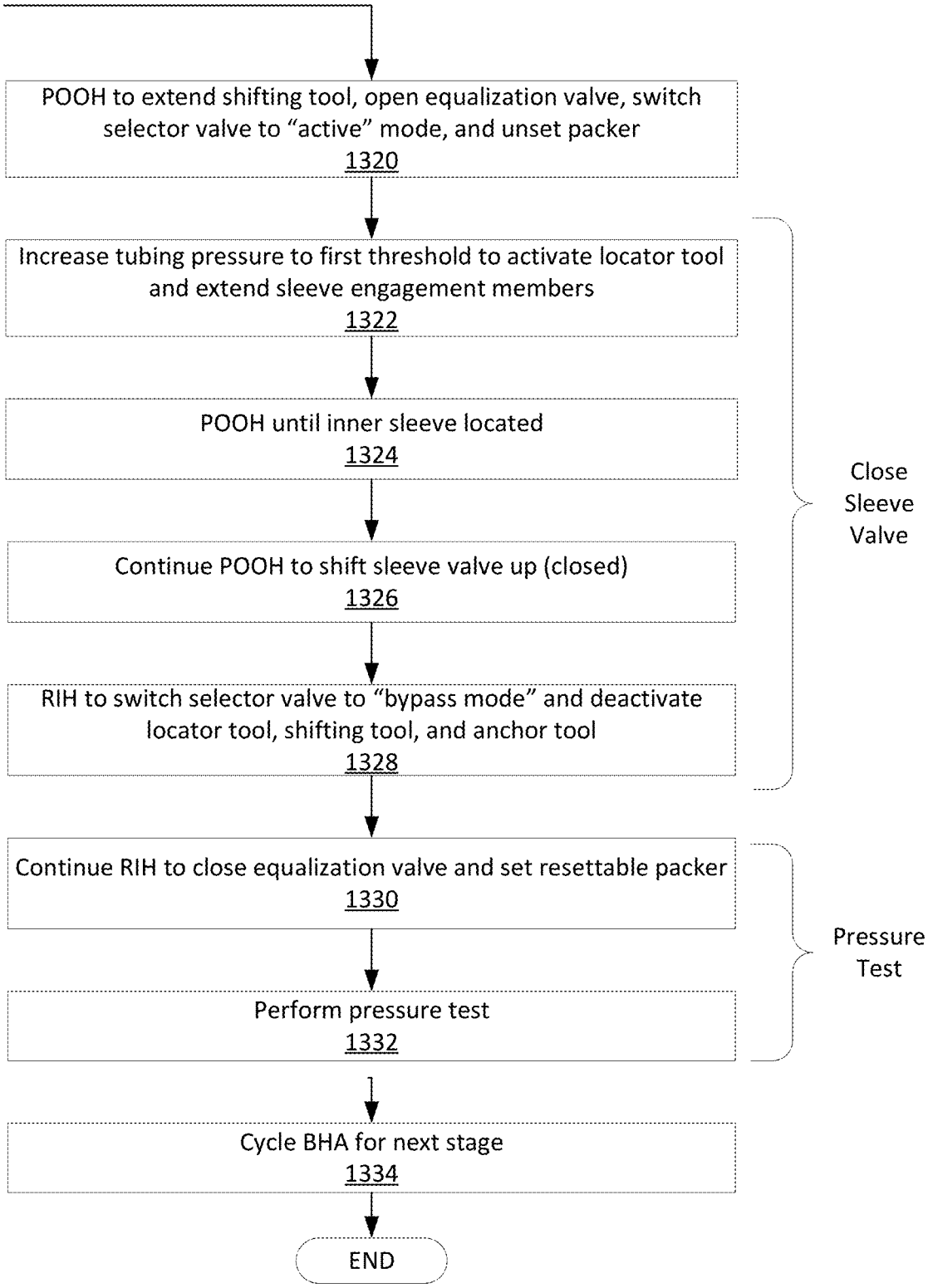
Figure 13C:
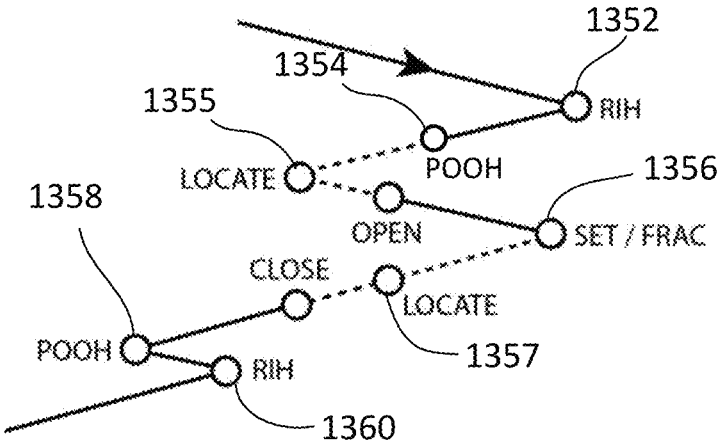
FIG. 13C is a diagram illustrating cycling of the BHA through the method of FIGS. 13A and 13B.

FIG. 13C is a diagram illustrating cycling of the BHA 200 through the method 1300 of FIGS. 13A and 13B discussed above. In FIG. 13C, stippled lines represent portions of the process during which fluid flow activates one or more components of the shifting assembly 205 of the BHA 200. FIG. 13C also illustrates where in the process the J-slot mechanism 212 is cycled through the RIH setting 1352, the first POOH setting 1354, the Set/FRAC setting 1356, and the second POOH setting 1358 described above. The sleeve valve is located, to be opened, at LOCATE node 1355, which corresponds to step 1308 discussed above. After locating the sleeve valve (node 1355), the sleeve valve is opened by hydraulically activating the shifting assembly 205 as discussed above, which pulls down the locator tool 204 and other components above the shifting tool 208. After the fracturing substage, the sleeve valve is located, to be closed, at LOCATE node 1357. The subsequent RIH setting 1360 represents the cycle starting over for the next sleeve valve and fracturing state.

The number of coiled tubing cycles and/or distance of the coiled tubing travel required during a fracturing stage performed using the BHA 200 may be less than typical prior art systems for downhole sleeve shifting systems. Reducing such cycles may save time and decrease cost and increase efficiency of the operations.

An example method for performing a fracturing stage using the BHA 200 of FIG. 3 and a shift-up-to-open sleeve valve will now be described with reference to FIGS. 14A and 14B. In this example, the process will be described with reference to the example sleeve valve 400*b* in FIGS. 4C and 4D, but embodiments are not limited to this specific example.

(a) RIH Below Sleeve Valve

At step 1402, the BHA 200 is run downhole by RIH coiled tubing movement to a position in which the locator tool 204 is downhole of the target sleeve valve 400*b* to be opened (similar to step 1302 in FIGS. 13A and 13B). The initial RIH movement for positioning the locator tool 204 may cycle the J-slot mechanism to the "Run in Hole" setting that disables setting of the packer 312. Thus, the RIH movement of the BHA 200 in this substage does not set the packer 312 in the casing.

(b) Locate Sleeve Valve

The sleeve valve 400*b* is then located, similar to steps 1304 to 1308 of FIG. 13. That is, at step 1404, POOH movement of the coiled tubing is applied that mechanically extends the shifting tool 208, opens the equalization valve 310, and extends the selector valve 202, thereby activating its "active" mode of operation. At step 1406, the locator tool 204 is activated by increasing the tubing fluid pressure to meet or exceed the first pressure threshold, to extend the sleeve engagement members 702. At step 1408, the BHA 200 is pulled uphole (POOH movement of the BHA) until the inner sleeve 410 is located and engaged by the sleeve engagement members 702. The POOH movement of steps 1404 and/or 1408 also cycles the J-slot mechanism to it's next position, which may be referred to as "first POOH position" setting herein. The J-slot mechanism may not be cycled again until step 1414 below.

(c) Open Sleeve Valve

At step 1410, further POOH movement may be applied to up-shift the inner sleeve 410 to the opened position, thereby closing the sleeve valve.

At step 1412, the locator tool 204 is released from the sleeve valve by applying RIH movement of the coiled tubing to switch the selector valve back to "bypass" mode, or alternatively by decreasing pressure in the BHA 200 below the first pressure threshold.

(d) Set Isolation Tool

At step 1414, further RIH movement is applied by the coiled tubing to cycle the J-slot mechanism to the "Set/Frac" or "Set for Frac" setting, close the equalization valve, and set the resettable packer 312. In the "Set/Frac" setting of the J-slot mechanism, the resettable packer 312 is enabled for being set to stop fluid flow in the annulus (for example, as described in U.S. Pat. No. 10,605,061). The further RIH movement of the coiled tubing also mechanically collapses the shifting tool 208 in this embodiment.

(e) Fracture

At step 1416, fracturing fluid is pumped downhole to fracture an earth formation in the region of the sleeve valve 400*a*. The fracturing fluid may be pumped into the annulus and enter the formation via the ports 408 in the opened sleeve valve 400*b* (similar to step 1318 of FIGS. 13A and 13B).

(f) Release Packer

At step 1418, the coiled tubing is again cycled with POOH movement, and the tension on the BHA may extend the selector valve 202 to switch it back to "active" mode of operation and open the equalization valve 310. The POOH movement also unsets the packer 312 of the isolation tool 210 after the equalization valve 310 has been opened.

If the sleeve valve is to be left open after the fracturing substage, then the method may skip steps 1420 to 1432 discussed below and instead continue to step 1434.

(g) Close Sleeve Valve

Optionally, after the fracturing is complete the sleeve valve 400*b* may be closed. More specifically, at step 1420, the locator tool 204 is hydraulically activated to extend the sleeve engagement members 702. Then at step 1422, the locator tool is pulled uphole (by POOH movement of the coiled tubing) to until the sleeve valve is located (i.e., the the sleeve engagement members 702 engage and locate the inner sleeve 410). At step 1424, the anchor tool 206 is hydraulically activated by setting fluid pressure within the BHA 200 at or above the second threshold. At step 1426, the shifting tool 208 is hydraulically activated by setting the fluid pressure at or above the third threshold to shift the inner sleeve 410 sleeve from uphole position to downhole position, thereby closing the sleeve valve 400*b*. At step 1428, the locator tool 204 is released from the sleeve valve 400*b* by appling RIH movement of the coiled tubing to switch the selector valve back to "bypass" mode, or alternatively by decreasing pressure in the BHA 200 below the first pressure threshold.

(h) Pressure Test

Optionally, a pressure test may be performed to verify the sleeve valve 400*b* is closed. If no pressure test is to be performed, then method may skip steps 1430 and 1432 discussed below and move to step 1434. At step 1430, RIH movement of the coiled tubing may again be applied to close the equalization valve 310, and re-set the resettable packer 312. At step 1432, the pressure test may be performed to verify the sleeve valve 400*b* is closed.

Advantageously, the steps of steps 1418 to 1432 may not require cycling of the J-slot mechanism and the drag block may essentially be stationary during these steps, similar to the method 1300 of FIG. 13.

(i) Cycle for Next Fracturing Stage

Optionally, at step 1434, the BHA 200 may be moved to the next target sleeve valve in preparation for the next fracturing stage. This may include POOH coiled tubing movement. If the packer 312 is still set (e.g., from the pressure test), the POOH movement will unset the packer 312 to allow movement of the BHA 200 within the casing. The POOH movement of the coiled tubing will cycle to the J-slot mechanism to it's next position (which may be referred to as "second POOH setting"). The BHA 200 may, in some embodiments, be moved to the next sleeve valve.

RIH movement may be performed for positioning the BHA below the next sleeve valve and cycling the J-slot back to the initial "run in hole" setting described above with reference to step 1402, and the method 1400 described above may be repeated. Alternatively, if the next sleeve valve is shift-down-to-open, the method 1300 of FIGS. 13A and 13B may be performed.

Figure 14A:
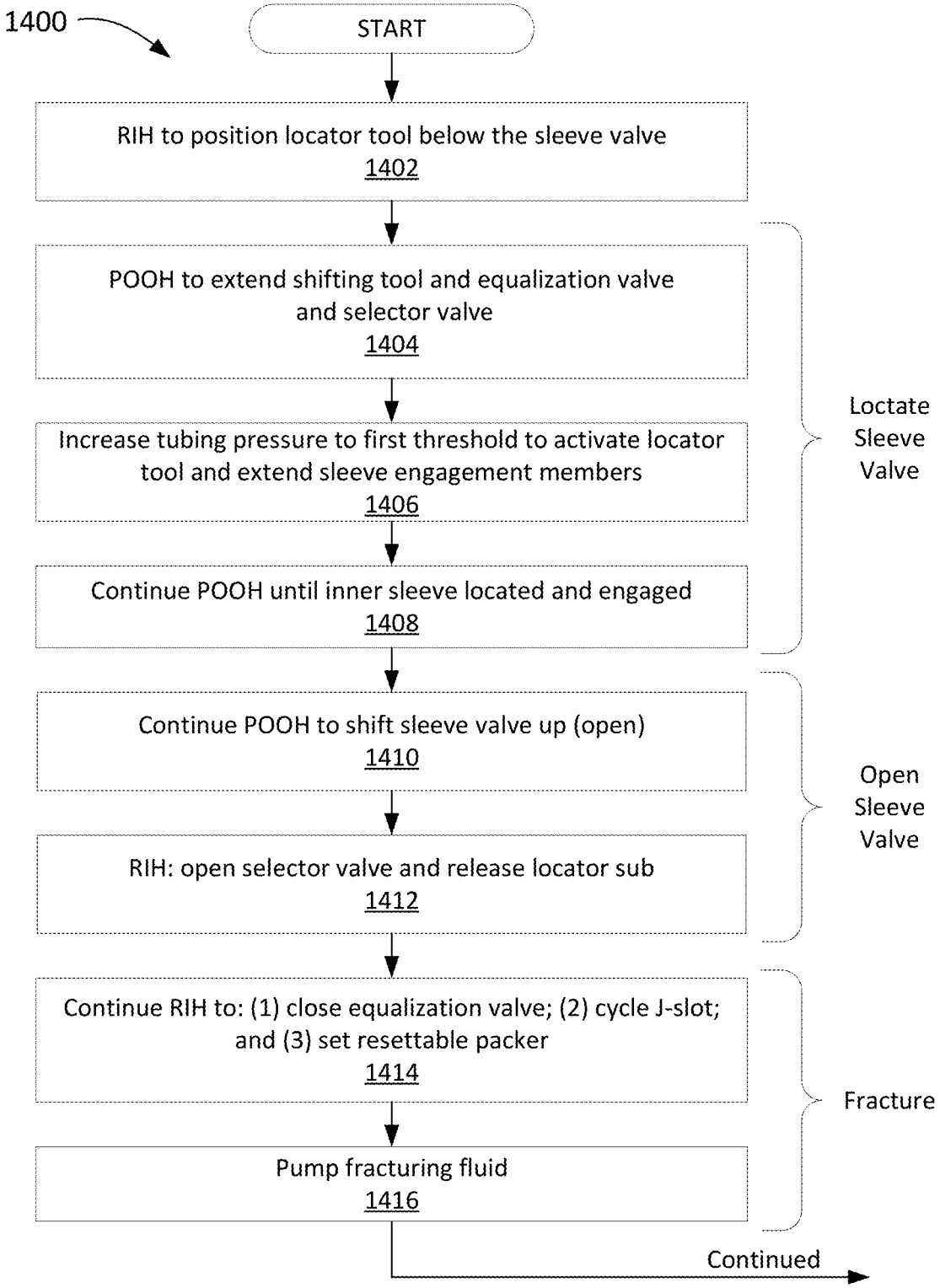
FIGS. 14A and 14B are a flowchart of an example method for performing a fracturing operation using the shifting assembly of FIG. 3 and a shift-up-to-open sleeve valve.
Figure 14B:
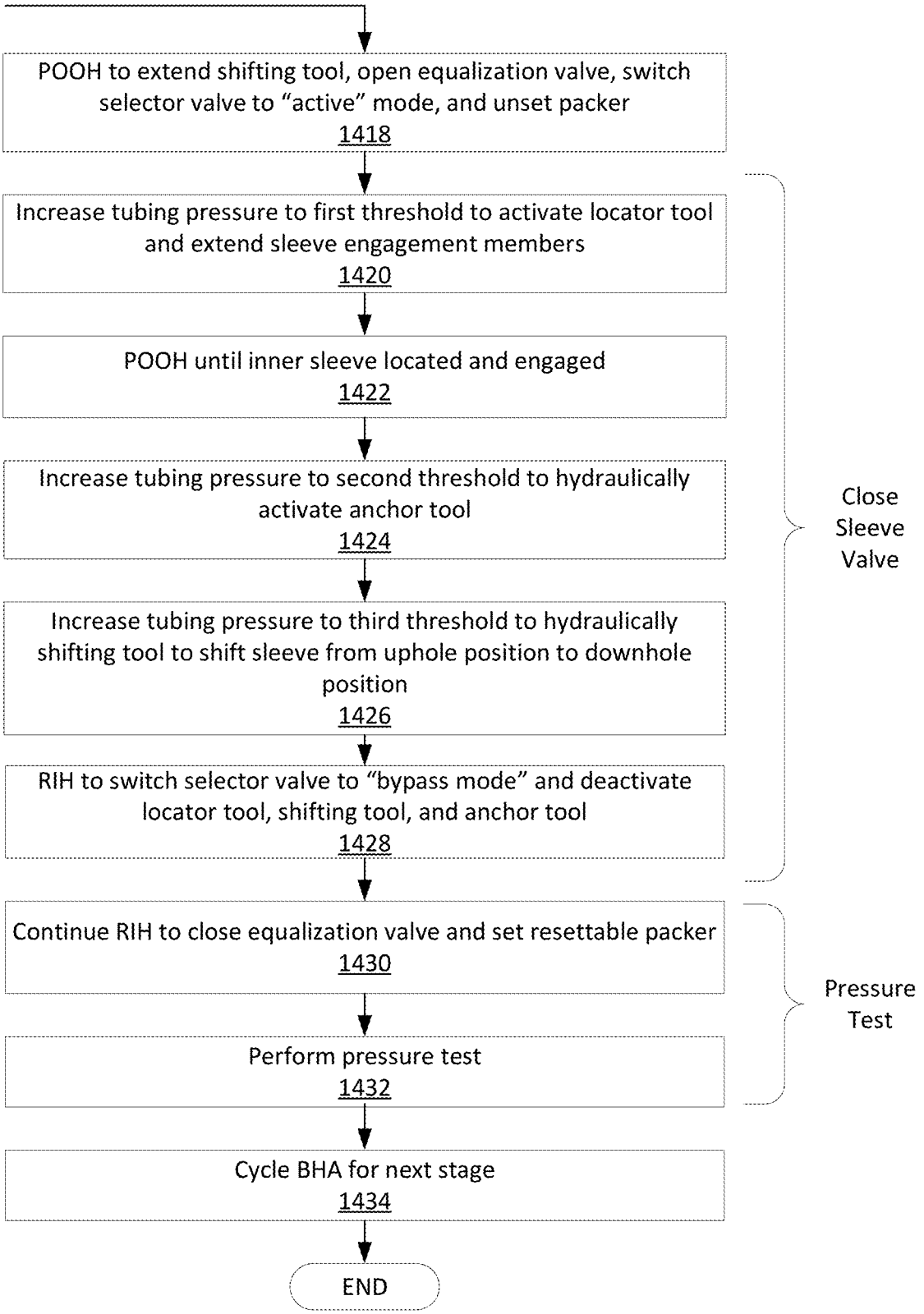
Figure 14C:
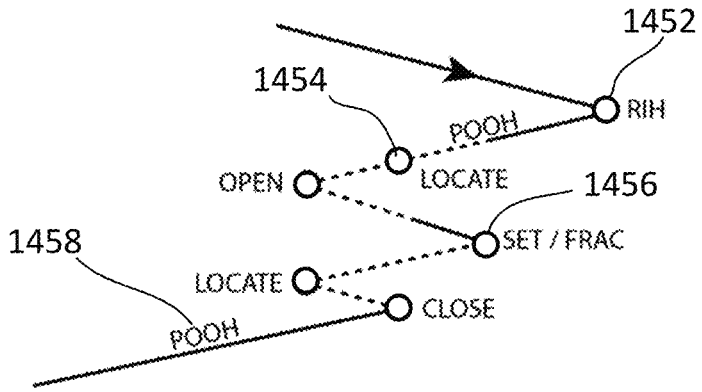
FIG. 14C is a diagram illustrating cycling of the BHA through the method of FIGS. 14A and 14B.

FIG. 14C is a diagram illustrating cycling the BHA 200 through the method of FIGS. 14A and 14B discussed above. In FIG. 14C, stippled lines represent portions of the process during which fluid flow activates one or more components of the shifting assembly 205 of the BHA 200. FIG. 14C also illustrates where in the process the J-slot is cycled through the RIH setting 1452, the first POOH setting 1454, the Set/FRAC setting 1456, and the second POOH setting 1458 described above.

Figure 15A:
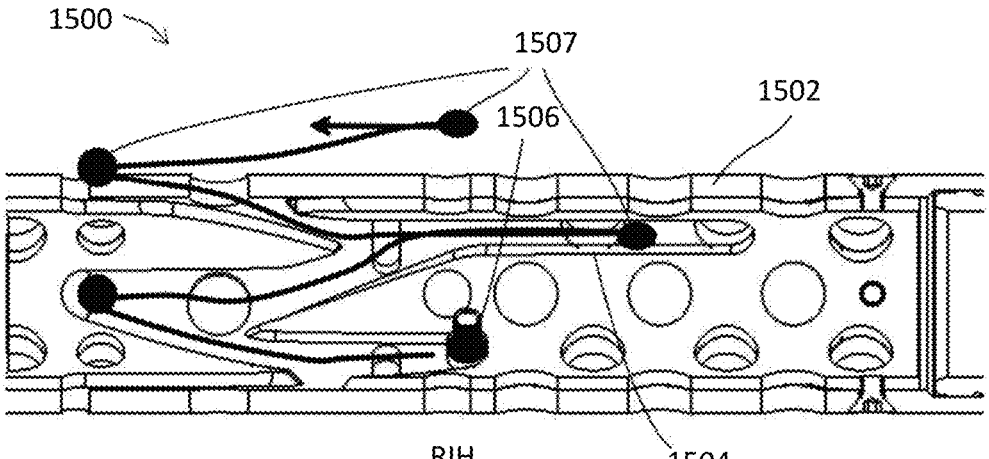
FIG. 15A is a cross sectional illustration of an example J-slot mechanism.
Figure 15B:
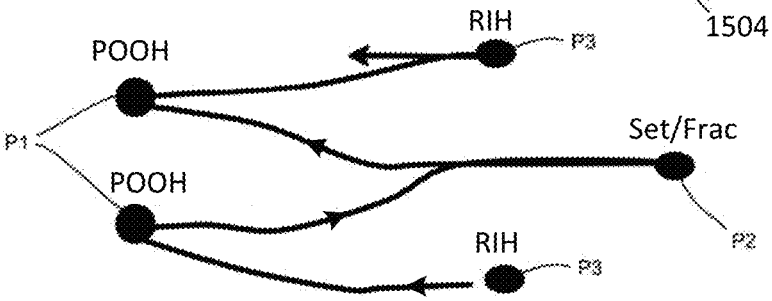
FIG. 15B is a diagram illustrating cycling of the J-slot mechanism of FIG. 15A.

FIGS. 15A and 15B illustrate an example J-slot mechanism 1500 that may be used, for example, as the cycling mechanism 212 of FIGS. 2 and 3. Embodiments are not limited to this particular design. FIG. 15A shows a J-slot shift housing 1502 that defines a J-slot guide profile 1504 therein. A J-slot slider (such as described in U.S. Pat. No. 10,605,061) may include a peg 1506 that cooperates with and slide within the J-slot guide profile 1504 to move between a plurality of peg positions 1507. The peg positions 1507 are distributed between three axial positions (P1, P2, P3), which correspond to the POOH settings, the Set/Frac setting, and the RIH setting respectively. The peg 1506 cycles by uphole coiled tubing movement and downhole coiled tubing movement through the following settings or axial positions of the peg 1506: starting from P3 (RIH), the peg 1506 is cycled to P1 (first POOH setting), then cycled to P2 (Set/Frac), then cycled to P1 (second POOH setting) and then cycled back to P3 (RIH). A resettable packer coupled to the J-slot mechanism 1500 may be disabled from being set by RIH movement when the J-slot mechanism 1500 is in the RIH setting. See U.S. Pat. No. 10,605,061, for more details of an example packer and J-slot mechanism and methods of use with a resettable packer.

In some embodiments, the BHA 200 may further include an additional isolation mechanism uphole of the locator tool 204 for isolating the wellbore above the target sleeve valve. Thus, the wellbore may be isolated both above and below the sleeve valve during fracturing operations.

As one example, the additional isolation mechanism may comprise an additional anchor tool (not shown) and a top cup (not shown), although alternate isolation means may also be used. The additional anchor tool and top cup may, for example, be located uphole of the selector valve such that flow and/or pressure within the anchor sub may be maintained even when the selector valve 202 is in "bypass mode" during the fracturing substage. The anchor tool may be activated and the top cup energized during the fracturing substage while the packer downhole of the sleeve is activated. The top cup may prevent uphole movement of fluid. Fracturing fluid may thereby be prevented from leaving an isolation zone between the top cup and packer 312, except through the sleeve valve into the surrounding formation via fracturing.

In another alternative embodiment, the shifting assembly 205 may be used without the isolation tool 210, cycling mechanism 212, or drag block for a fracturing operation. For example, the shifting assembly 205 may open a target sleeve valve with other sleeve valves in the well closed. Fracturing may be performed through the opened sleeve valve alone, without setting a packer or other isolation tool. Fluid may be pumped right to the end of the well for the fracturing process. Then, the shifting assembly 205 may be used to close that sleeve valve and move on to repeat the process at a next target sleeve valve, and so on.

As noted above, the hydraulic locator 304 may be used without other components of the BHA 200, simply for up-shifting sleeve valves. This may be particularly useful where casing has been deformed or the casing otherwise has a narrow inner diameter, where the hydraulic locator 304 may be easier to run in hole than other typical components of the BHA (e.g. drag block). Furthermore, if the bottom end of the hydraulic locator is stopped or provided with a flow restriction, it may be activatable without use of an activation valve.

In some embodiments, a downhole assembly may simply comprise the hydraulically actuated locator tool described herein connected to coiled tubing. The locator tool may be run downhole to engage and open a shift-up-to-open sleeve valve or close a shift-down-to-open sleeve valve, since this action merely requires locating/engaging the inner sleeve and pulling uphole using the coiled tubing. The locator tool Additional exemplary BHA embodiments are described below, and embodiments are also not limited to those specific combinations and arrangements of components described.

As yet another option, a selector valve (such as the selector valve 202 in FIG. 3) may initially be releasably locked in the "active" (extended) configuration. The locking may be implemented by a releasable locking mechanism, such as a shear pin. The selector valve 202 may by secured in the "active" mode while it is run-in-hole to a toe of the well. This may allow fluid to be circulated through to a downhole end of the BHA to run to the toe of the well. When desired (e.g. when the BHA reaches the toe of the well), the locking mechanism may be released such that the selector valve may function normally for extension/contraction to switch between active and bypass modes. In the shear pin example, tension may be applied to shear the pin. Other components of the BHA may also have releasably locked initial states using similar methods.

As noted herein, embodiments are not limited to the BHA 200 shown in FIG. 2. For example, rather than being pressure-activated, one or more of the locator tool, shifting tool, and anchor tool may be flow activated or mechanically activated. A combination of pressure, flow, and mechanically activated components may be used. As another example, rather than the resettable packer shown in FIG. 2, other suitable wellbore isolation means may be used in other embodiments.

As yet another example, in some embodiments, a selector valve may not be located above the locator tool. For example, a selector valve may be located below the locator tool or other components of the shifting assembly. The valve may be a Flow Activated Valve "FAV". A FAV may be configured for multiple modes of operation, where the modes of operation are selectable by the flow rate of fluid entering the FAV from uphole. The modes may include: (1) fluid flow through the FAV inner fluid passageway (i.e., fluid longitudinally through the interior of the FAV); (2) fluid discharge into the annulus; and optionally (3) fluid both through the FAV and discharge into the annulus. The FAV valve may have an internal cycling mechanism (e.g., J-slot mechanism) that operates by cycling fluid flow thru the tool. Cycling fluid flow allows the FAV valve to switch to different modes 1, 2 or 3. When the FAV valve is in the BHA string its cycling mechanism is operated by varying the fluid flow. The BHA may also include a relief valve 1608 remains closed until fluid pressure within the FAV exceeds a second pressure threshold, at which point the relief valve opens to allow fluid to discharge from within the FAV to the annulus. The second pressure threshold for activating the relief valve may be higher than the first pressure threshold for activating the locator tool in this example.

In yet another alternative embodiment, the shifting tool may comprise a shift-assist element that expands in the annulus between the shifting tool and the casing in some embodiments (similar to a resettable packer, but not anchoring the shifting tool to the casing). The shift-assist element may be compressed by RIH movement of the coiled tubing such that the shift-assist element radially expands within the annulus between the BHA and the casing (or wellbore wall). With the shift-assist element expanded and the slidable sleeve engaged by the locator sub, fluid pressure may be applied to the annulus to move the shifting tool downhole and thereby shift the inner sleeve to a downhole position. The downhole position of the slidable sleeve may be opened or closed depending on whether the sleeve valve is configured for shift-down-to-open or shift-down-to-open operation.

Figure 16A:
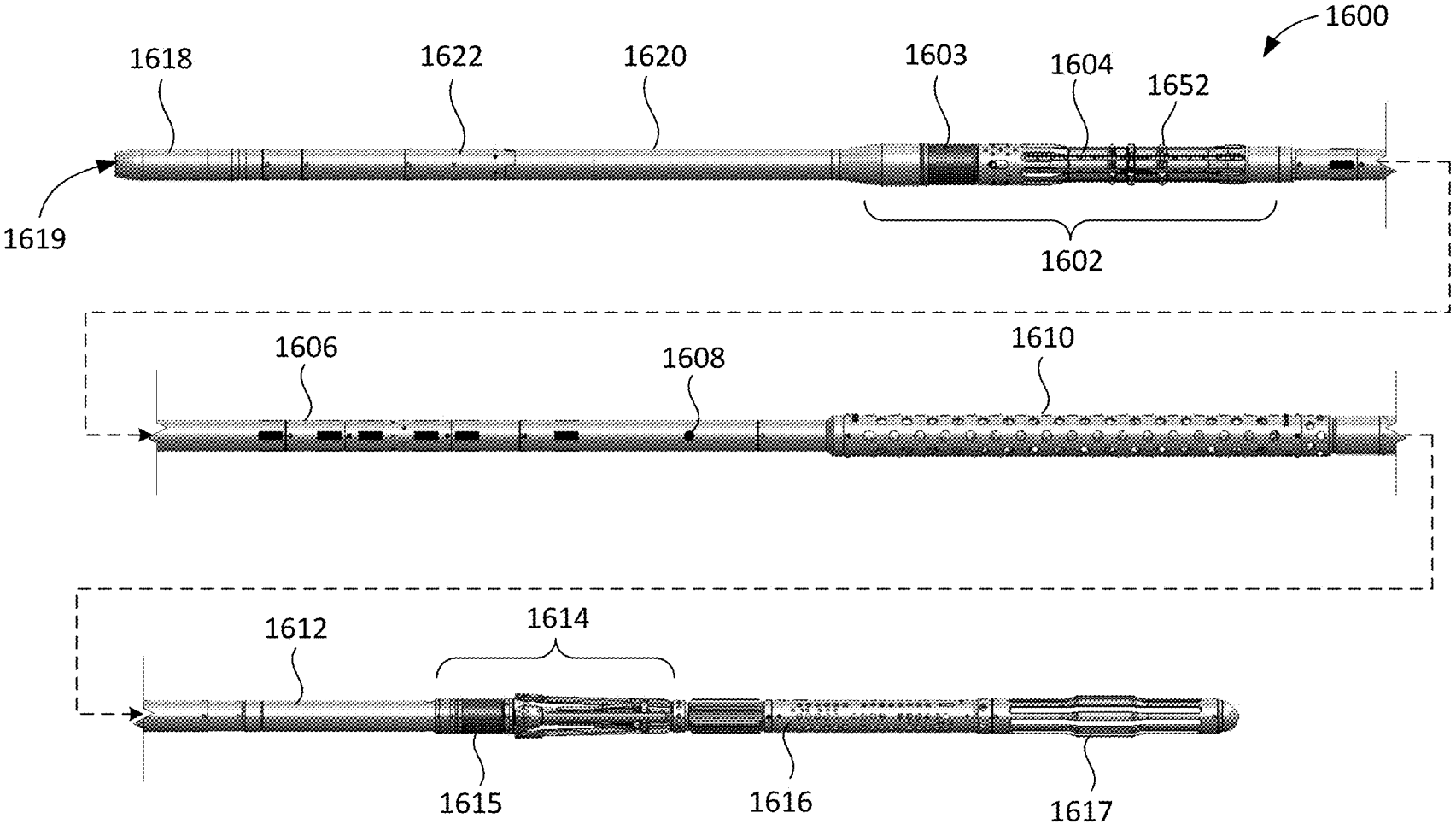
FIG. 16A is a side view of another example BHA according to some embodiments.

FIG. 16A is a side view of another example BHA 1600 according to some embodiments. The BHA 1600 may allow for fracturing stages to be performed using fewer strokes than conventional sleeve valve systems. The BHA may be used for opening and closing both shift-up-to-open and shift-down-to-open sleeve valves.

The BHA 1600 in this embodiment includes: a shifting assembly 1602 including an expandable/retractable shift-assist element 1603 and a locator tool 1604 downhole of the shift-assist element 1603; a fluid activated valve (FAV) 1606 including a relieve valve 1608 located downhole of the locator tool 1604; a slack sub 1610 downhole of the FAV 1606; a relief or interval bypass 1612; and a wellbore isolation tool 1614; a J-slot mechanism 1616; and a drag block 1617. The wellbore isolation tool 1614 in this example comprises a resettable packer 1615. However, any suitable isolation tool for fracturing operations may be used. In other embodiments, for example, the resettable packer 1615 may be provided without the remainder of the example isolation tool 1614 shown.

The BHA 1600 in this example further includes a coil connector 1618 at the uphold end 1619 of the BHA 1600 for connecting the BHA 1600 to coiled tubing (not shown). Optional disconnect 1622 is also included intermediate the shifting assembly 1602 and the coil connector 1618. FIG. 4 also shows optional guide section 1620, which may house electronics and other equipment and will be discussed below. FIG. 15A is an enlarged cross-sectional partial view of the BHA 1600 showing the coil connector, disconnect 1622 and guide 1620. One or more of components of the BHA 200 may be omitted or rearranged in other embodiments.

Figure 16B:
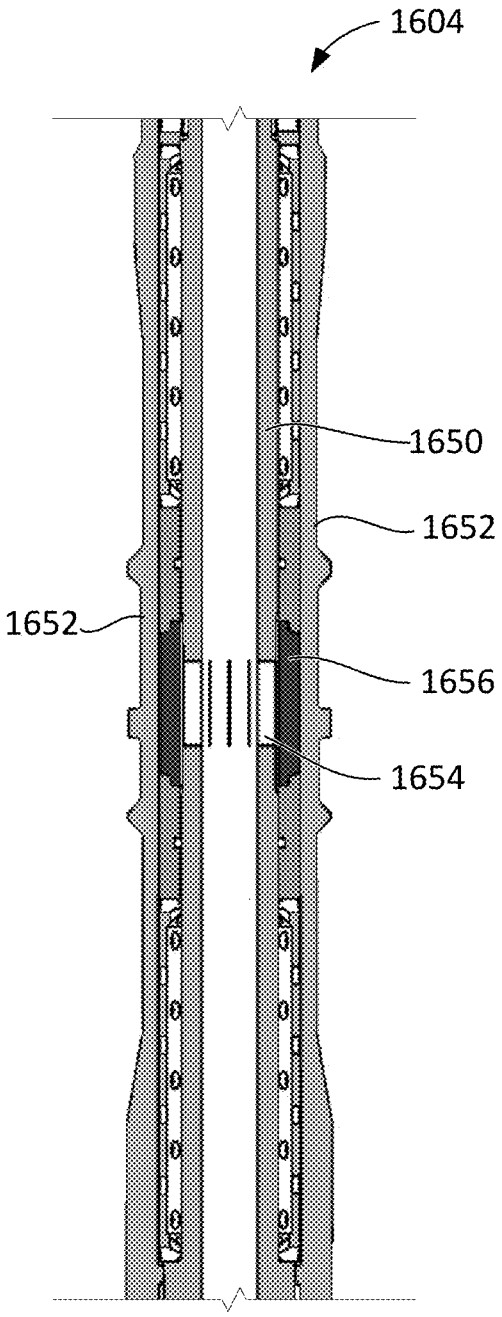
FIG. 16B is an enlarged cross-sectional partial view of a locator tool of the BHA of FIG. 16A.

FIG. 16B is an enlarged cross-sectional partial view of the locator tool 1604. The locator tool 1604 includes sleeve engagement members 1652 that are hydraulically actuatable to move from a retracted configuration to an extended configuration. The sleeve engagement members 1652 have an outward profile that may engage and become axially secured with an inner sleeve of a sleeve valve having a corresponding inner profile. Fluid pressure within the locator tool 1604 above a first pressure threshold may deflect sleeve engaging elements 1652 radially outward to the extended position for engaging an inner profile of a shiftable sleeve of a sleeve valve. Pressure falling below the threshold may causes the sleeve engaging elements 1652 to retract to the retracted position shown in FIG. 16B. In this example, the locator tool 1604 includes an internal tubular mandrel 1650 that runs axially through the locator tool 1604 and defines a flow path therethrough. Flow ports 1654 extend through the inner mandrel 1650 to undersides of inflatable elements 1656. Fluid pressure or fluid flow above the threshold inflates the inflatable elements 1656 to radially push out the sleeve engaging elements 1652.

The shift-assist element 1603 is a compressible ring (similar to a packer ring) that may be compressed by RIH movement of the coiled tubing such that the shift-assist element 1603 radially expands within the annulus between the BHA 1600 and the casing (or wellbore wall). With the shift-assist element 1603 expanded and the slidable sleeve engaged by the locator tool 1604, fluid pressure may be applied to the annulus to move the BHA downhole and thereby shift the inner sleeve to a downhole position. The downhole position of the slidable sleeve may be opened or closed depending on whether the sleeve valve is configured for shift-down-to-open or shift-down-to-open operation.

The FAV 1606 may be controllable by fluid flow (rate and/or pressure) to switch or cycle between multiple modes of operation including, but not limited to: (1) fluid flow through the FAV inner fluid passageway (i.e., fluid longitudinally through the interior of the FAV); (2) fluid discharge into the annulus.

The relief valve 1608 may be configured to remain closed until fluid pressure within the FAV exceeds a second pressure threshold, at which point the relief valve 1608 may open to allow fluid to discharge from within the FAV 1606 to the annulus. The second pressure threshold for activating the relief valve 1608 may be higher than the first pressure threshold for activating the locator tool 1604 in this example.

The slack sub 1610 may, for example, be similar to the slack sub embodiments shown and described in U.S. Pat. No. 11,346,169, titled "Sleeve Valves, Shifting Tools and Methods for Wellbore Completion Operations Therewith," the entire contents of which are incorporated herein by reference. The slack sub 1610 is movable between an axially expanded configuration (not shown) and an axially contracted position shown in FIG. 16. POOH movement of the coiled tubing may create axial tension that expands the slack sub 1610, while RIH movement of the coiled tubing may contract the slack sub 1610.

The wellbore isolation tool 1614 in this example is shown in the form similar to the tool described in U.S. Pat. No. 11,365,606 titled "Downhole Sleeve Assembly and Sleeve Actuator Therefor," the entire contents of which are incorporated herein by reference. However, the J-slot mechanism 1616 in this example may be configured for the coiled tubing cycles and operation substages described herein.

Example operation of the BHA 1600 of this example will now be described. For shift-down-to-open sleeve valves, the following process may be followed. Initially, the BHA 1600 may be run downhole (i.e., RIH movement) to a position in which the locator tool 1604 is expected to be downhole of the selected sleeve valve to be opened. As in the examples described above, cycling the coiled tubing (i.e., switching between RIH and POOH movement) over a sufficient distance may cycle the J-slot mechanism between settings so that the packer 1615 of the isolation tool 1614 is only set by RIH movement at the appropriate substage. For example, in the initial configuration, the J-slot position may correspond to mechanically prevention of contracting of the resettable packer by RIH movement of the BHA, while cycling to the fracturing substage (c) below may move the J-slot to a position that mechanically unlocks the resettable packer to allow it to be contracted and set by RIH movement.

(a) Locate Sleeve Valve

When the locator tool 1604 is expected to be downhole of the selected sleeve valve to be opened, the locate mode may be activated by POOH movement of the coil tubing and by increasing pressure within the BHA via the coiled tubing to or above the first pressure threshold (but below the second pressure threshold). This pressure increase causes the sleeve engaging elements 1652 to radially expand for locating the slidable sleeve. POOH movement pulls the locator tool 1604 in the uphole direction until the sleeve engaging elements 1652 engage the inner sleeve of the sleeve valve (not shown). The complimentary and matching profiles of the inner sleeve and the sleeve engaging elements 1652 may allow the sleeve elements to further extend to engage and become axially secured with the inner sleeve. The inner sleeve may thereby become "located".

The POOH movement of the coiled tubing may also axially extend the slack sub 1610 to the extended configuration. Once the sleeve valve is located, the drag block 1617 may remain substantially in the same position through the remaining substages (b) to (d) described below.

(b) Open Sleeve Valve

For the shift-down-to-open sleeve valve configuration, the coiled tubing is again lowered for RIH movement. The RIH movement may compress the shift-assist element 1603. If the RIH movement of the coiled tubing is insufficient on its own to shift the slidable sleeve downward, then pressure in the annulus may be applied to push the expanded shift-assist element downhole, thereby pushing the locator tool 1604 downhole and shifting the slidable sleeve downward to open the sleeve valve.

(c) Fracture

For the fracturing substage, pressure may then increased above the second pressure threshold, thereby triggering the relief valve 1608 of the FAV 1606. The relief valve 1608 opens and discharges the pressure within the FAV and locator tool 1604, and the sleeve engaging elements 1652 of the locator tool 1604 thus contract radially and release from the slidable sleeve.

The coiled tubing may then be further lowered (RIH) until the slack sub is fully axially contracted, which is detectable at surface. The distance that the slack sub is able to expand/contract may thus, determine the position of the locator tool 1604 and guide section 1620 relative to the sleeve valve.

Further RIH movement combined with the drag provided by the drag block 1614 sets the resettable packer 1615 against the casing (or borehole wall) at a position downhole of the sleeve valve.

Fracturing fluid may now be pumped downhole to fracture an earth formation in the region of the sleeve valve. The fracturing fluid may enter the formation via ports in the opened sleeve valve.

(d) Close Sleeve Valve

Closing the sleeve may now be accomplished by uphole (POOH) movement of the BHA 1600 by pulling the coiled tubing uphole and pressurizing the locator tool 1604 above the first pressure threshold (similar to locate mode). When the slidable sleeve of the sleeve valve is engaged by the locator tool 1604, further POOH movement may shift the sleeve valve to the closed position.

At this point, the locator tool 1604 is axially stopped from further uphole movement by the inner sleeve, which may be detectable at surface, and the locator sub 1404 may be released from the sleeve valve by relieving pressure below the first pressure threshold.

Figure 17A:
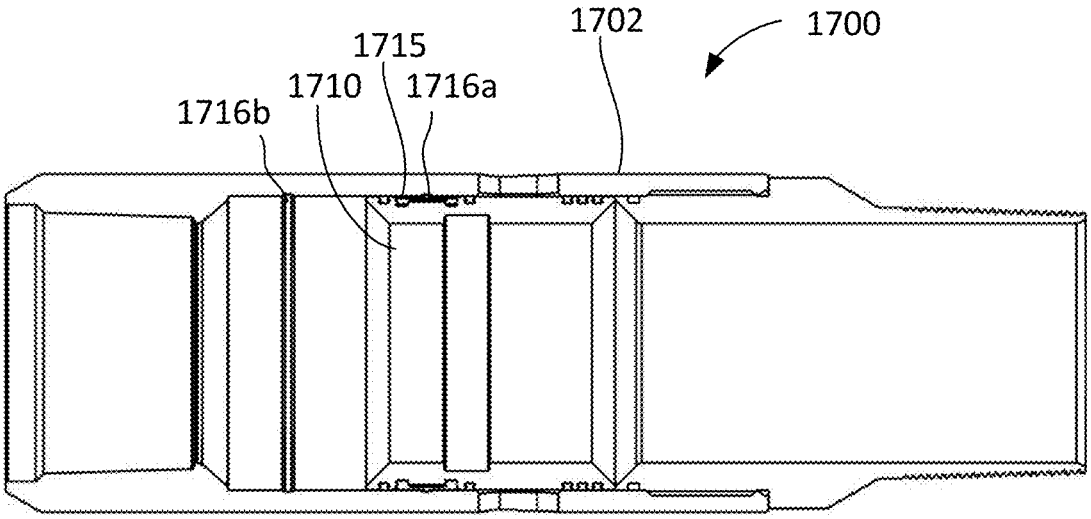
FIGS. 17A and 17B are side cross-sectional views of another example shift-up-to-open example sleeve valve.
Figure 17B:
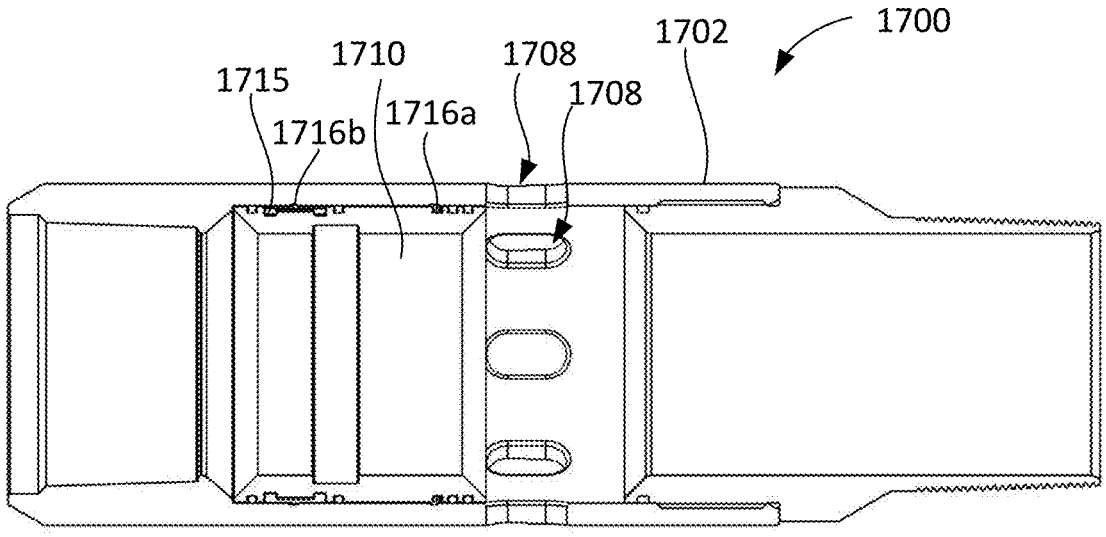

In this example, the BHA 1600 may also be used to operate (open/close) a shift-up-to-open sleeve valve (such as the sleeve valve 1700 having inner sleeve 1710 shown in FIGS. 17A and 17B). For shift-up-to-open operation, the locator tool 1604 may be activated and pulled upward (POOH) to locate the sleeve, and then further POOH movement may open the sleeve. Closing the shift-up-to-open sleeve valve may essentially follow the steps for opening the shift-down-to-open sleeve valve described above. Thus, the BHA 1600 is not limited to the shift-down-to-open sleeve valve fracturing stage operation described above, but may also be used for a shift-up-to-open sleeve valve fracturing stage with the appropriate modifications to the operation procedure.

FIGS. 17A and 17B are side cross-sectional views of an example shift-up-to-open example sleeve valve 1700 that may be used with the BHA 1600 in FIG. 16A. The sleeve valve 1700 includes inner sleeve 1710 within a housing 1702. The housing defines ports 1708 therethrough that are covered or obstructed by the inner sleeve 1710 when the inner sleeve 1710 is in the downhole sleeve position (FIG. 17A) and not covered or obstructed when the inner sleeve 1710 is in the uphole sleeve position (FIG. 17B). The inner sleeve 1710 is configured to be engaged by the sleeve engagement member 1652 of the locator tool 1604 in FIGS. 16A and 16B.

The sleeve valve 1700 in this example includes a detent mechanism that biases the inner sleeve 1710 to remain in each of the open first sleeve position and the closed first sleeve position. The detent mechanism in this embodiment includes a detent ring 1715 secured about the inner sleeve 1710 and annular detent grooves 1716*a* and 1716*b* defined in the inner surface of the housing.

Figure 18:
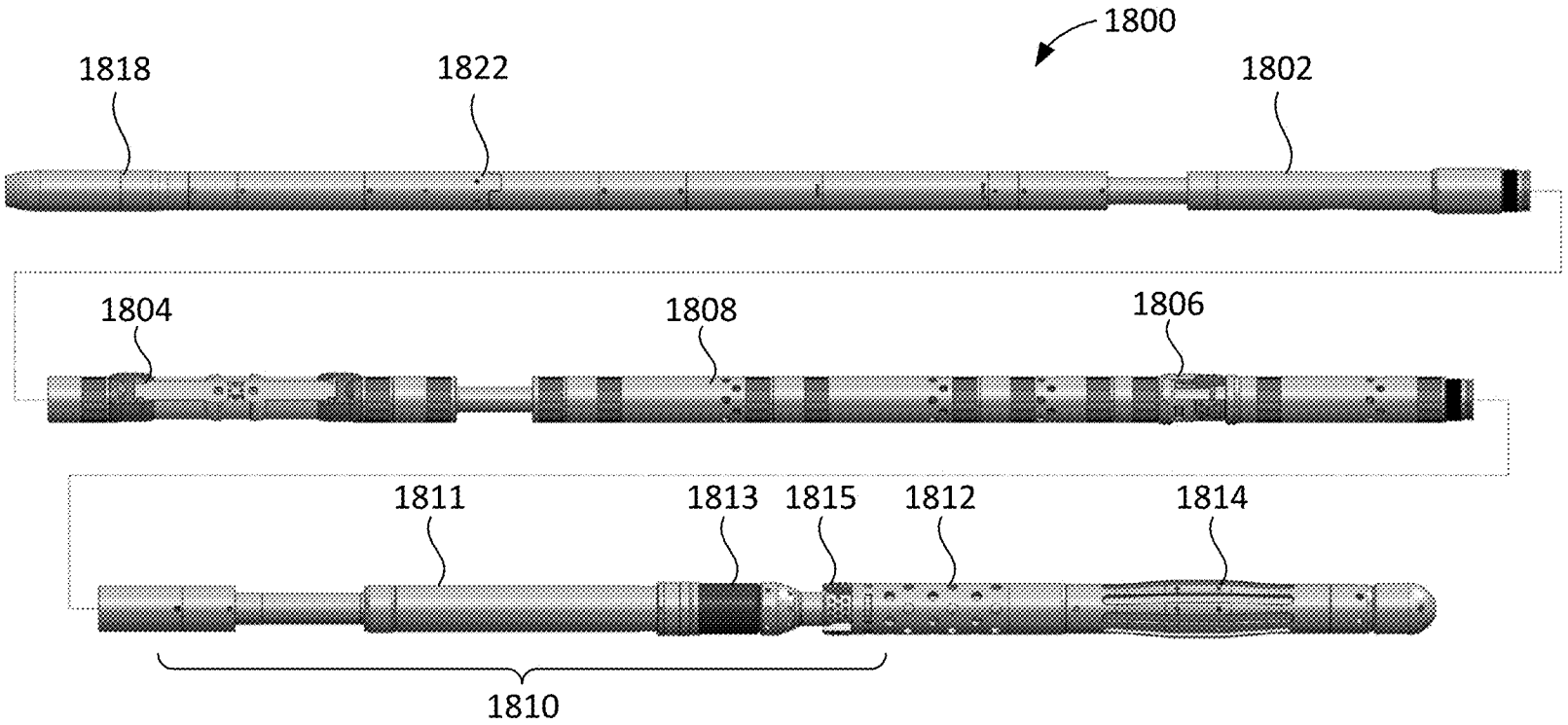
FIG. 18 is an exploded view of yet another example BHA according to some embodiments.

FIG. 18 is an exploded view of yet another example BHA 1800. The BHA 1800 includes a hydraulic shifting assembly controllable to shift a shiftable inner sleeve of a sleeve valve in a casing string. The sleeve valve may, for example, be in the form shown in FIG. 19A or 19B, although embodiments are not limited to that specific configuration.

The shifting assembly in this example includes the locator tool 1804, the anchor tool 1806 and the shifting tool 1808. Fluid pressure and/or flow rate of fluid flowing through the BHA 1800 may be controlled to hydraulically actuate the locator tool 1804, the anchor tool 1806 and the shifting tool 1808. The BHA 1800 in this embodiment optionally further includes: a selector valve 1802 (shown in the extended, "active" mode position); an isolation tool 1810 positioned downhole of the shifting assembly; a cycling mechanism 1812 positioned downhole of the isolation tool 1810; and a drag block 1814 at the downhole end of the BHA 1800. One or more of components of the BHA 1800 may be omitted or rearranged in other embodiments. The BHA 1800 in this example also optionally includes a coil connector 1818, a disconnect mechanism 1822, and/or may include one or more additional components described herein.

The shifting tool 1808 may be similar to the shifting tool 208 of FIG. 3 described above.

The isolation tool 1810 includes an equalization valve 1811 (shown in the extended, open position), a resettable packer 1813 and slips 1815, similar to the isolation tool 210 shown in FIG. 3 and described above.

Figure 19A:
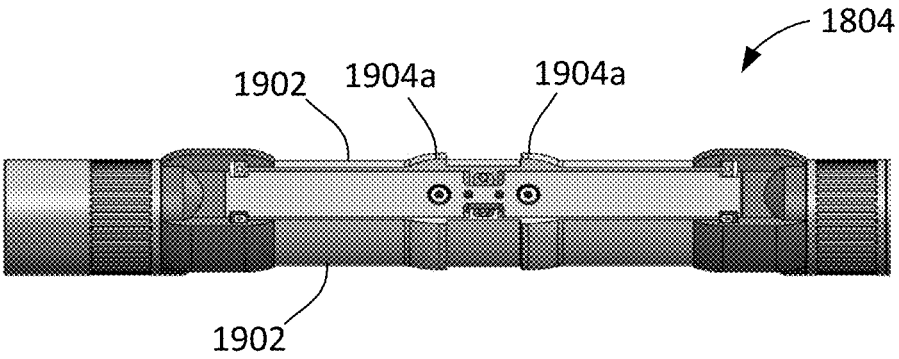
FIGS. 19A and 19B are enlarged partial side view of the BHA of FIG. 18, showing a locator tool in retracted and extended positions.
Figure 19B:
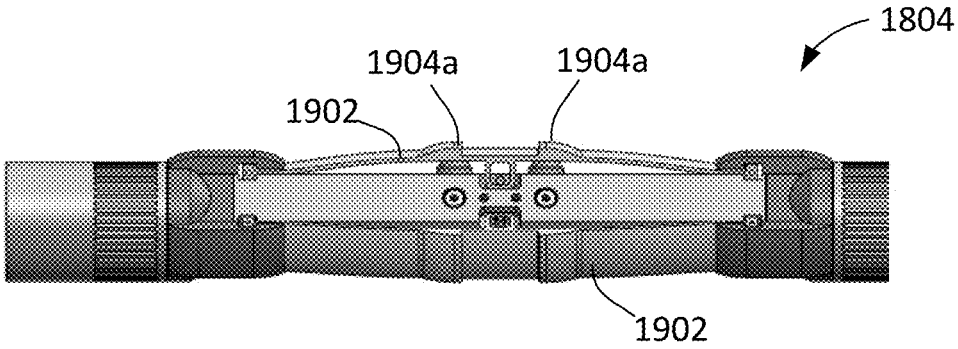

FIGS. 19A and 19B show the example hydraulically activatable locator tool 1804 of FIG. 18 in retracted and extended positions respectively. The locator tool 1804 includes sleeve engagement members 1902 that are extendible and retractable. In this example, the sleeve engagement members 1902 have a profile comprising two axially spaced apart ridges 1904*a* and 1904*b* for engaging an inner sleeve with a complimentary inner sleeve profile. Fluid pressure above a first threshold may cause the sleeve engagement members to radially extend to the configuration shown in FIG. 19B.

Figure 20A:
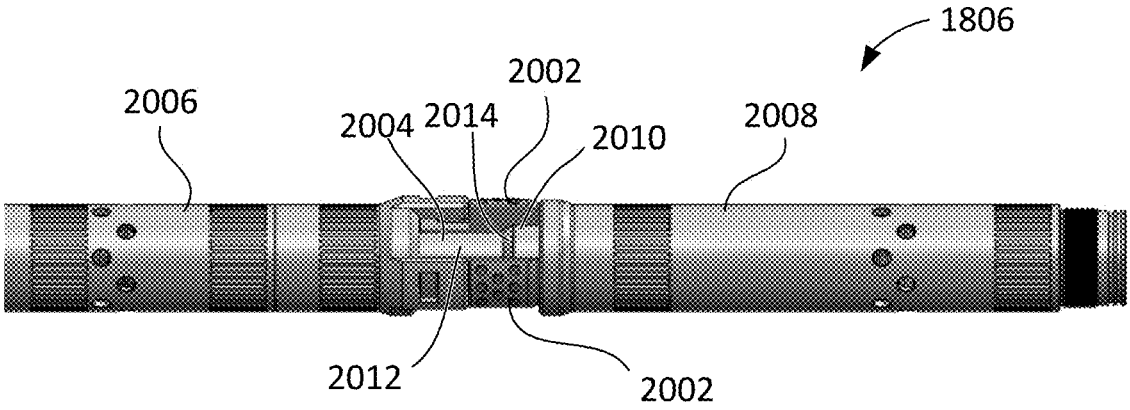
FIGS. 20A and 20B are enlarged side view of an anchor tool of the BHA of FIG. 18 in retracted and extended positions.
Figure 20B:
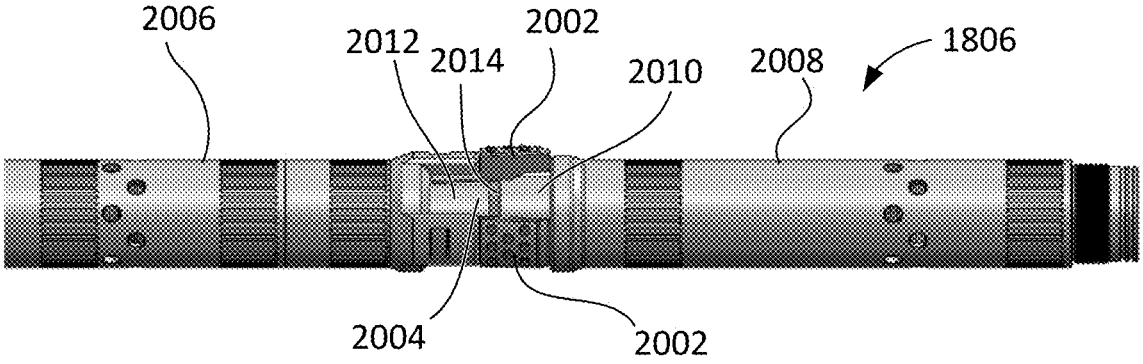

FIGS. 20A and 20B show the anchor tool 1806 of the BHA 1800 of FIG. 18 in retracted and extended positions. The anchor tool 1806 includes anchor elements 2002 that are hydraulically actuatable to move between a retracted configuration shown in FIG. 20A and an extended configuration shown in FIG. 20B. Similar to the example anchor tool 206 of FIG. 2, the anchor elements 2002 extend to engage the casing and axially secure the anchor tool 1806 relative to the casing.

The anchor tool 1806 comprises an inner mandrel 2004, and uphole and downhole housing portions 2006 and 2008 positioned over the mandrel 2004. The anchor elements 2002 are positioned between the uphole and downhole housing portions 2006 and 2008. The inner mandrel 2004 has an enlarged downhole portion 2010 with a larger outer diameter than an uphole portion 2012 of the mandrel 2004. An annular shoulder 2014 is formed between the uphole portion 2012 and the downhole portion 2010 due to the increase in outer diameter. The mandrel 2004 is axially movable, by hydraulic action, relative to the uphole and downhole housing portions 2006 and 2008 and the anchor elements 2002. The anchor tool 1806 may, for example, include internal hydraulic cylinders (not shown) to generate the hydraulic movement.

When an internal pressure within the anchor tool 1806 is below a threshold, mandrel is in a downhole shifted position (relative to the uphole and downhole housing portions 2006 and 2008) shown in FIG. 20A. In this position, the anchor elements 2002 lay in the radially retracted configuration over the mandrel 2004. When the internal pressure exceeds the threshold, the mandrel 2004 may be pushed in the uphole direction relative to the uphole and downhole housing portions 2006 and 2008, to the uphole shifted position shown in FIG. 20B. In moving to this position, the annular shoulder 2014 and downhole portion 2010 of the mandrel push the anchor elements 2002 radially outward to the extended configuration shown in FIG. 20B. The mandrel 2004 may be biased to return to the configuration of FIG. 20A when pressure falls below the threshold. The internal pressure threshold to activate the anchor tool 1806 may be greater than the threshold required to activate the locator tool 1804, but lower than a pressure threshold to activate the shifting tool 1808 shown in FIG. 18. As will be appreciated, the uphole/downhole relative movement to extend the anchor elements 2002 may be reversed in other embodiments.

Figure 21:
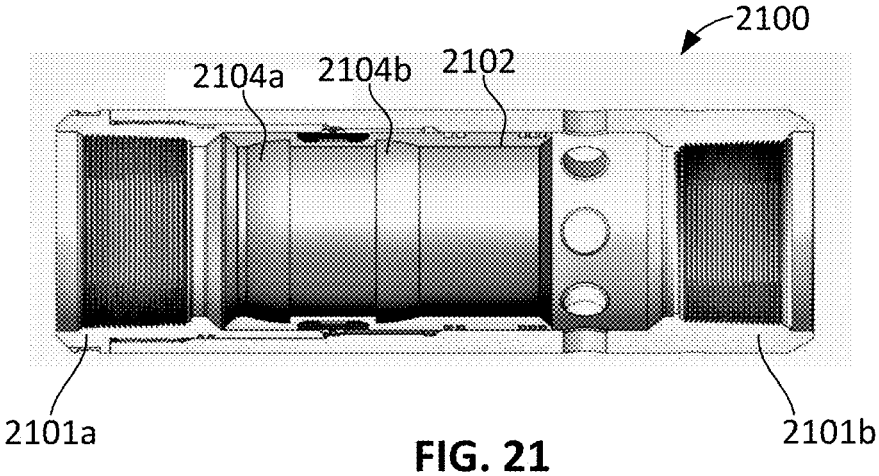
FIG. 21 is a side cross-sectional view of another example sleeve valve according to some embodiments.

FIG. 21 is a side cross-sectional view of a sleeve valve 2100 with a shiftable inner sleeve 2102 having an inner profile comprising annular grooves 2104*a* and 2104*b* that are shaped complimentary to the sleeve engagement members 1902 of the example hydraulic locator tool 1804 in FIGS. 19A and 19B. In this example, the sleeve valve 2100 has a box-to-box design with two female threaded connector ends 2101*a* and 2001*b*. In this configuration, the sleeve can be configured for either shift-up-to-open or shift-down-to-open by flipping the axial orientation of the sleeve valve 2100 (since both ends have the same female connector format. Other end connector configurations may also be used.

Figure 22:
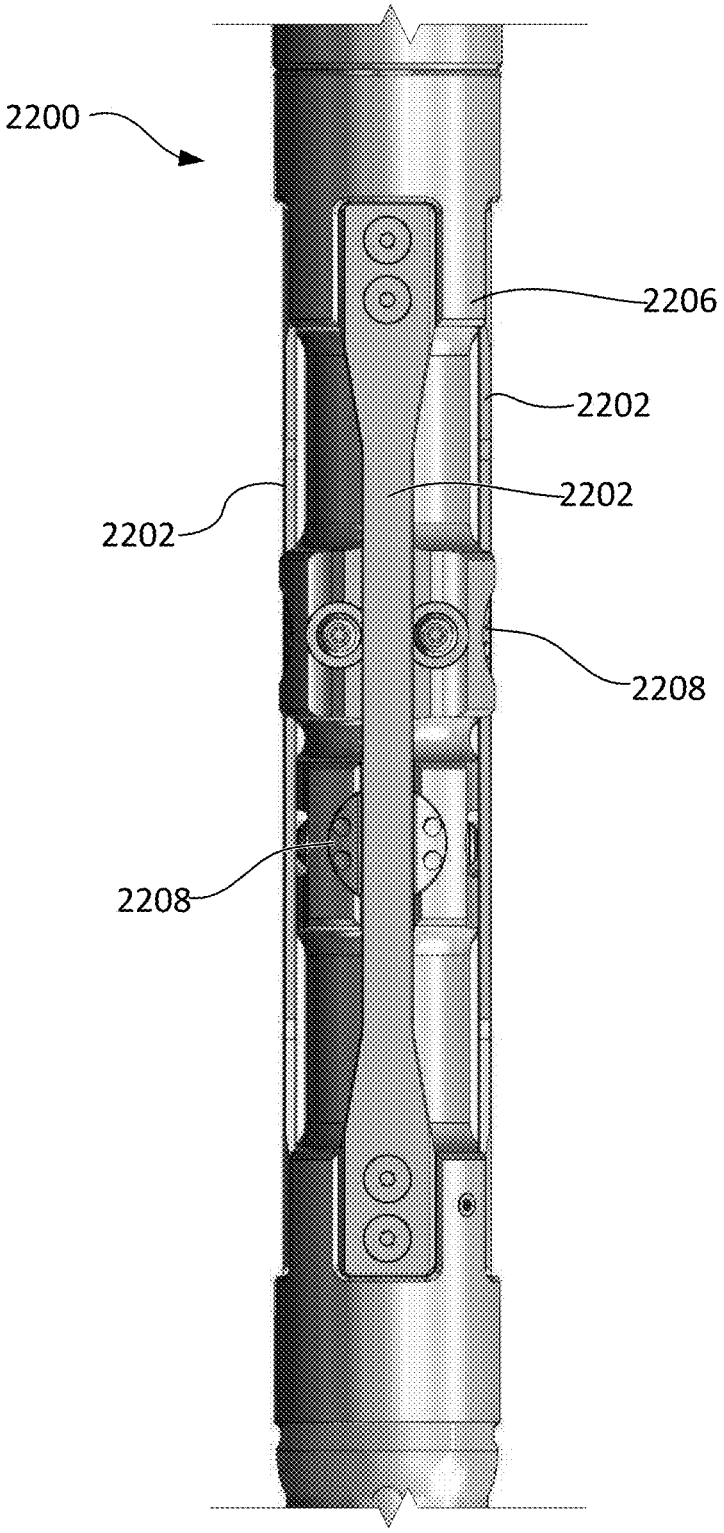
FIG. 22 is a side view of another example anchor tool according to some embodiments.

FIG. 22 is a side view of another example anchor tool 2200 in the form of a sub for a BHA. The anchor tool 2200 includes radially extendible and retractable members 2202 for engaging the inner casing wall and securing the position of the anchor sub therein. FIG. 22 shows the members 2202 in the retracted position. The extendible and retractable members 2202 in this embodiment comprise resilient bendable beams secured at opposite ends to the body 2206 of the anchor tool 2200. 22 The anchor tool 2200 further includes hydraulically actuated pistons 2208 positioned under the members 2202. The pistons 2208 are configured to move radially outward responsive to fluid flow at or above the flow rate or pressure threshold, simlar to the example anchor tool 206 shown in FIG. 3.

It is to be understood that a combination of more than one of the approaches described above may be implemented. Embodiments are not limited to any particular one or more of the approaches, methods or apparatuses disclosed herein. One skilled in the art will appreciate that variations, alterations of the embodiments described herein may be made in various implementations without departing from the scope of the claims.

What is claimed is:

1. A downhole tool system for use within a casing string including a sleeve valve comprising a shiftable inner sleeve, the downhole tool system comprising:

a locator tool comprising at least one sleeve engagement member that is hydraulically actuatable from a radially retracted configuration to a radially extended configuration for engaging the shiftable inner sleeve;

an anchor tool positioned downhole of the locator tool and comprising at least one anchor member that is hydraulically actuatable from a radially retracted configuration to a radially extended configuration for gripping an inner wall of the casing string; and a shifting tool positioned between the locating tool and the anchor tool and movable between an axially extended configuration and an axially contracted configuration, wherein the shifting tool is hydraulically actuatable to move from the axially extended configuration to the axially contracted configuration;

wherein the downhole tool system is connectable to tubing uphole of the locator tool and defines a primary inner fluid passageway therethrough, and each of the locator tool, the anchor tool, and the shifting tool are hydraulically actuatable by controlling fluid pressure or fluid flow within the primary inner fluid passageway; and wherein the locator tool is actuatable by the fluid pressure in the primary fluid passageway exceeding a first pressure threshold, the anchor tool is actuatable by the fluid pressure exceeding a second pressure threshold that is greater than the first fluid threshold, and the shifting tool is actuatable by the fluid pressure exceeding a third pressure threshold that is greater than the second pressure threshold.

2. The downhole tool system of claim 1, wherein:

the locator tool defines a first locator tool fluid path therethrough and a second locator tool fluid path, the first fluid locator tool fluid path being part of the primary fluid passage;

the locator tool comprises a locator tool activation valve, the locator tool activation valve comprising a pressure-shiftable locator tool valve component exposed to pressure within the primary fluid passage and moveable between a closed position that blocks fluid communication between the first and second locator tool fluid paths and an opened position that allows fluid communication between the first and second fluid locator tool paths, the pressure-shiftable locator tool valve component is biased to remain in the closed position when the fluid pressure within primary fluid passage is below the first pressure threshold and to shift to the opened position when the fluid pressure meets or exceeds the first pressure threshold; and the at least one sleeve engagement member is hydraulically actuatable by fluid pressure in the second locator tool fluid path.

3. The downhole tool system of claim 2, wherein the locator tool further comprises, for each at least one sleeve engagement member, a respective one or more hydraulic pistons exposed to pressure within the second locator tool fluid path and movable responsive to the pressure within the second locator tool fluid path to deflect the sleeve engagement member radially outward to the radially extended configuration.

4. The downhole tool system of claim 1, wherein:

the anchor tool defines a first anchor tool fluid path therethrough and a second anchor tool fluid path, the first fluid anchor tool fluid path being part of the primary fluid passage;

the anchor tool comprises an anchor tool activation valve, the anchor tool activation valve comprising a pressure-shiftable anchor tool valve component exposed to pressure within the primary fluid passage and moveable between a closed position that blocks fluid communication between the first and second anchor tool fluid paths and an opened position that allows fluid communication between the first and second fluid anchor tool paths, the pressure-shiftable anchor tool valve component is biased to remain in the closed position when the fluid pressure within primary fluid passage is below the second pressure threshold and to shift to the opened position when the fluid pressure meets or exceeds the second pressure threshold; and the at least one anchor member is hydraulically actuatable by fluid pressure in the second anchor tool fluid path.

5. The downhole tool system of claim 4, wherein the anchor tool further comprises, for each at least one anchor member, a respective one or more hydraulic pistons exposed to pressure within the second anchor tool fluid path and movable responsive to the pressure within the second anchor tool fluid path to deflect the anchor member radially outward to the radially extended configuration for gripping the inner wall of the casing string.

6. The downhole tool system of claim 1, wherein:

the shifting tool defines a first shifting tool fluid path therethrough and a second shifting tool fluid path, the first fluid shifting tool fluid path being part of the primary fluid passage;

the shifting tool comprises a shifting tool activation valve, the shifting tool activation valve comprising a pressure-shiftable shifting tool valve component exposed to pressure within the primary fluid passage and moveable between a closed position that blocks fluid communication between the first and second shifting tool fluid paths and an opened position that allows fluid communication between the first and second fluid shifting tool paths, the pressure-shiftable shifting tool valve component is biased to remain in the closed position when the fluid pressure within primary fluid passage is below the third pressure threshold and to shift to the opened position when the fluid pressure meets or exceeds the third pressure threshold; and wherein pressure within the second shifting tool fluid path exceeding the pressure within the first shifting tool fluid path creates a hydraulic force urging the shifting tool toward the axially contracted configuration.

7. The downhole tool system of claim 6, wherein the shifting tool further comprises one or more hydraulic cylinders that collectively generate the hydraulic compressive force responsive to the pressure within the second shifting tool fluid path.

8. The downhole tool system of claim 7, wherein the shifting tool is extendible by mechanical tension to move from the axially contracted configuration to the axially extended configuration.

9. The downhole tool system of claim 1, further comprising a selector valve positioned uphole of the locator tool, wherein:

the selector valve is extendible to an extended selector valve configuration by axial mechanical tension and contractable to a contracted selector valve configuration by axial mechanical compression;

in the extended selector valve configuration, the selector valve directs fluid from the tubing into the primary fluid passage; and in the contracted selector valve configuration, the selector valve directs fluid from tubing into an annulus between the downhole tool system and the casing string.

10. The downhole tool system of claim 1, further comprising a flow restriction device that restricts flow through the primary passageway and positioned downhole of the locator tool, the shifting tool and the anchor tool.

11. The downhole tool system of claim 1, further comprising an isolation tool positioned downhole of the anchor tool, the isolation tool comprising a resettable packer.

12. The downhole tool system of claim 11, further comprising a cycling mechanism positioned below the isolation tool.

13. The downhole tool system of claim 12, further comprising a drag block positioned downhole of the cycling mechanism.

14. A method of shifting a shiftable inner sleeve of a sleeve valve using the downhole tool system of claim 1, comprising:

running the downhole tool system downhole to a position below the sleeve valve;

locating the inner sleeve with the locator tool; and shifting the inner sleeve;

wherein locating the shiftable inner sleeve comprises:

hydraulically activating the locator tool to move the at least one sleeve engagement member from the radially retracted configuration to the radially extended configuration; and while the locator tool is activated, moving the locator tool within the casing until the at least one sleeve engagement member engages the shiftable inner sleeve; and wherein shifting the inner sleeve comprises shifting the inner sleeve from an uphole sleeve position to a downhole sleeve position comprising:

while the locator tool is activated and the inner sleeve is engaged by the locator tool:

hydraulically activating the anchor tool to move the at least one anchor member from the radially retracted anchor member configuration to the radially extended anchor member configuration; and while the locator tool and the anchor tool are activated, hydraulically activating the shifting tool to move from the axially extended configuration to the axially contracted configuration, thereby moving the shiftable inner sleeve from an uphole sleeve position to a downhole sleeve position.

15. The method of claim 14, wherein shifting the inner sleeve comprises:

running the downhole tool system downhole to a position below the sleeve valve;

hydraulically activating the locator tool to move the at least one sleeve engagement member from the radially retracted configuration to the radially extended configuration;

while the locator tool is activated:

pulling the locator tool uphole until the at least one sleeve engagement member engages the shiftable inner sleeve; and further pulling the locator tool uphole to move the shiftable inner sleeve from a downhole sleeve position to an uphole sleeve position.

* * * * *